US012642356B2

(12) United States Patent
Parker et al.

(10) Patent No.: US 12,642,356 B2
(45) Date of Patent: Jun. 2, 2026

(54) CHAIR AND COMPONENTS

(71) Applicant: FORMWAY FURNITURE LIMITED, Lower Hutt (NZ)

(72) Inventors: Kent Wallace Parker, Lower Hutt (NZ); Martyn Walter Goodwin Collings, Wellington (NZ); Wayne Douglas O'Hara, Lower Hutt (NZ); Aaron Michael Young, Lower Hutt (NZ); Paul James Stevenson, Wellington (NZ); Gavin James Bateman, Wellington (NZ); Kai Xi Lin, Wellington (NZ)

(73) Assignee: Formway Furniture Limited, Lower Hutt (NZ)

( * ) Notice: Subject to any disclaimer, the term of this patent is extended or adjusted under 35 U.S.C. 154(b) by 391 days.

(21) Appl. No.: 18/523,623

(22) Filed: Nov. 29, 2023

(65) Prior Publication Data

US 2024/0099464 A1 Mar. 28, 2024

Related U.S. Application Data

(63) Continuation of application No. 17/405,143, filed on Aug. 18, 2021, now Pat. No. 11,864,658, which is a (Continued)

(30) Foreign Application Priority Data

Feb. 5, 2016 (NZ) ..... 716713

(51) Int. Cl.
*A47C 3/025* (2006.01)
*A47C 1/02* (2006.01)
(Continued)

(52) U.S. Cl.
CPC ..... *A47C 3/0252* (2013.01); *A47C 1/02* (2013.01); *A47C 1/03261* (2013.01); (Continued)

(58) Field of Classification Search
CPC ..... A47C 3/0252; A47C 1/02; A47C 1/03261; A47C 1/033; A47C 3/025; A47C 3/0255; (Continued)

(56) References Cited

U.S. PATENT DOCUMENTS 273,630 A 3/1883 Stevens
317,933 A 5/1885 Doubler
(Continued)

FOREIGN PATENT DOCUMENTS

DE 3439917 C1 8/1985
DE 4239548 A1 4/1993
(Continued)

OTHER PUBLICATIONS

International Search Report dated May 15, 2017, issued in PCT Application No. PCT/NZ2017/050009, filed Feb. 3, 2017.
(Continued)

*Primary Examiner* — Robert Canfield
(74) *Attorney, Agent, or Firm* — Workman Nydegger

(57) ABSTRACT

A chair support shell has an integral back portion, seat portion, and joining portion between the back portion and the seat portion. At least a major portion of the support shell comprises a compliant structure, the compliant structure having a plurality of cells interconnected by a plurality of resilient members. The compliant structure provides compliance in the seat portion, compliance in the back portion, and compliance in the joining portion. The compliant structure enables recline of the back portion relative to the seat portion.

20 Claims, 39 Drawing Sheets

Related U.S. Application Data continuation of application No. 16/074,355, filed as application No. PCT/NZ2017/050009 on Feb. 3, 2017, now Pat. No. 11,122,901.

(51) Int. Cl.

| | |
|---|---|
| ***A47C 1/032*** | (2006.01) |
| ***A47C 1/033*** | (2006.01) |
| ***A47C 7/35*** | (2006.01) |
| ***A47C 7/44*** | (2006.01) |

(52) U.S. Cl.

CPC ..... *A47C 1/033* (2013.01); *A47C 3/025* (2013.01); *A47C 3/0255* (2013.01); *A47C 7/35* (2013.01); *A47C 7/44* (2013.01); *A47C 7/445* (2013.01)

(58) Field of Classification Search

CPC .. A47C 7/35; A47C 7/44; A47C 7/445; A47C 1/03277; A47C 3/027; A47C 3/12; A47C 7/14; A47C 1/024; A47C 3/02

See application file for complete search history.

(56) References Cited

U.S. PATENT DOCUMENTS

| | | | | |
|---|---|---|---|---|
| 346,311 | A | 7/1886 | Parry | |
| 822,660 | A | 6/1906 | Errick | |
| 834,670 | A | 10/1906 | Hartzler | |
| 1,219,295 | A | 3/1917 | Hadley | |
| 1,332,406 | A | 3/1920 | Pierce | |
| 1,555,689 | A | 9/1925 | Miller | |
| 2,745,468 | A | 5/1956 | Kramer | |
| 2,763,318 | A | 9/1956 | Bertoia | |
| 2,893,469 | A * | 7/1959 | Eames | A47C 3/12 297/239 |
| 3,025,105 | A * | 3/1962 | Nash | A47C 3/04 297/DIG. 2 |
| 4,084,850 | A * | 4/1978 | Ambasz | A47C 3/025 297/301.1 |
| 4,143,916 | A | 3/1979 | Trotman | |
| 4,333,683 | A * | 6/1982 | Ambasz | A47C 7/44 297/DIG. 2 |
| 4,509,793 | A | 4/1985 | Wiesmann et al. | |
| 4,585,272 | A * | 4/1986 | Ballarini | A47C 3/12 297/285 |
| 4,603,904 | A * | 8/1986 | Tolleson | A47C 7/44 297/285 |
| 4,660,887 | A | 4/1987 | Fleming | |
| 4,668,557 | A | 5/1987 | Lakes | |
| 4,892,356 | A | 1/1990 | Pittman | |
| 5,039,163 | A * | 8/1991 | Tolleson | A47C 7/445 297/297 |
| 5,195,801 | A | 3/1993 | Franck et al. | |
| 5,997,094 | A * | 12/1999 | Cvek | A47C 3/12 297/284.4 |
| 6,533,352 | B1 * | 3/2003 | Glass | A47C 7/445 297/301.5 |
| 7,857,389 | B2 | 12/2010 | Ueda | |
| 7,862,120 | B2 | 1/2011 | Ueda | |
| 7,896,439 | B2 | 3/2011 | Kan et al. | |
| 8,567,864 | B2 * | 10/2013 | Deisig | A47C 3/045 297/285 |
| 8,820,835 | B2 | 9/2014 | Minino et al. | |
| 8,967,147 | B2 | 3/2015 | Martin | |
| 8,991,924 | B2 * | 3/2015 | Piretti | A47C 7/445 297/285 |
| D726,431 | S | 4/2015 | Genlin | |
| 9,504,326 | B1 | 11/2016 | Cartis | |
| 9,538,847 | B2 * | 1/2017 | Romero | A47C 1/03261 |
| 9,706,847 | B2 * | 7/2017 | Piretti | A47C 5/04 |
| 9,936,755 | B2 | 4/2018 | Blakey | |
| D863,807 | S | 10/2019 | Parker | |
| D869,189 | S | 12/2019 | Parker | |
| D869,216 | S | 12/2019 | Parker | |
| 11,291,305 | B2 | 4/2022 | Deevers | |
| 11,324,323 | B2 | 5/2022 | Deevers | |
| 2002/0021040 | A1 | 2/2002 | Caruso et al. | |
| 2003/0088900 | A1 | 5/2003 | Cho | |
| 2004/0195881 | A1 | 10/2004 | Wells | |
| 2005/0142331 | A1 | 6/2005 | Anderson | |
| 2006/0103222 | A1 | 5/2006 | Caruso et al. | |
| 2008/0248710 | A1 | 10/2008 | Wittne | |
| 2009/0085386 | A1 | 4/2009 | McCoy et al. | |
| 2012/0228911 | A1 * | 9/2012 | Piretti | A47C 3/12 297/285 |
| 2013/0082499 | A1 | 4/2013 | Schmitz et al. | |
| 2014/0239698 | A1 | 8/2014 | Griggs, Jr. | |
| 2014/0361588 | A1 * | 12/2014 | Romero | A47C 1/03294 297/341 |
| 2015/0190269 | A1 | 7/2015 | Lenoble | |
| 2015/0265052 | A1 | 9/2015 | Gehner et al. | |
| 2015/0320220 | A1 | 11/2015 | Eberlein | |
| 2016/0235206 | A1 * | 8/2016 | Piretti | A47C 7/16 |
| 2016/0316916 | A1 * | 11/2016 | Pectol | A47C 7/445 |
| 2018/0235367 | A1 * | 8/2018 | Ostwald | A47C 3/023 |
| 2021/0235872 | A1 | 8/2021 | Koch | |
| 2021/0368984 | A1 | 12/2021 | Parker et al. | |
| 2021/0386151 | A1 | 12/2021 | Blakey | |

FOREIGN PATENT DOCUMENTS

| | | | | |
|---|---|---|---|---|
| DE | 10 2005 042 811 | A1 | 3/2007 | |
| DE | 10 2006 036 816 | A1 | 2/2008 | |
| DE | 10 2018 133405 | A1 | 6/2020 | |
| EP | 0210710 | A1 | 2/1986 | |
| EP | 0210710 | A2 | 2/1987 | |
| EP | 0591932 | A1 | 4/1994 | |
| EP | 0982180 | A1 | 3/2000 | |
| EP | 2110051 | A1 * | 10/2009 | A47C 7/445 |
| SE | 312 213 | | 7/1969 | |
| WO | 1991/101210 | A | 2/1991 | |
| WO | 2001/30202 | A1 | 5/2001 | |
| WO | 2003/022085 | A2 | 3/2003 | |
| WO | 2006/113232 | A2 | 10/2006 | |
| WO | 2006/115381 | A2 | 11/2006 | |
| WO | 2015/041796 | A1 | 3/2015 | |
| WO | 2015/132543 | A1 | 9/2015 | |
| WO | 2021/040718 | A1 | 3/2021 | |

OTHER PUBLICATIONS

Written Opinion dated May 15, 2017, issued in PCT Application No. PCT/NZ2017/050009, filed Feb. 3, 2017.

Extended European Search Report, completed Apr. 1, 2021, from EP21164396.0.

Institute fur Architektur und Medien, *Scan Your Bodyshape*, believed published about 2010, 2 pages.

Mina Konakovic et al., *Beyond Developable: Computational Design and Fabrication with Auxetic Materials*, Siggraph' 16 Technical Paper, Jul. 24-28, 2016, 11 pp.

Allsteel Brochure, *Inspire*, cms.allsteeloffice.com/SynergyDocuments/InspireBrochure.pdf, publication date unknown but believed published prior to Aug. 3, 2017.

Moooi Carbon Chair by Bertjan Pot + Marcel Wanders, 2004, https://www.moooi.com/products/carbon-chair, 5 pp.

Variation from Uniformity, https://spacesymmetrystructure.wordpress.com/2012/10/15/variation-from-uniformity/—publication date appears to be Oct. 2012, 4 pp.

Konstantin Grcic Industrial Design, Myto projects, http://konstantin-grcic.com/projects/myto/, published as early as 2008, pp. 14.

Hermam Miller (USA), + Vitra (EU) DAW by Charles and Ray Eames, 1950, https://www.vitra.com/en-ch/living/product/details/eamesplastic-armchair-daw.

Hermam Miller (USA), + Vitra (EU) DAW by Charles and Ray Eames, 1950, https://www.vitra.com/en-ch/living/product/details/eamesplastic-side-chair-dsw.

Hermam Miller (USA), + Vitra (EU) DAW by Charles and Ray Eames, 1951, https://www.vitra.com/en-gb/living/product/details/wirechair-dkx.

(56) References Cited

OTHER PUBLICATIONS

Hay, About a Chair 22 (AAC22), by Hee Welling, 2010, http://hay.dk/en/products/furniture/seating/chairs/about-a-chair.
9 page PDF, Pater titled: *Auxetic Material: Classification, Mechanical Property and Applications*, A V Mazaev et al., 202 IOP Conf, Ser,: Mater. Sci. Eng. 747 012008 (Year 2020.
4 page PDF, Dupont™ Hytrel® Thermoplastic Polyester Elastomer Product Reference Guide, Reference No. HYE-A11192-00-B0915, downloaded Jun. 2023, (Year: 2020.).

* cited by examiner (i)

(ii)

(i)

(ii)

(i)

(ii)

(iii)

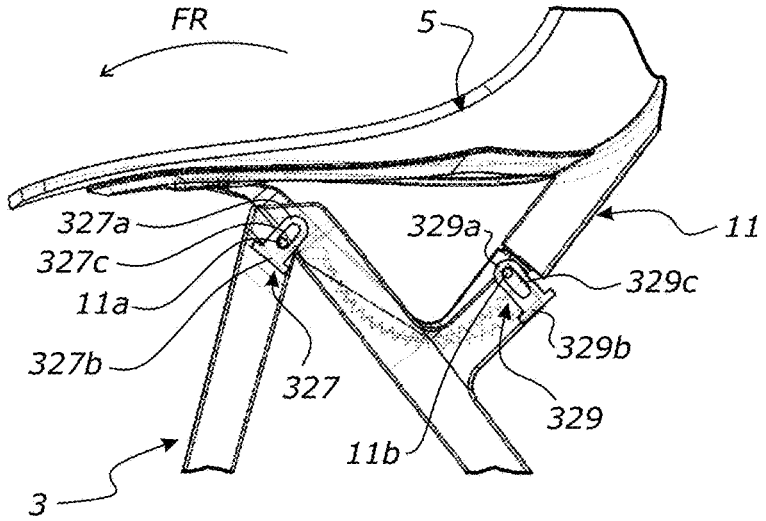
(i)
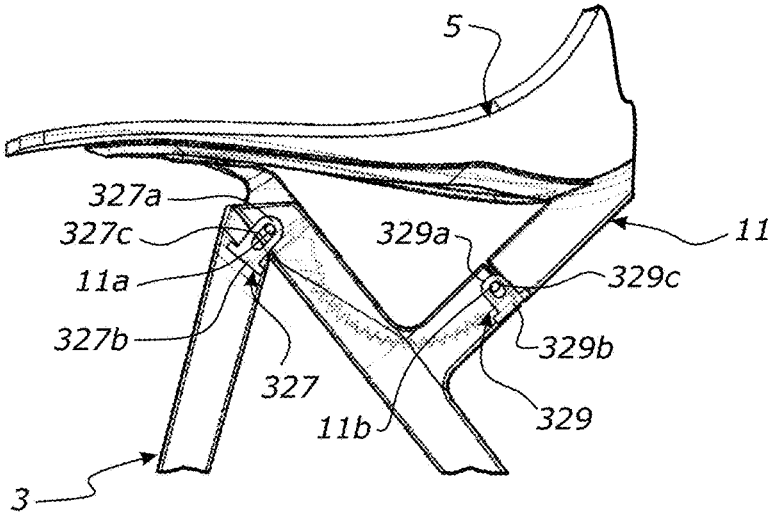
(ii)
FIGURE 38
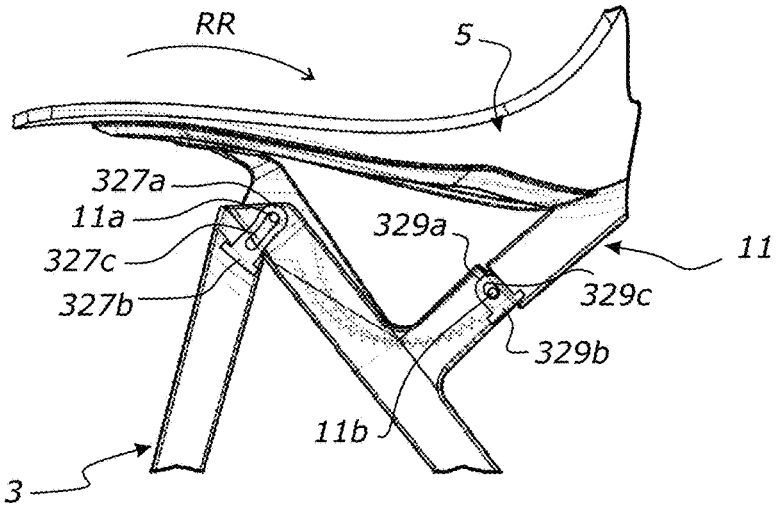
(iii)

CHAIR AND COMPONENTS

CROSS-REFERENCE TO RELATED APPLICATIONS

This application is a continuation of U.S. application Ser. No. 17/405,143, filed Aug. 18, 2021, which is a continuation of U.S. application Ser. No. 16/074,355, filed Jul. 31, 2018, which is a nationalization of PCT Application No. PCT/NZ2017/050009, filed Feb. 3, 2017, which claims priority to New Zealand Application No. 716713, filed Feb. 5, 2016, which are incorporated herein by specific reference.

BACKGROUND OF THE INVENTION

1. The Field of the Invention

This invention relates to a chair and related components. More particularly, the invention relates to a rocking mechanism and/or to a seat shell with a compliant structure and/or to a recline mechanism.

Background

Many existing rocking and reclining chairs have bulky mechanisms to provide the rocking or the reclining motion. Such mechanisms can be unsightly, or are aesthetically more acceptable in pedestal-type task chairs than in household chairs such as dining chairs.

Dining chairs are traditionally upright, rigid chairs, with four legs, often chosen for their aesthetic appeal. Such chairs typically provide very little ergonomic support to an occupant. In addition to meal-time use, household dining chairs are often used for extended periods of time by household members, for example for working at a laptop at the table, making ergonomic support desirable.

Further, complex mechanisms of the type found in task chairs can be prohibitively expensive to apply to household chairs such as dining chairs and other chairs that are bought in large numbers such as meeting chairs, where the purchase of multiple chairs is necessary and a lower cost is desirable.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to address at least one of the disadvantages outlined above and/or to at least provide the public with a useful alternative.

SUMMARY OF THE INVENTION

In accordance with a first aspect of the present invention, there is provided a chair support shell comprising an integral back portion, seat portion, and joining portion between the back portion and the seat portion. At least a major portion of the support shell comprises a compliant structure. The compliant structure has a plurality of cells interconnected by a plurality of resilient members. The compliant structure provides compliance in the seat portion, compliance in the back portion, and compliance in the joining portion. The compliant structure enables recline of the back portion relative to the seat portion.

In an embodiment, the cells and the resilient members define a plurality of voids. In an embodiment, the voids are Y-shaped. The Y-shaped voids may be provided in a series of offset rows and/or columns. Alternatively, the voids may be a different shape.

In an embodiment, the cells are substantially triangular, for example, equilateral, scalene, or isosceles triangles in plan view. A plurality of the resilient members may extend from each cell. In an embodiment, three of the resilient members extend from each cell. For example, three of the resilient members may extend from each corner of a triangular cell at approximately 120 degrees to each other.

An occupant-facing surface of the cells may have a recess. Additionally or alternatively, the non occupant-facing surface of the cells may comprise a recess. The recess in the non-occupant-facing surface may be deeper than the recess in the occupant-facing surface.

The resilient members may be substantially straight or they may be curved. The thickness of the resilient members may be constant or may vary, and may have a filet/radius where they join the cells.

In an embodiment, the cells and resilient members together define an auxetic structure; that is, a structure having a negative Poisson's ratio. In such an embodiment, the auxetic behaviour is in the plane of the structure.

In an embodiment, the support shell is configured to cause deformation of the joining portion, as the back portion is reclined. The support shell may, for example, be configured to cause contraction and/or extension of the joining portion in a first direction and/or a second orthogonal direction, as the back portion is reclined. The support shell may be configured to cause contraction and/or extension of the joining portion in both the first direction and second orthogonal direction, as the back portion is reclined.

In an alternative embodiment, the back portion may not be reclinable relative to the seat portion. In that embodiment, the compliant structure may be provided soley to provide compliance and occupant comfort in the seat portion, back portion, and/or the joining portion between the seat portion and back portion.

In an embodiment, the support shell comprises a single piece of injection moulded plastic.

The support shell may comprise a solid perimeter portion that is substantially non-compressible and substantially non-extendible, such that a length of the perimeter is substantially unchanged as the back portion reclines or flexes, or as the seat portion flexes. The solid perimeter could extend around the entire perimeter of the shell or could only extend around a portion of the perimeter of the shell.

In an embodiment, the compliant structure comprises resilient members of differing thicknesses, the thicknesses being selected to provide regions of greater and/or lesser compliance within the compliant structure. In such an embodiment, thicker resilient members are provided in regions where less compliance is desirable and thinner resilient members are provided in regions where more compliance is desirable. Alternatively or additionally, the compliant structure may comprise resilient members of differing lengths, the lengths being selected to provide regions of greater and lesser compliance in the compliant structure. In such an embodiment, shorter resilient members are provided in regions where less compliance is desirable and longer resilient members are provided in regions where more compliance is desirable.

The shell may comprise solid, substantially non-compressible attachment regions for attachment to a chair support structure. For example, for attachment to a back support, seat support, transom, or base. The solid attachment regions may comprise areas of the compliant structure where the voids are 'filled in'. Additionally or alternatively, the shell may comprise structural regions for other purpose(s). For example, the structural regions may comprise solid regions or relatively stiff regions, to provide reduced compliance in the structural regions. The structural regions may be solid and/or may be relatively thick. The structural regions may comprise lifting regions or straps to assist with lifting the seat portion as the back portion is reclined and/or may comprise regions to provide occupant support.

In accordance with a second aspect of the present invention, there is provided a chair comprising the support shell as described above in relation to the first aspect.

The chair may comprise a chair support structure and a recline mechanism coupling the back portion of the shell to the chair support, the recline mechanism facilitating recline of the back portion relative to the chair support structure. Part of the total recline of the back portion of the shell may be provided by the compliance and flex in the support shell, and part of the recline may be provided by the recline mechanism.

In an embodiment, the chair further comprises a rocking mechanism that couples the seat portion of the shell to the chair support to facilitate rocking motion of the shell relative to the chair support.

An occupant-facing surface and/or an opposite surface of the support shell may be upholstered.

In accordance with a third aspect of the present invention, there is provided a chair comprising a support shell having a seat portion and a back portion, a transom, and a recline mechanism. The recline mechanism comprises: a resilient front support member having a first end operatively attached to the transom and a second end operatively attached to a front part of the seat portion; and a back support arm having a lower end operatively rigidly attached to the transom, an upper end operatively rigidly attached to the back portion, and a flex region having a rearward flexibility that is greater than the rearward flexibility of the rest of the back support arm. The back portion is reclinable relative to the seat portion and a rear part of the seat portion is configured to lift as the shell back portion reclines.

In an embodiment, the back support arm is attached to a lumbar and/or upper portion of the back portion. The chair may comprise a single back support arm, two back support arms, or more than two back support arms.

In an embodiment, the recline mechanism comprises two resilient front support members. The front support member second ends may be positioned more laterally outward than the first ends. The recline mechanism may comprise a single front support member, two front support members, or more than two front support members.

In an embodiment, the back support arm flex region(s) comprise a series of transverse notches or slots, said notches or slots providing the greater rearward flexibility. The notches or slots may be provided on a front side of the back support arm(s). In an alternative embodiment, portion(s) of the back support arm may comprise thinned or necked region(s) to provide the greater rearward flexibility.

In an embodiment, the back support arm upper end(s) is/are operatively rigidly attached to a lumbar portion of the back portion. Alternatively, the back support arm upper end(s) may be rigidly attached to the upper portion of the back portion. The back support arm(s) may be integral with back portion of shell, or may be a separate member mechanically attached to the back shell.

The back support arm may be directly bolted or otherwise attached to the transom, or it may be attached via a back arm or transom extension. In an alternative form, the back support arm may be integrally moulded with the transom.

In an embodiment, the seat lift is partially controlled by a length and stiffness of the front support member(s).

In an embodiment, at least a major portion of the support shell comprises a compliant structure, the compliant structure having a plurality of cells interconnected by a plurality of resilient members. The compliant structure, in combination with the support arms, may enable recline of the back portion relative to the seat portion.

The chair may comprise the support shell as described above in relation to the first aspect.

In accordance with a fourth aspect of the present invention, there is provided a chair comprising a base, a transom supported on the base, a seat portion and a back portion supported on the transom, and a rocking mechanism configured to enable the transom to rock forward and rearward relative to the base. The rocking mechanism comprises a concave rock surface provided on the base; a convex rock surface operatively provided on the transom and arranged to be in rolling contact with the concave rock surface, the convex rock surface having a radius of curvature less than a radius of curvature of the concave rock surface; and complementary engagement features operatively provided on the transom and on the base.

In an embodiment, the rocking mechanism comprises at least one biasing member acting between the transom and the base to bias the transom to a neutral position, wherein the transom can be rocked forwards and/or rearwards from the neutral position. In an alternative embodiment, the biasing member(s) may not be provided, and the transom may return to the neutral position under the influence of gravity and/or the weight of a chair occupant.

In an embodiment, the engagement features comprise at least one tooth provided on one of the base and the transom, and a complementary recess or teeth provided on the other one of the transom, wherein the tooth is seated in the complementary recess or between the teeth when the transom is in a neutral position, and configured such that rocking the transom forwards or rearwards moves the tooth away from its seated position.

In an embodiment, the engagement features comprise a plurality of teeth provided on one of the base and the transom, and complementary recesses and/or teeth provided on the other one of the base and the transom. In an embodiment, at least one of the teeth is seated in a complementary recess and/or between the teeth when the transom is in a neutral position, and configured such that rocking the transom forward or rearwards moves the at least one of the teeth away from its seated position. The teeth may be provided by a gear on the transom, and the recesses and/or teeth may be provided by a curved array of recesses and/or teeth on the base, the gear being in rolling contact with the curved array of recesses and/or teeth. In an embodiment, the convex rock surface is adjacent the gear and the concave rock surface is adjacent the curved array of recesses and/or teeth.

The gear may be a spur gear. Alternatively, other types of tooth profile or gear could be used.

The curved array of recesses and/or teeth may be provided by a curved rack.

In an embodiment, the rocking mechanism comprises two laterally spaced coaxial gears and two respective laterally spaced curved arrays of recesses and/or teeth. Such an embodiment may further comprise two convex rock surfaces and two concave rock surfaces, each concave and convex rock surface being adjacent to a respective one of the gears or curved arrays of recesses and/or teeth.

In an embodiment, the spur gear is a partial spur gear. In an embodiment, the spur gear teeth have varying profiles. Alternatively the teeth profiles may all be the same. In an embodiment, the spur gear teeth have an involute profile to encourage rolling contact between teeth.

The or each convex rock surface may have a radius of curvature that is substantially the same as a pitch radius of the spur gear(s), and the or each concave rock surface may have a radius of curvature that is substantially the same as a pitch radius of the curved array(s) of recesses and/or teeth.

In an embodiment, the convex rock surface(s) is/are concentric with the spur gear(s), and the concave rock surface(s) is/are concentric with the curved rack(s).

In an embodiment, a forward portion of the gear(s) is substantially in line with a rear portion of the gear(s), and a forward portion of the curved array(s) of recesses and/or teeth is substantially in line with a rear portion of the curved array(s) of recesses and/or teeth. In an alternative configuration, a portion of the gear(s) may be offset from another portion of the gear(s). Similarly, a portion of the curved array(s) may be offset from another portion of the curved array(s). For example, a front portion of the gear(s) and curved array(s) may be positioned laterally outwardly of a rear portion of the gear(s) and curved array(s), or a front portion of the gear(s) and curved array(s) may be positioned laterally inwardly of a rear portion of the gear(s) and curved array(s).

In an embodiment, running/gear surfaces of teeth of the gear(s) and/or of the curved array(s) are parallel to each other, but the gear(s) and the curved array(s) are angled.

In an alternative embodiment, the engagement features comprise high friction surface(s) on the convex and/or concave surfaces. The convex rock surface may comprise a single tooth, the concave rock surface may comprise a complementary recess, and the convex and/or concave surfaces may have a high friction surface to reduce or eliminate slip between the contacting surfaces.

In an embodiment, the convex and concave rock surfaces each have a constant radius of curvature.

In an embodiment, the radius of curvature of each of the convex and concave rock surfaces varies along the surface. For example, the radius of curvature of each of the convex and concave rock surfaces may be smaller at a rear of the surfaces than at a front of the surfaces.

In an embodiment, the at least one biasing member comprises a front spring and a rear spring, the springs acting between the transom and the base. The rocking mechanism may comprise two front springs and two rear springs. The rocking mechanism may comprise more than two front springs and/or more than two rear springs. The front spring(s) may be symmetrical with the rear spring(s), in a side view, about a frontal plane that is coincident with the neutral contact point. Alternatively, the front and rear spring(s) may be asymmetric.

In an embodiment, the springs may be configured to act only in tension, only in compression, or both in tension and in compression. For example, the springs may be configured to act only in tension. In that configuration, the front spring(s) will resist rearward rock and the rear spring(s) will resist forward rock. In an alternative configuration, the springs may be configured to act only in compression. In that configuration, the front spring(s) will resist forward rock and the rear spring(s) will resist rearward rock. The springs may act in one direction and lose contact or decouple in the opposite direction.

A spring rate of the front spring(s) may be the same as or different to a spring rate of the rear spring(s). For example, in one embodiment, the spring rate of the front spring(s) is about twice the spring rate of the rear spring(s).

In an embodiment, the biasing member(s) comprise coil spring(s). Alternatively the biasing member(s) could comprise one or more leaf springs or springs in the form of resilient blocks or members.

In an embodiment, the chair further comprises a forward and/or rear stop to limit rock of the transom relative to the base. The stop may comprise a curved slot provided on the base or the transom, and a pin provided on the other of the base or the transom, the pin being slidable in the slot between a front limit position and a rear limit position. In an alternative embodiment, the stop(s) may be provided by different features, such as by resilient stop blocks or members that compress to provide a soft stop. The forward and/or rear stop may be incorporated into a forward and/or rear spring. Alternatively, the chair may comprise rigid geometric limit(s).

In an embodiment, the seat portion and the back portion are movably mounted on the transom. The back portion may be reclinable relative to transom and the seat portion. For example, the seat portion and back portion may be mounted on the transom by way of the recline mechanism described above in relation to the third aspect.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(s)' following a noun means the plural and/or singular form of that noun.

As used herein the term 'and/or' means 'and' or 'or', or where the context allows both.

The invention consists in the foregoing and also envisages constructions of which the following gives examples only.

BRIEF DESCRIPTION OF THE DRAWINGS

The present invention will now be described by way of example only and with reference to the accompanying drawings in which:

FIGS. 38(*i*) to 38(*iii*) are side views showing the rocking motion of the chair with alternative biasing members, where FIG. 38(*i*) shows the chair in a forward rocked configuration, FIG. 38(*ii*) shows the chair in a neutral position, and FIG. 38(*iii*) shows the chair rocked rearwardly;

Figure 39:
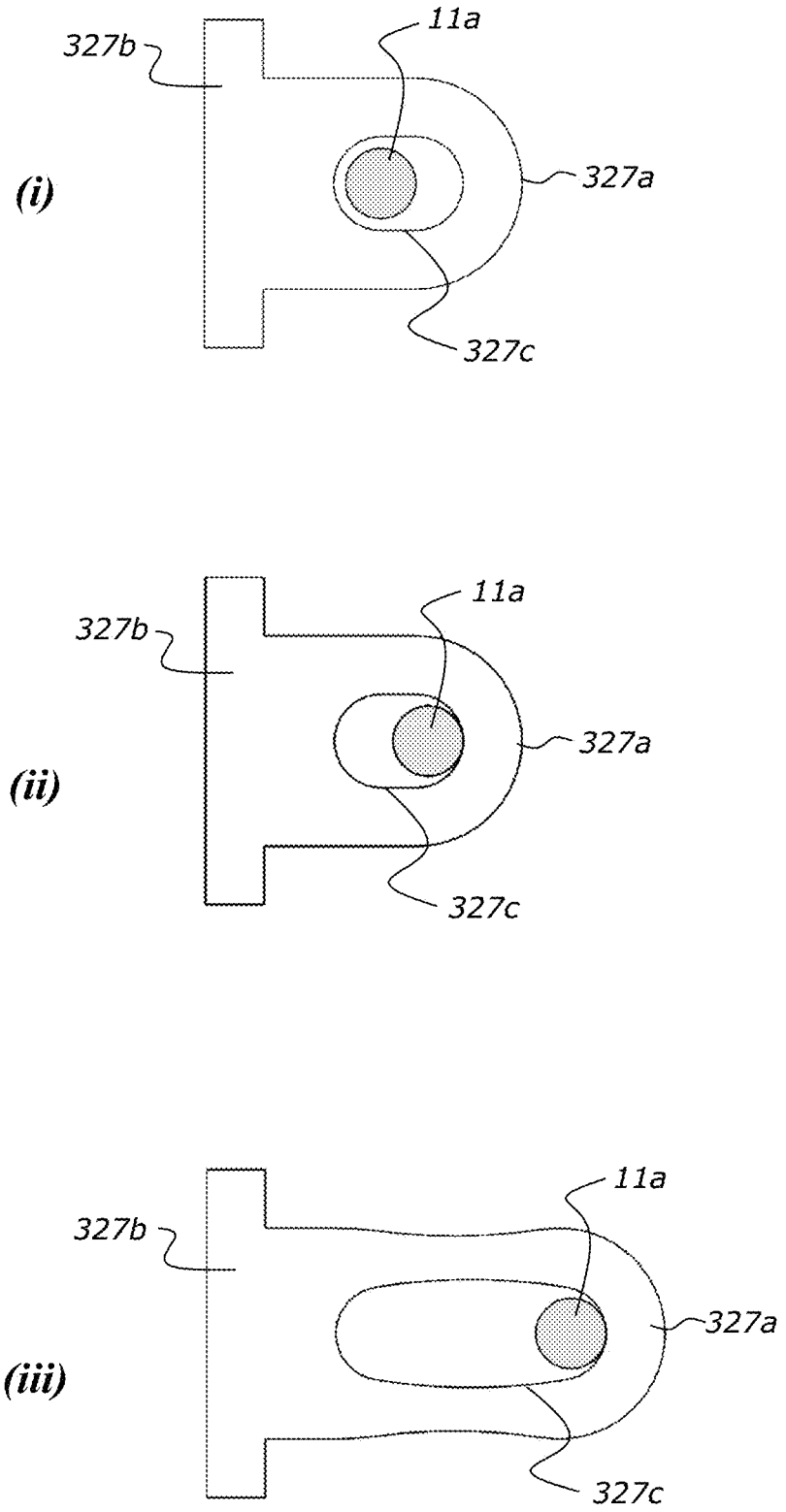
FIGS. 39(*i*) to 39(*iii*) are side views of the front biasing member of the chair of FIGS. 38(*i*) to 38(*iii*), where FIG.
Figure 40:
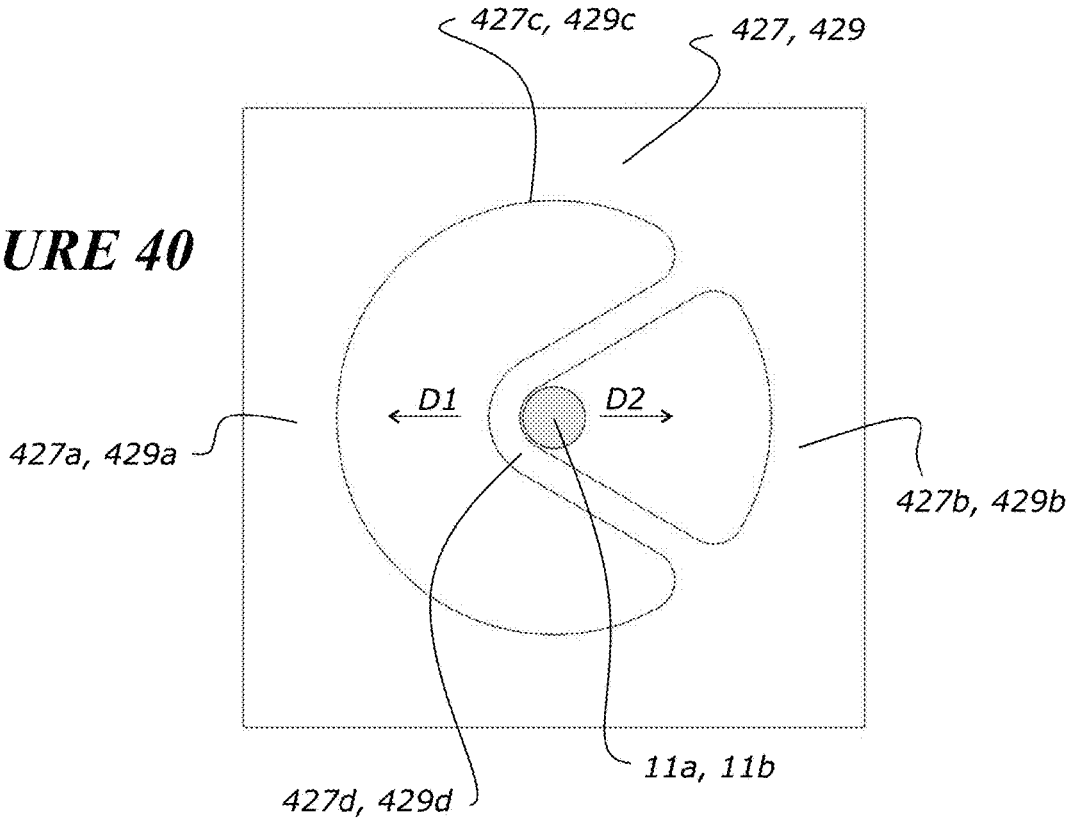
Figure 41:
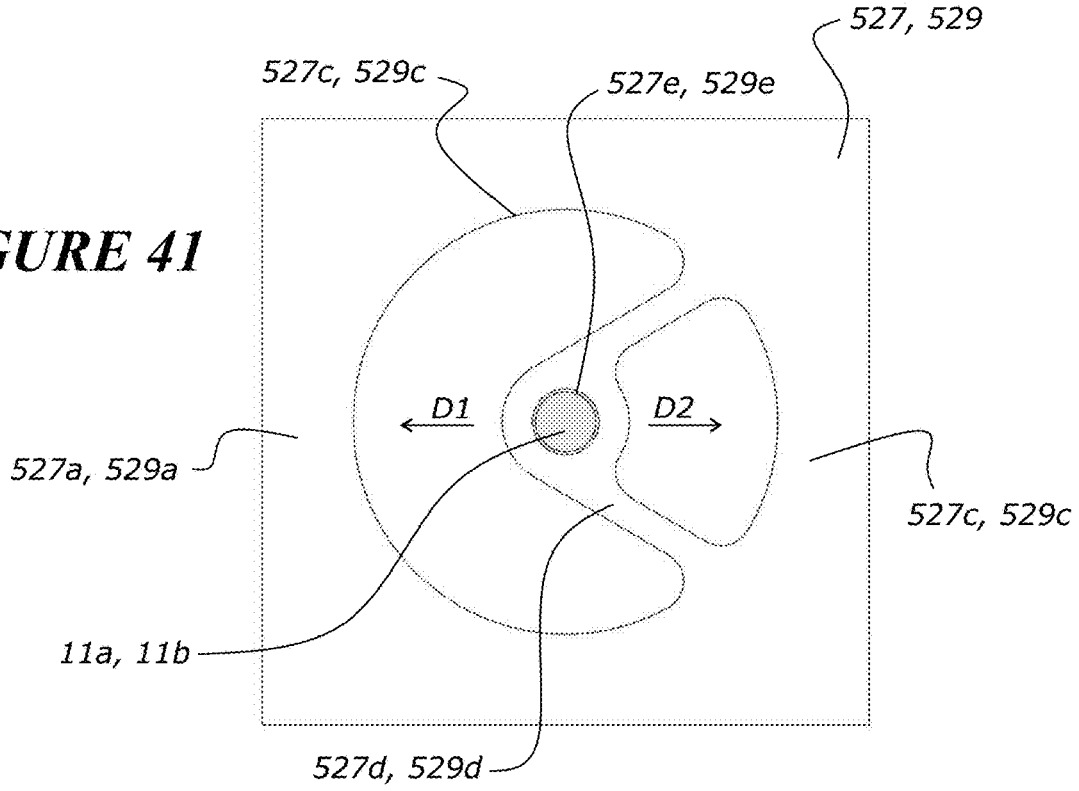
Figure 42:
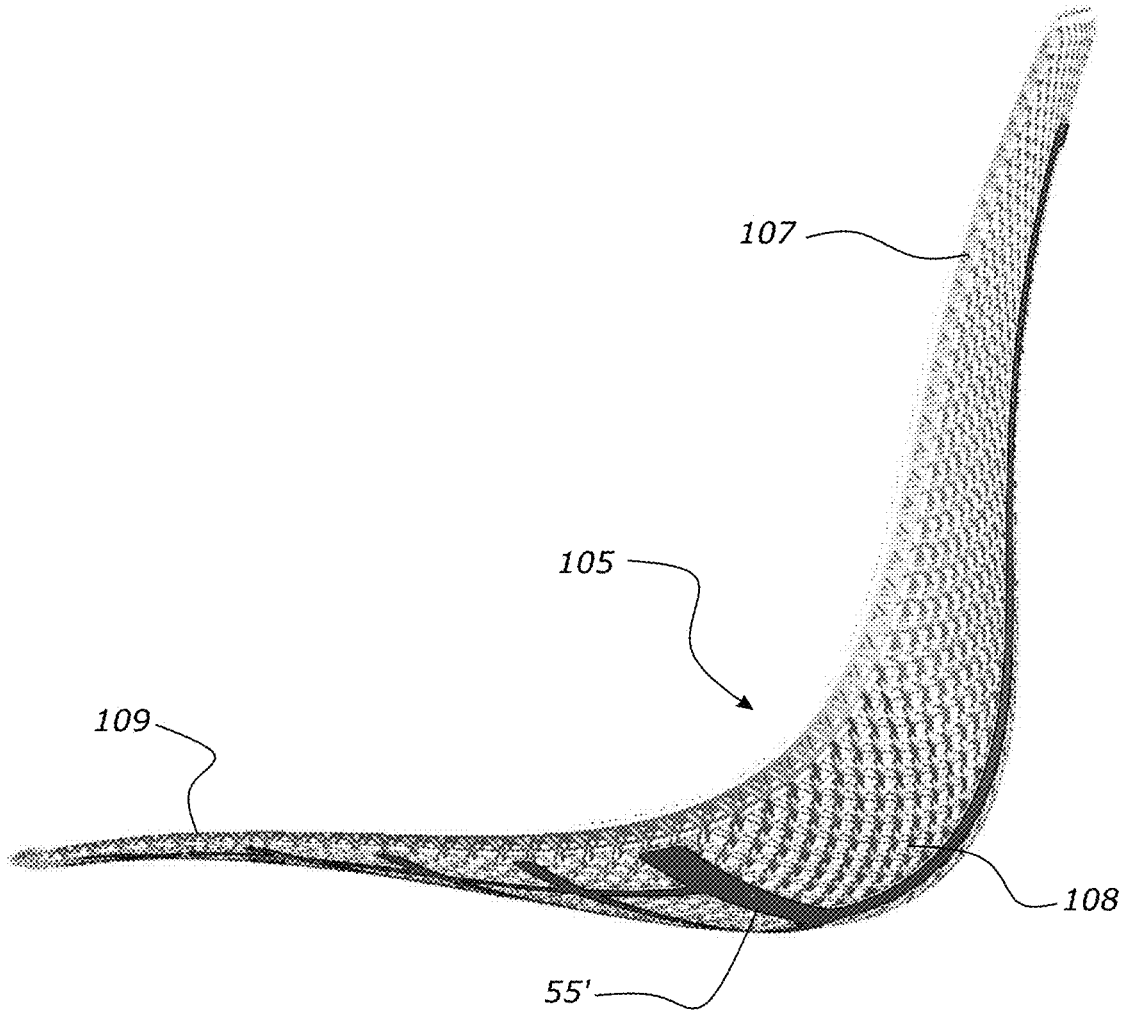
Figure 43:
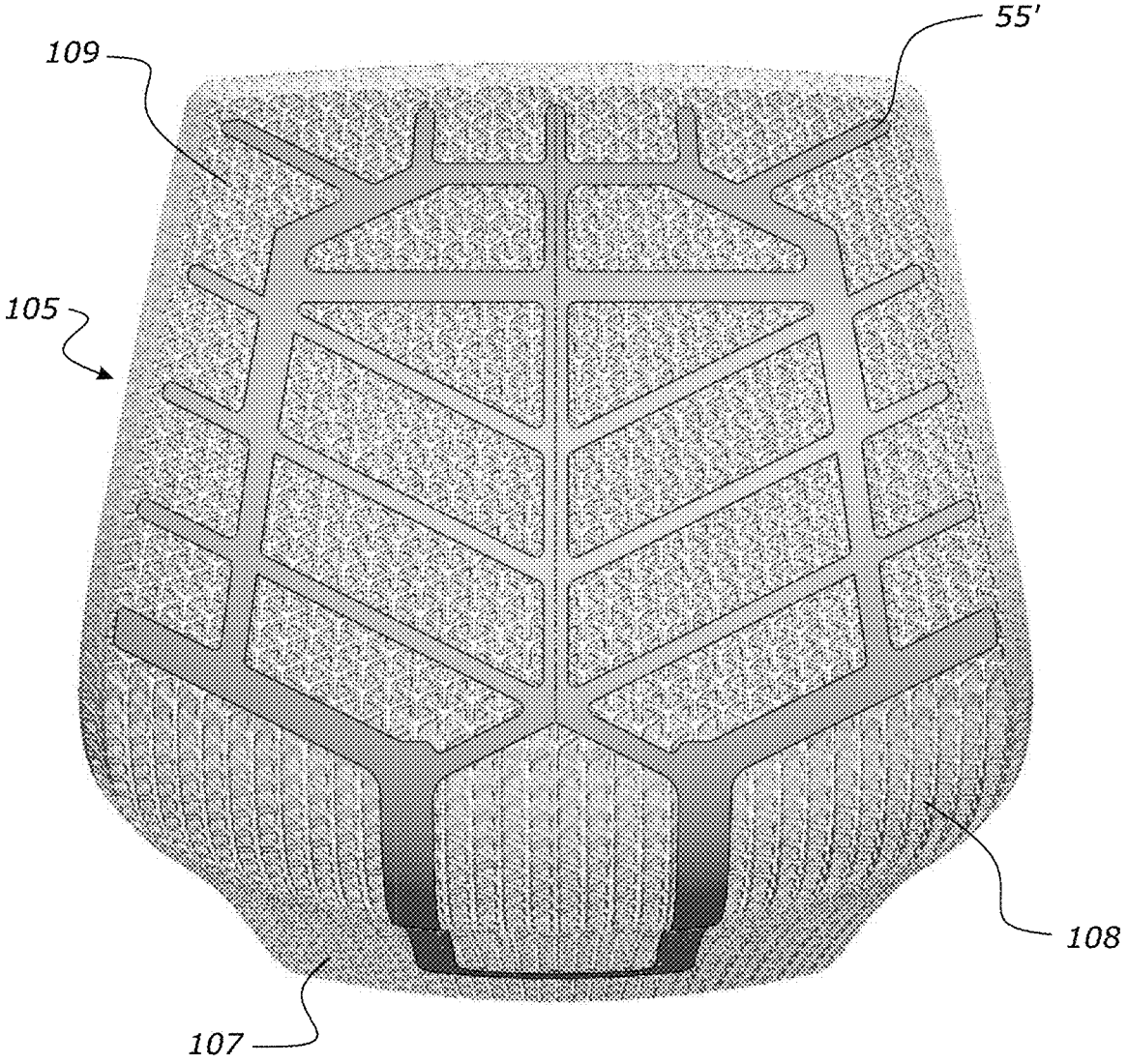

39(*i*) shows the front biasing member when the chair is in a forward rocked configuration, FIG. 39(*ii*) shows the front biasing member when the chair is in a neutral position, and FIG. 39(*iii*) shows the front biasing member when the chair rocked rearwardly;

FIG. 40 is a side view of an alternative biasing member for use in the chair;

FIG. 41 is a side view of another alternative biasing member for use in the chair;

FIG. 42 is a side view of an alternative compliant shell of the chair with solid regions for occupant support and to provide seat portion lifting straps; and FIG. 43 is an underside view of the compliant shell of FIG. 42.

DETAILED DESCRIPTION OF EMBODIMENTS

Figure 1:
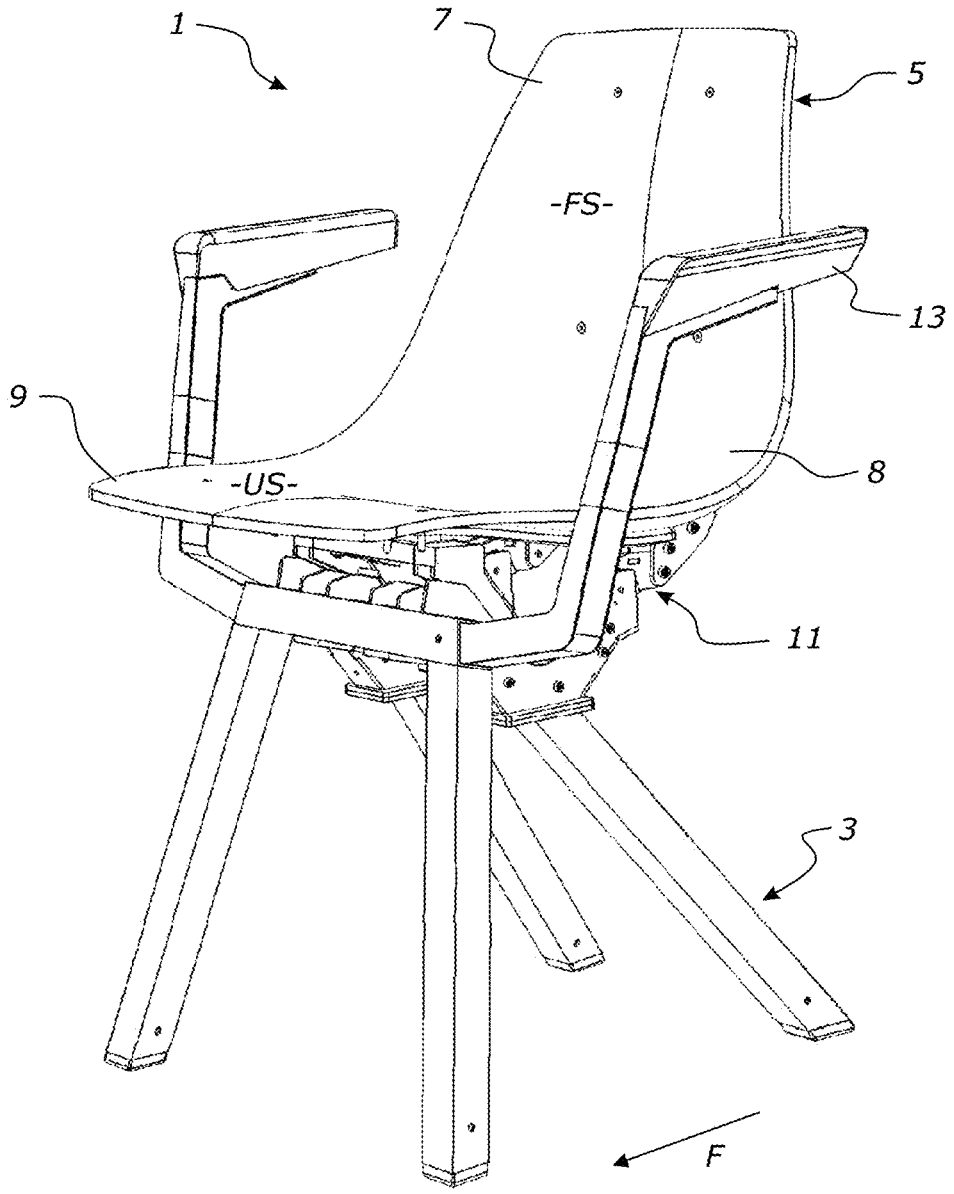
FIG. 1 is a perspective view of a rockable, reclinable chair in accordance with a first exemplary form of the present invention, in a neutral rock, upright configuration.
Figure 2:
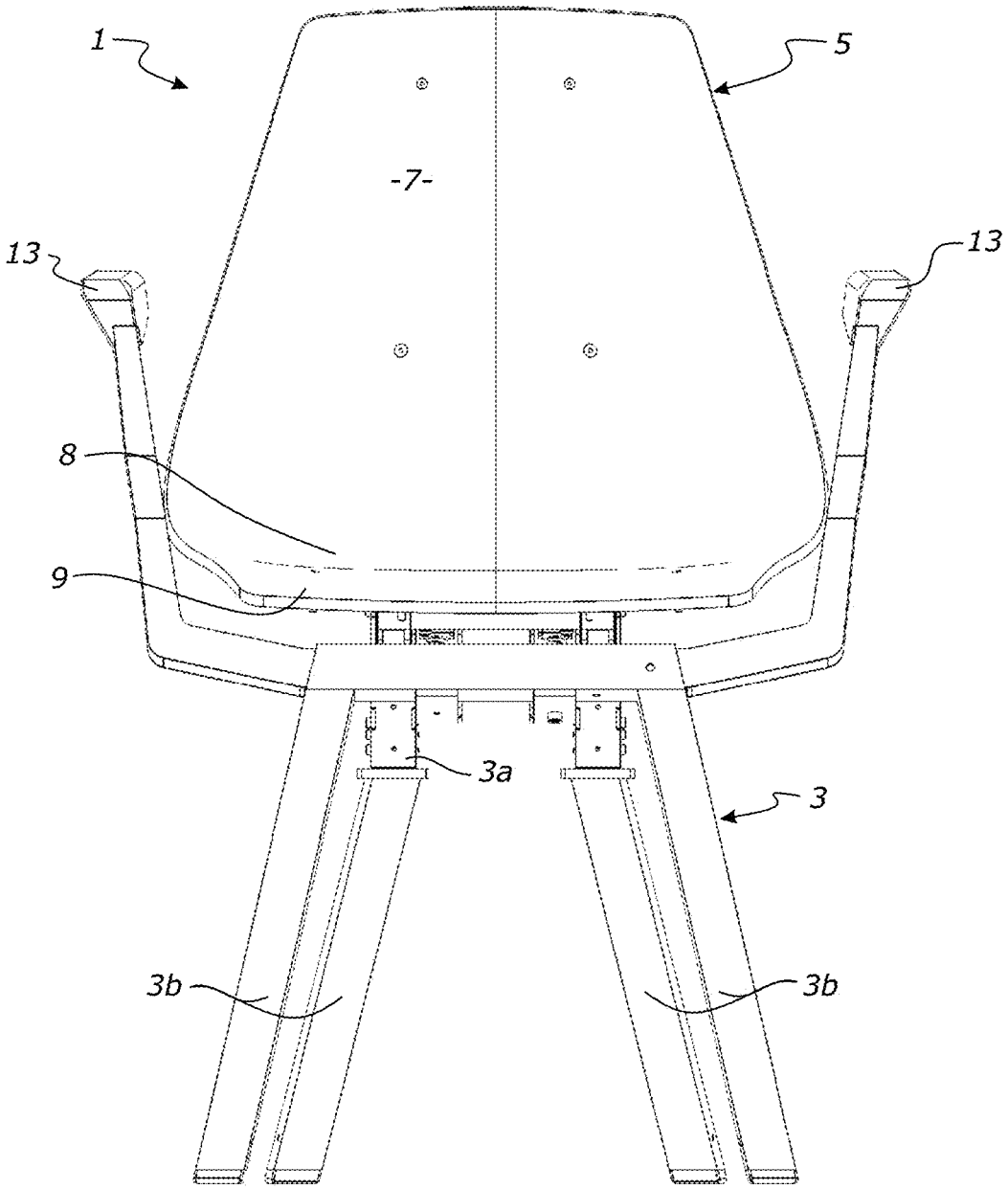
FIG. 2 is a front view of the chair of FIG. 1 in a neutral rock, upright configuration.
Figure 3:
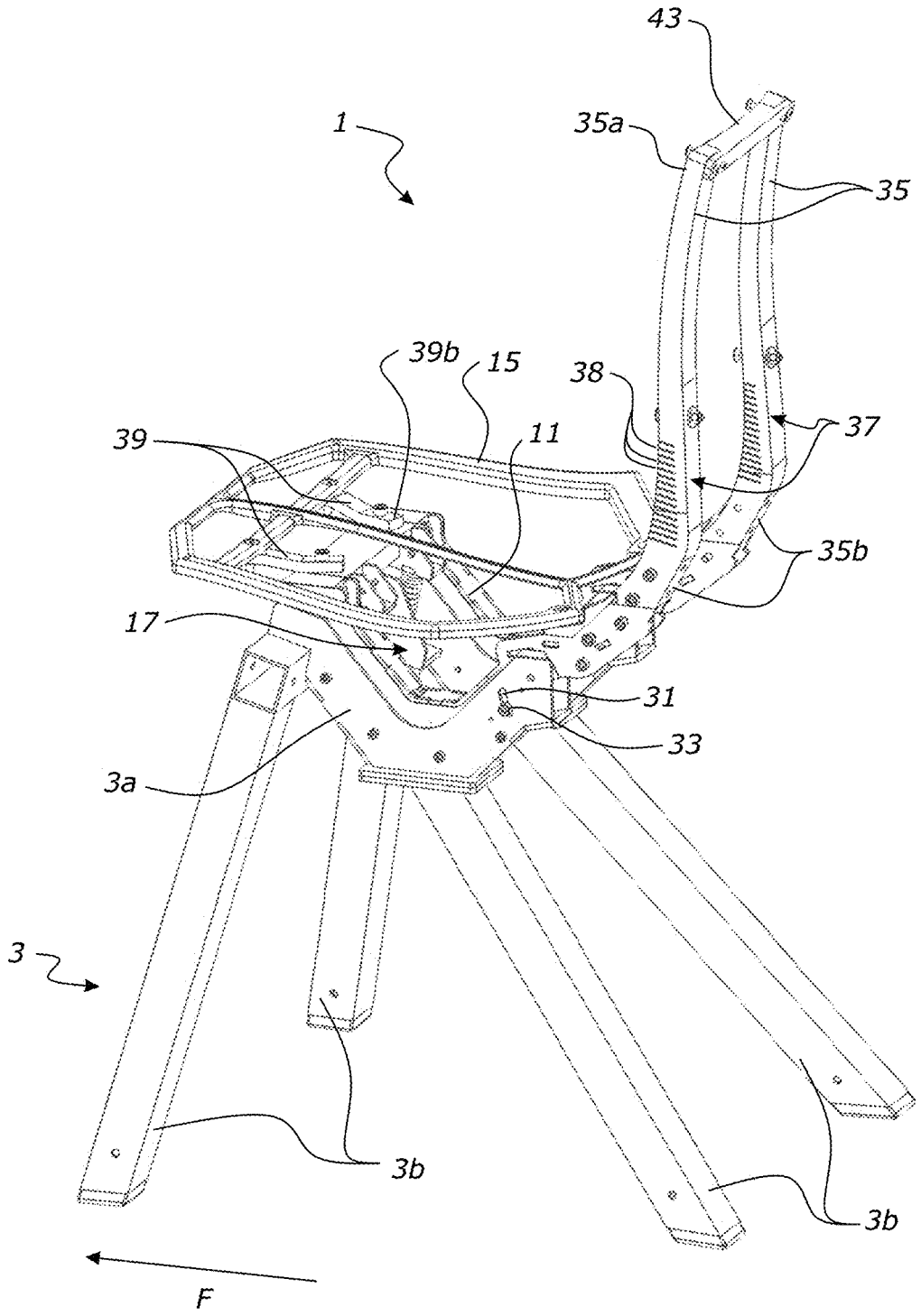
FIG. 3 is a side perspective view of a the chair of FIGS. 1 and 2, with the seat shell and arms hidden to show the rocking and reclining mechanisms.
Figure 4:
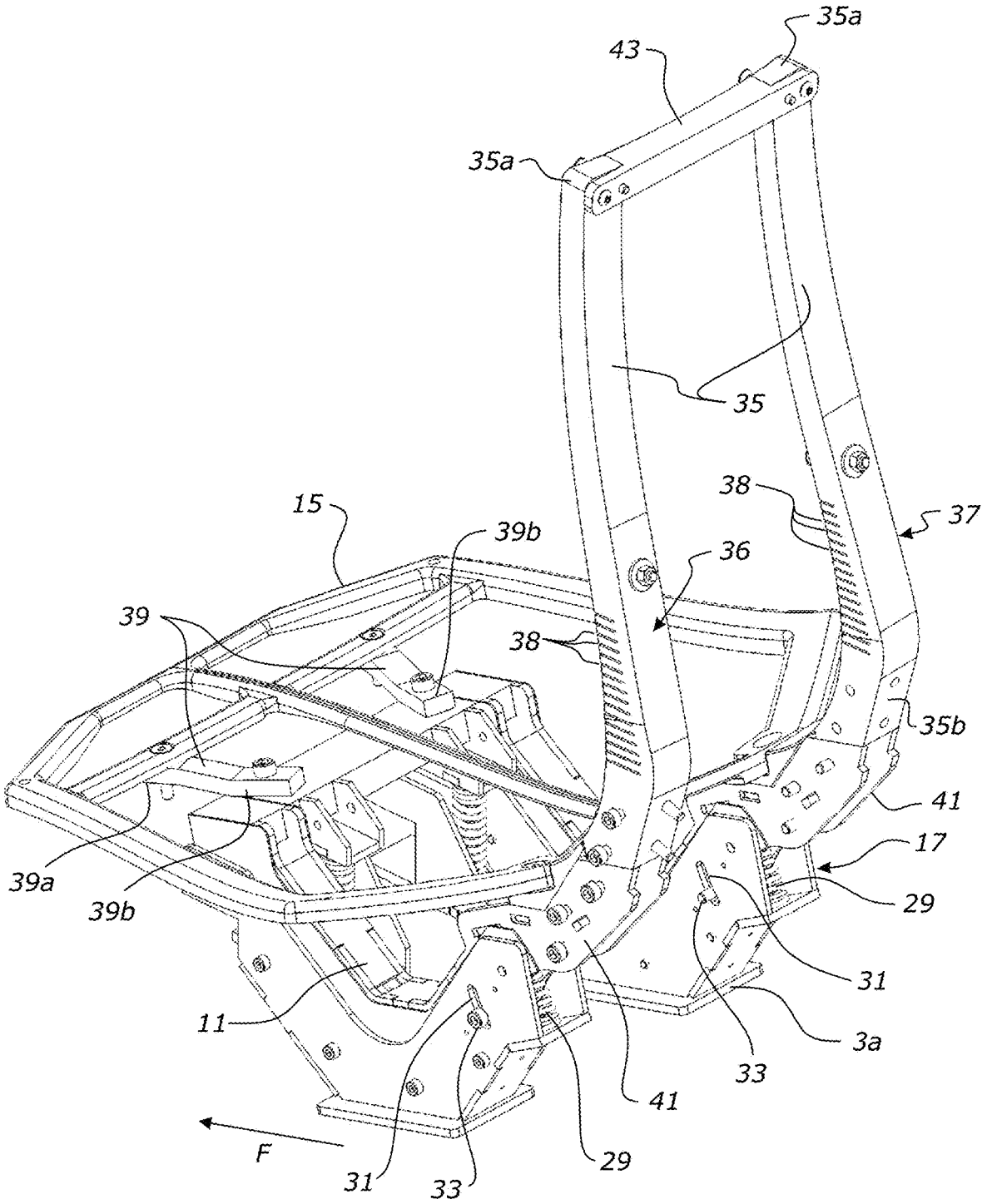
FIG. 4 is an enlarged view of the rocking and recline mechanisms of FIG. 3, with the legs of the chair base hidden.

FIGS. 1 and 2 show a rocking and reclining chair 1 incorporating an embodiment of the present invention. The chair 1 comprises a base assembly 3, a seat shell 5 for supporting a seated occupant, a transom 11, and arm rests 13 for supporting the arms of the seated occupant. The seat shell 5 comprises an integral seat portion 9 and back portion 7, and is movably supported on the transom 11. The transom 11 is movably supported on the base assembly 3. An upper surface US of the seat portion 9 and a forward surface FS of the back portion 7 are occupant-facing surfaces of the seat shell.

The figures illustrate preferred forms of the chair and rocking and reclining mechanisms from various different angles. An arrow marked "F" has been inserted into the figures where appropriate to indicate a forward direction of the chair. Accordingly the terms forward, rearward, left side, and right side (or similar) should be construed with reference to the forward direction F of the chair, not necessarily with reference to the orientation shown in the particular figure.

Referring to FIGS. 1 to 17, the transom 11 is movably supported on the base 3 by way of a rocking mechanism 17. The rocking mechanism enables the transom 11 and seat shell 5 to tilt or rock forwards and rearwards relative to the base 3.

Figure 5:
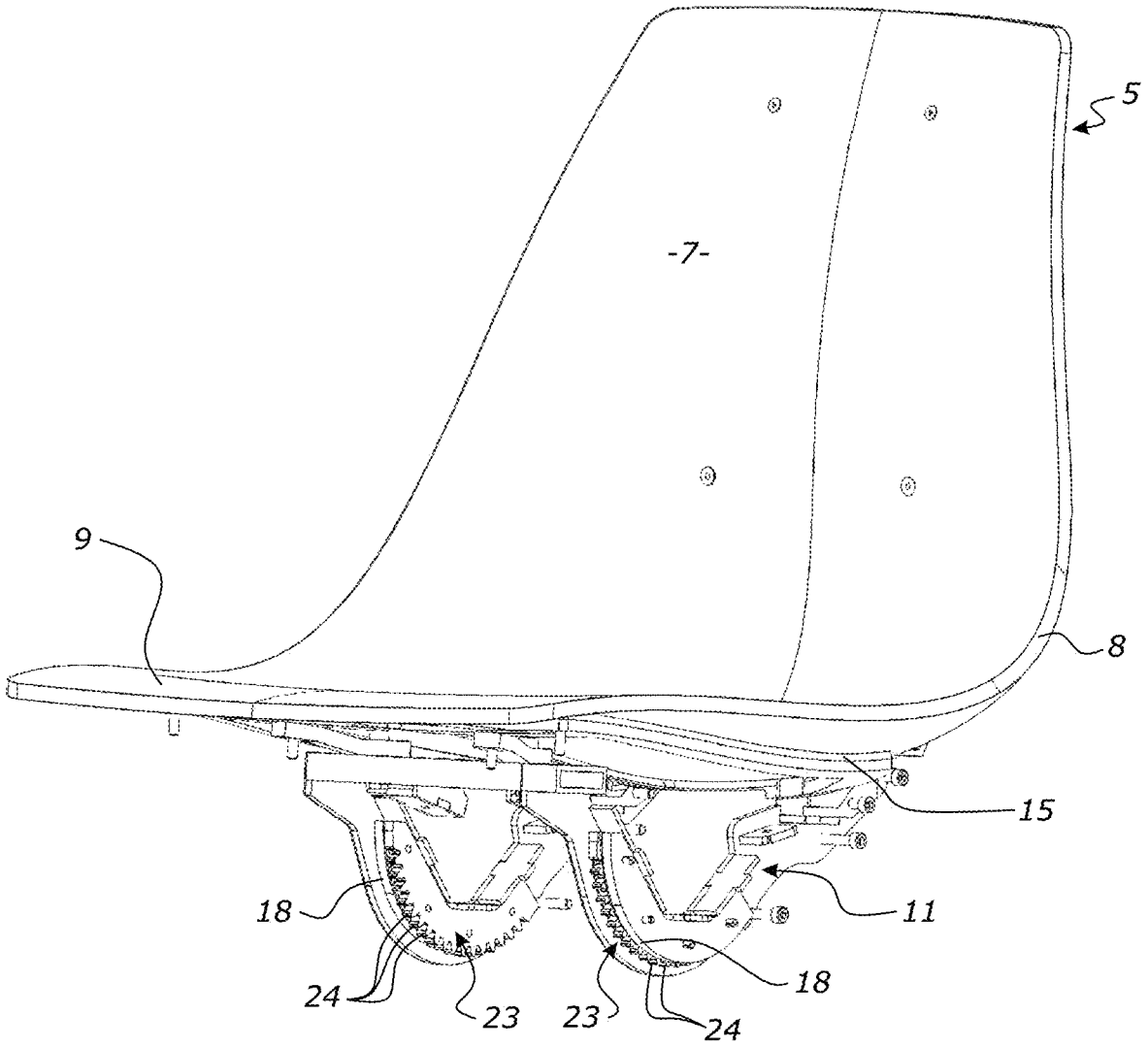
FIG. 5 is a front, underside perspective view of the seat shell, the attached transom and the portion of the rocking mechanism associated with the transom.

The rocking mechanism 17 comprises two curved, convex rock surfaces 18 that are provided on an underside of the transom 11 (FIG. 5). These convex surfaces 18 are in rolling contact with two respective concave rock surfaces 21 (FIGS. 6 and 7) provided on an upper part 3*a* of the base 3, forming two parallel sets of rock surfaces. The convex rock surfaces 18 on the transom have a radius of curvature that is less than a radius of curvature of the concave rock surfaces 21 on the base 3. This enables the convex surface 18 to rock relative to the concave surface 21 and the centre of mass of the seat shell 5 and the occupant to move forwards and rearwards relative to the base 3.

The two convex rock surfaces 18 are co-axial with each other and laterally spaced apart, with one convex surface positioned at or towards a left side of the transom 11 and the other convex surface positioned at or towards a right side of the transom 11. Similarly, the two concave rock surfaces 21 are co-axial with each other and spaced apart, with one concave surface positioned at or towards a left side of the transom 11 and the other concave surface positioned at or towards a right side of the transom 11, aligned with and receiving the respective convex surfaces 18.

Figure 6:
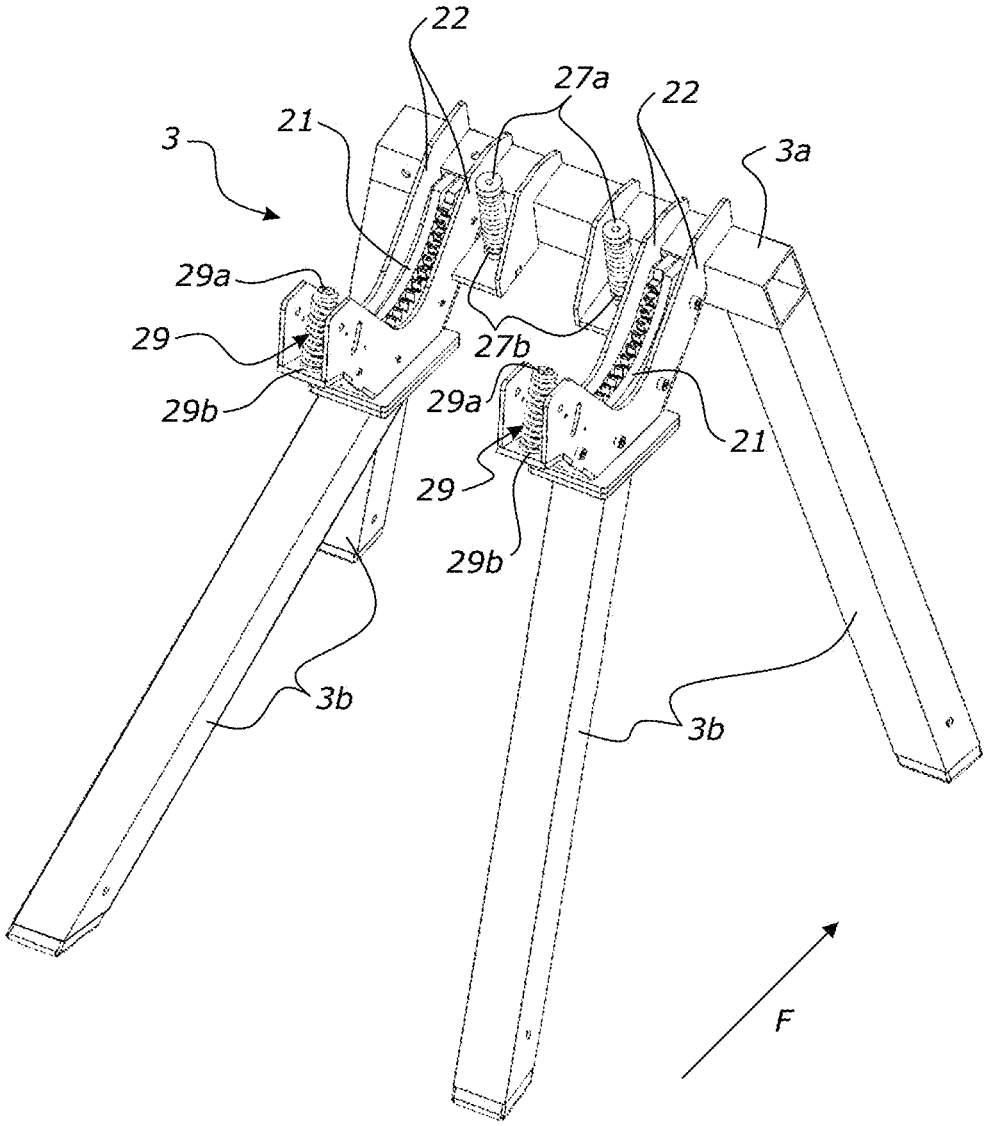
FIG. 6 is a rear perspective view of the chair base, showing the portion of the rocking mechanism associated with the base.
Figure 7:
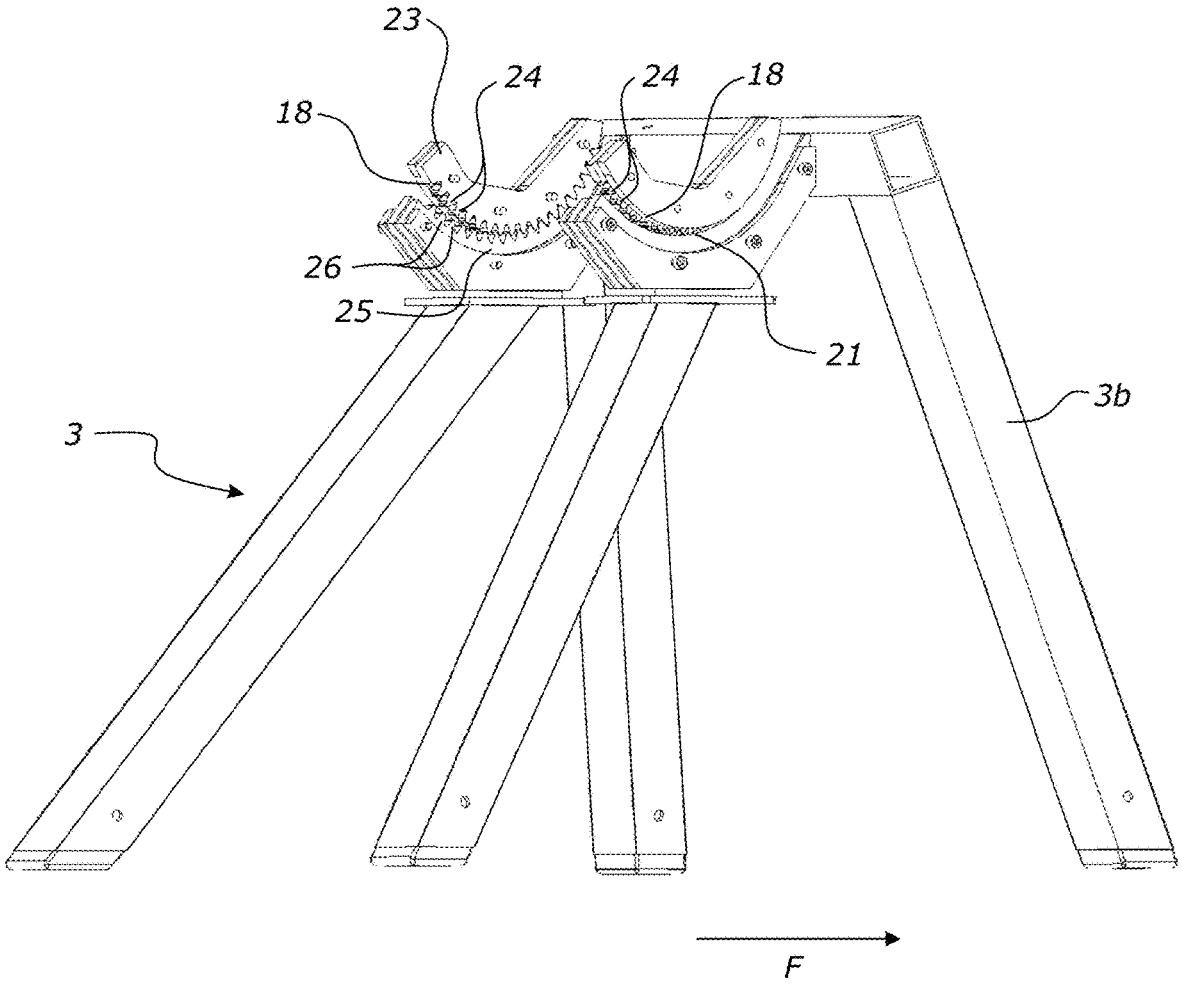
FIG. 7 is a rear perspective view of the chair base and the rocking mechanism, showing the interaction of the spur gears and curved racks.

Complementary engagement features are operatively provided on the transom and on the base to help control movement of the rock surfaces relative to each other. Referring to FIGS. 5 to 7, the rocking mechanism 17 also comprises two gears 23, each provided on the transom 11 adjacent a respective convex surface 18. In the form shown, the gears are spur gears. However, other gear configurations could be used. Each spur gear 23 has a plurality of teeth 24. The upper part of the base 3*a* comprises two corresponding arrays of recesses and/or teeth, in this form provided by curved racks 25 for engaging a respective spur gear 23. FIG. 7 shows the spur gears 23 and racks 25 engaged in a forward rocked position.

The spur gears 23 are partial spur gears, with each spur gear 23 comprising an externally geared arcuate convex surface that extends around an arc of less than 360 degrees, preferably less than 180 degrees. In the embodiment shown, the arcuate geared surface extends through an arc of about 120 degrees.

The concave curved rack 25 extends through an arc of less than 180 degrees. In the embodiment shown, the curved rack 25 extends through an arc of about 120 degrees. The involute teeth 24 on the spur gear 23 are sized and shaped to engage the teeth 26 on the curved rack.

In the form shown, a longitudinal axis of the convex rock surfaces, concave rock surfaces, gears, and curved racks lie in respective planes, so that a front portion of each convex rock surface is in line with a rear portion of that convex rock surface, a front portion of each concave rock surface is in line with a rear portion of that concave rock surface, a front portion of each gear is in line with a rear portion of that gear, and a front portion of each rack is in line with a rear portion of that rack. In an alternative configuration shown in FIGS. 21 to 24, the gears, racks, and rock surfaces may have offset portions for aesthetic reasons and/or tooling. Unless described below, the features and functionality are the same as for the embodiment of FIGS. 1 to 20, and like reference numerals indicate like parts with the addition of 1000.

Figure 24:
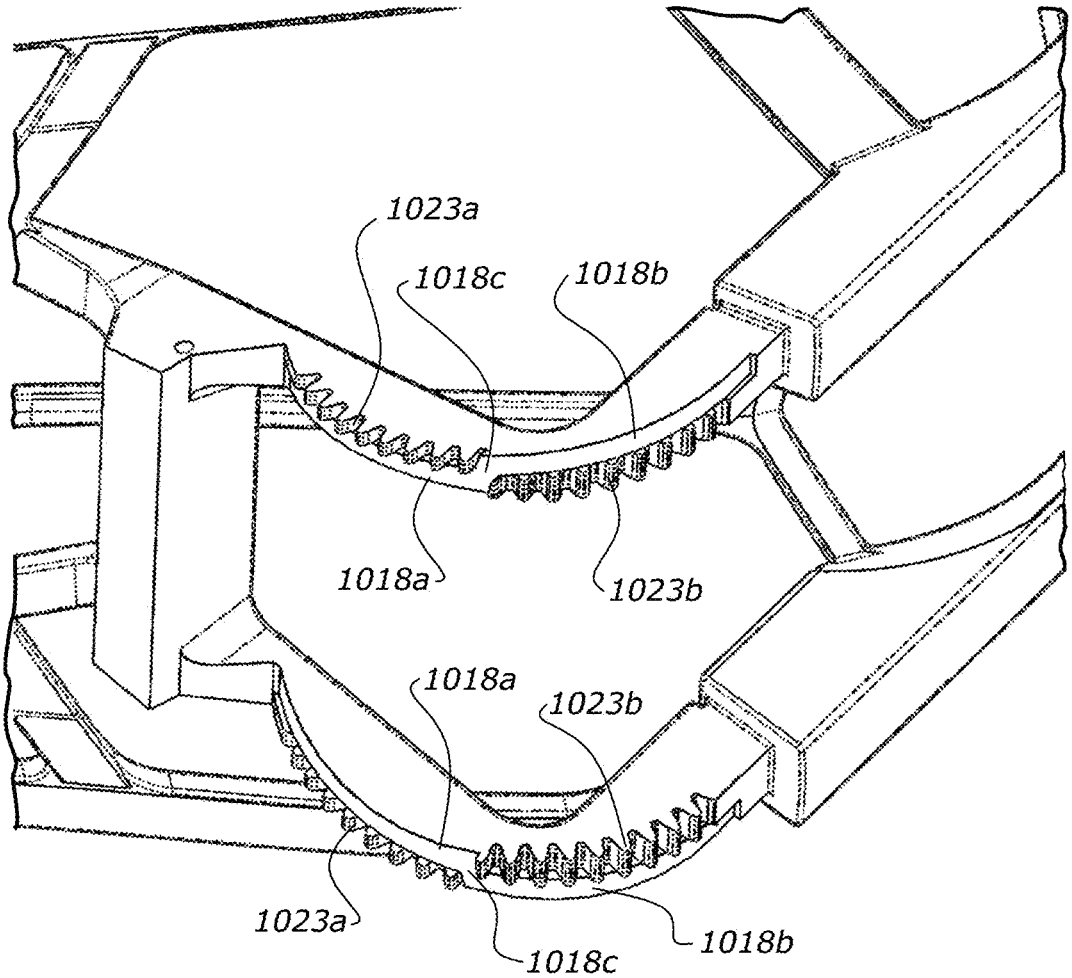
FIG. 24 is an underside perspective view of an alternative upper rock surface and gear arrangement of the chair for use with the base of FIGS. 21 to 23.

In this embodiment, a portion of each rack is offset from another portion of that rack. For example, in the form shown in FIG. 21, the front portion 1025*a* of each rack is offset from a rear portion 1025*b* of the rack. As shown in FIG. 24, the front portion 1023*a* of each gear is offset from a rear portion 1023*b* of that gear. The front portions of the racks and gears may be positioned laterally outwardly of a rear portions of the racks and gears, or the front portions of the racks and gears may be positioned laterally inwardly of the rear portions of the racks and gears. Different configurations could be used on opposite sides of the chair. The racks and gears and discontinuous, with there being a break between the front and rear portions of the racks and gears.

Similarly, a portion of each rock surface is offset from another portion of that rock surface. In the form shown, the front portion 1021*a* of each concave rock surface is offset from the rear portion 1021*b* of that concave rock surface. The front portion 1018*a* of each convex rock surface is offset from the rear portion 1018*b* of that convex rock surface. The front portions of the rock surfaces may be positioned laterally inwardly of the rear portions of the rock surfaces, or the front portions of the rock surfaces may be positioned laterally outwardly of the rear portions of the rock surfaces. Different configurations could be used on opposite sides of the chair. A laterally extending intermediate region 1018*c*, 1021*c* is advantageously provided on each rock surface so that there is contact between the convex and concave rock surfaces throughout the rocking motion.

Figure 8:
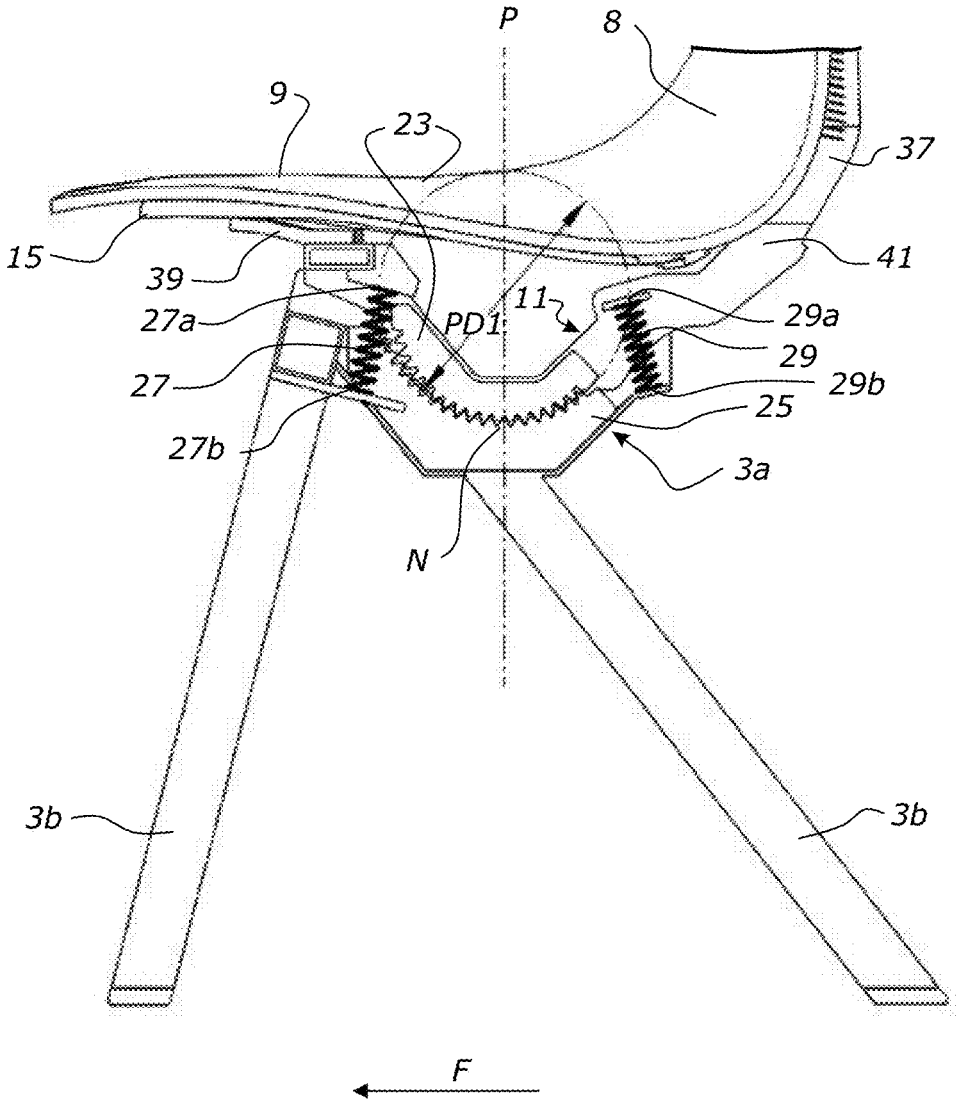
FIG. 8 is a schematic section view of part of the chair of FIGS. 1 to 7 in a neutral rock position, showing the interaction of one of the spur gears with a respective curved rack.

Front and rear biasing members in the form of coil springs 27, 29 act between the transom 11 and the upper part 3*a* of the base 3, and are configured to bias the transom 11 to a neutral position shown in FIG. 8. In the neutral position, at least one of the teeth 24 on the spur gear 23 is fully seated and engages the curved rack 25 at a contact point N. The contact point N is at the lowest point of the spur gear 23 and the lowest point of the rack 25, and the centre of mass of the seat shell 5 and occupant is approximately directly above the contact point, which is the lowest energy state. In this neutral position, the forward-most and rear-most teeth 24 on the spur gear 23 are out of engagement or only partially engaged with the curved rack 25.

The front springs 27 are angled with their upper ends 27*a* positioned more rearward than their lower ends 27*b*. The rear springs 29 are angled with their upper ends 29*a* positioned more forward than their lower ends 29*b*. In the embodiment shown, when viewed from the side of the chair, the front springs 27 are symmetrical with the rear spring(s) 29 about a frontal plane P that is coincident with the neutral contact point N (FIG. 8). However, the front springs 27 are positioned more medially than the rear springs 29 to create a more compact arrangement. Alternatively, the rear springs 29 may be positioned more medially than the front springs 27, or may be in line with the front springs 27. The front and rear springs may be asymmetric about the frontal plane P.

Figure 9:
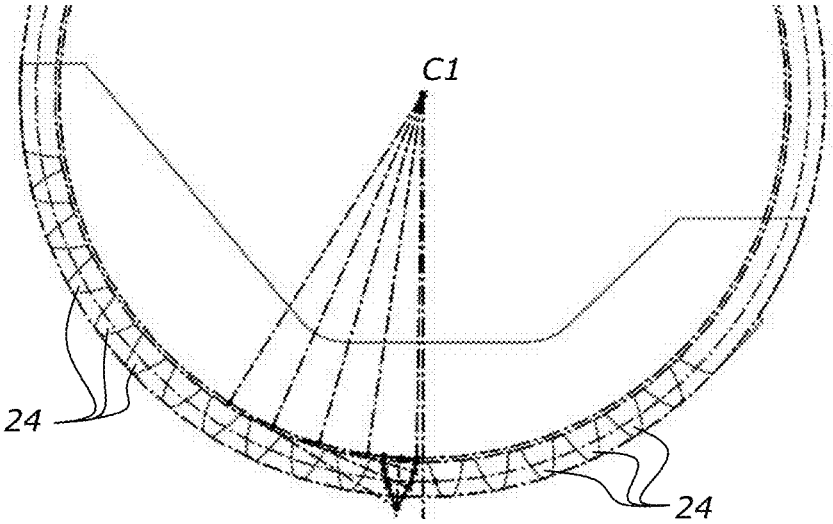
FIGS. 9(*i*) and 9(*ii*) show the geometry of the spur gear, where FIG. 9(*i*) shows the full spur gear component, and FIG. 9(*ii*) shows the tooth geometry and indicates reference diameters.
Figure 9:
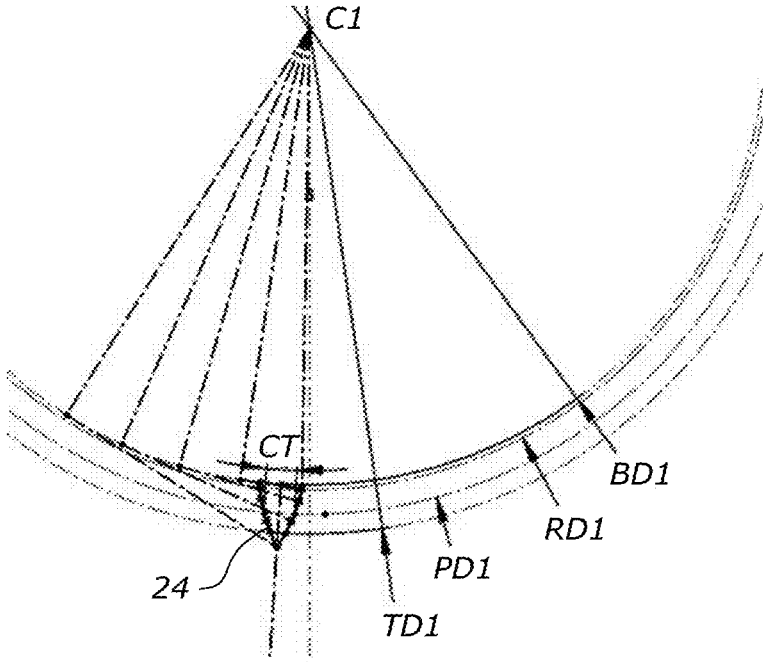
Figure 10:
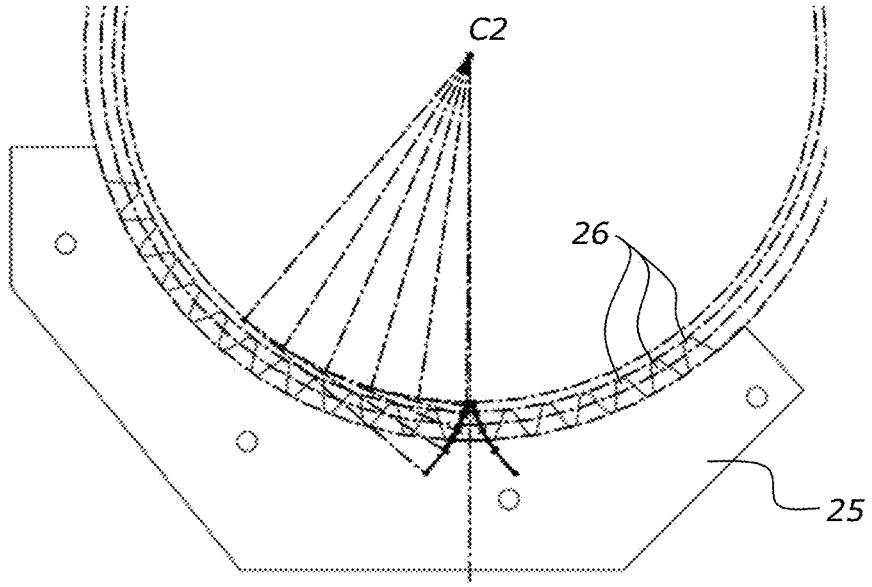
FIGS. 10(*i*) and 10(*ii*) show the geometry of the curved rack, where FIG. 10(*i*) shows the full curved rack component, and FIG. 10(*ii*) shows the tooth geometry and indicates reference diameters.
Figure 10:
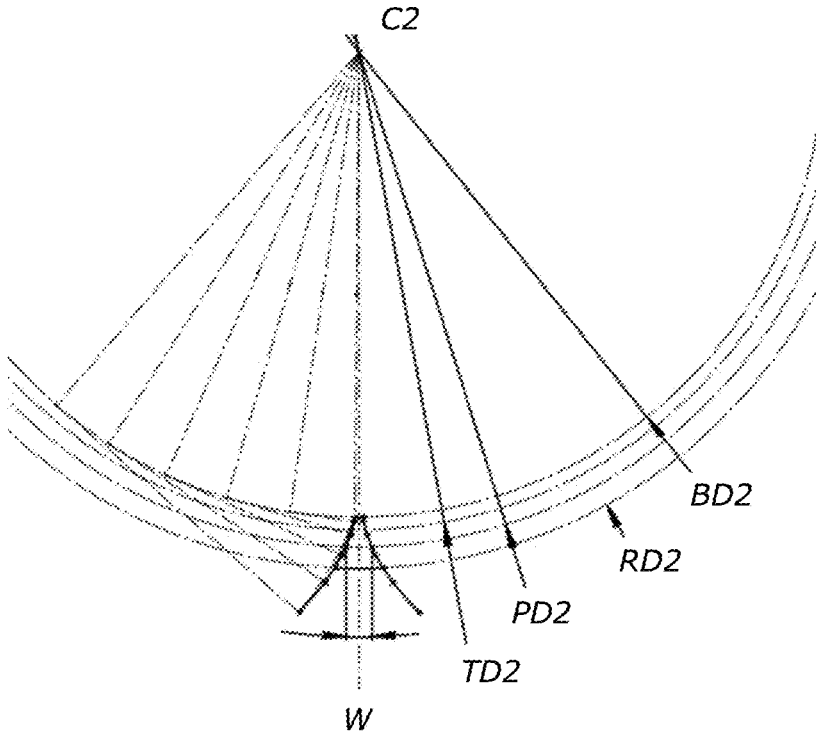

Referring to FIGS. 9(*i*) to 9(*ii*), in the embodiment shown, the spur gear 23 has a constant pitch diameter PD1, and the spur gear teeth 24 each have the same profile with the same circular thickness CT, a constant base and root diameter BD1, RD1, and a constant tip diameter TD1. The curved rack 25 (FIGS. 10(*i*) and 10(*ii*)) has a constant pitch diameter PD2, and the rack teeth 26 each have a constant profile with the same width W, a constant base and root diameter BD2, RD2, and a constant tip diameter TD2.

The pitch diameter PD2 of the curved rack 25 is larger than the pitch diameter PD1 of the spur gear 23 such that not all of the spur gear teeth 24 are fully engaged with the curved rack 25 at any position of the spur gear 23. This enables the spur gear 23 to roll along the rack 25. In the exemplary embodiment shown, the pitch diameter PD2 of the curved rack 25 is 145 mm, and the pitch diameter PD1 of the spur gear 23 is 125 mm. However, the absolute pitch diameters PD1, PD2 may be larger or smaller, and the difference between the diameters may be larger or smaller.

Referring to FIGS. 5 and 6, each convex rock surface 18 has a curvature diameter (or curvature radius) that is substantially the same as the pitch diameter PD1 or curvature (or pitch radius) of the spur gears 23. Each concave rock surface 21 has a curvature diameter (or curvature radius) that is substantially the same as a pitch diameter PD2 (or pitch radius) of the curved racks 25 (FIG. 6). The convex rock surfaces 18 are concentric with the spur gears 23, and the concave rock surfaces 21 are concentric with the curved racks 25 such that each concave rock surface 21 is in rolling contact with the respective convex rock surface 18 when the spur gears 23 and curved racks 25 are engaged. In the embodiment shown, the concave and convex rock surfaces 21, 18 are low friction surfaces, which may assist to minimise noise and/or provide smooth rocking.

Figure 11:
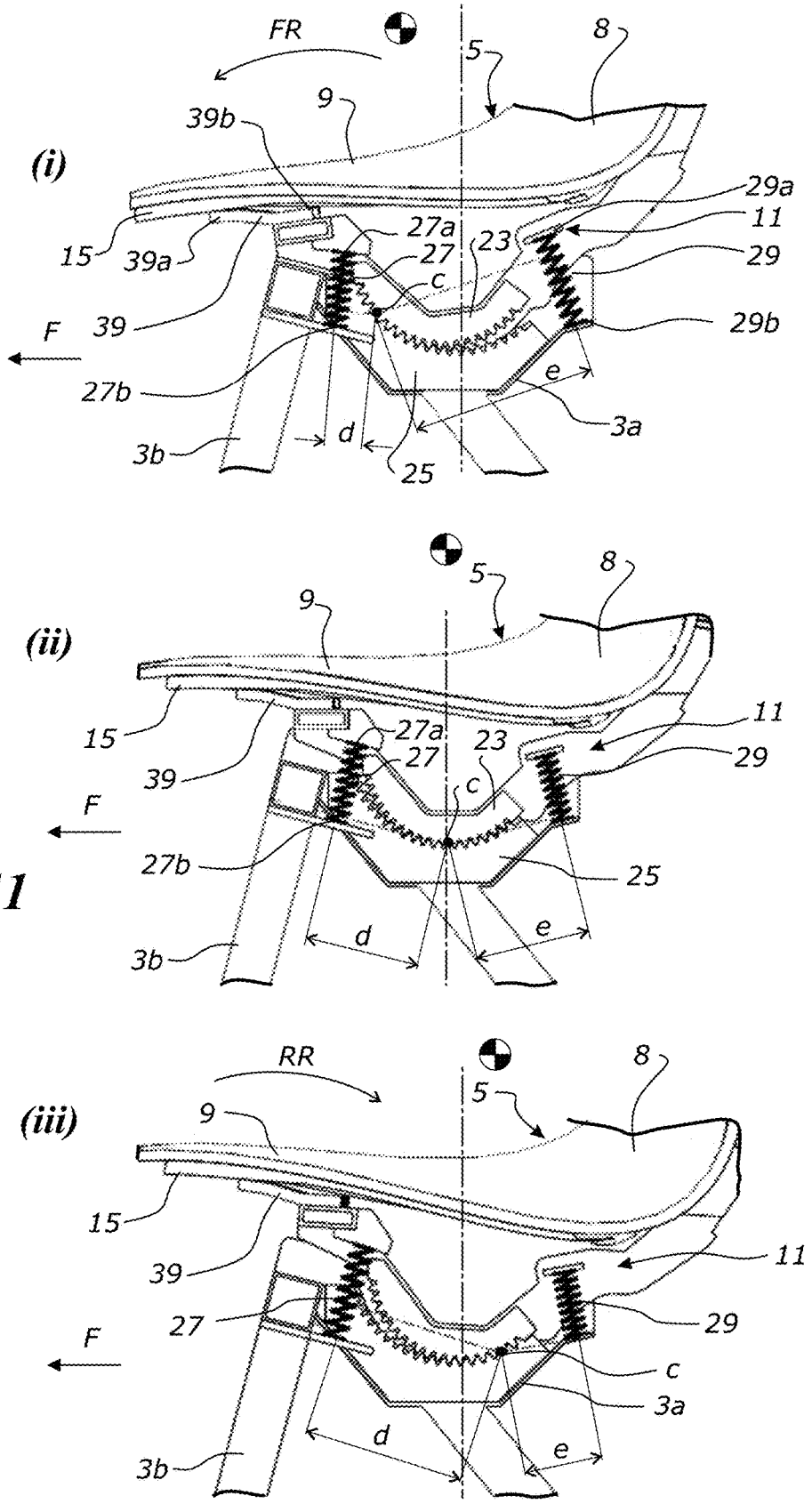
FIGS. 11(*i*) to 11(*iii*) are schematic section views showing the rocking motion of the chair, where FIG. 11(*i*) shows the chair in a forward rocked configuration, FIG. 11(*ii*) shows the chair in a neutral position, and FIG. 11(*iii*) shows the chair rocked rearwardly.

FIGS. 11(*i*) to 11(*iii*) illustrate the rocking motion of the seat shell 5 and transom 11 relative to the base 3. FIG. 11(*i*) shows the chair 1 in a forward rocked FR position. In this position, the spur gear 23 and curved rack 25 are fully engaged at a contact point C towards a front of the curved rack 25. Because the contact point C is closer to the front spring 27, a moment arm d from the contact point C to the front spring 27 is shorter than a moment arm e from the contact point C to the rear spring 29. Therefore, the rear spring 29 has more influence than the front spring 27 on the rock resistance in the forward rocked position. In the form shown, the rear spring rate is higher and the deflection of the rear spring is greater than that of the front spring.

In the forward rocked position of FIG. 11(*i*), the rear spring 29 acts as a tension spring and the front spring 27 acts as a compression spring to bias the seat back towards a neutral position. In forward rock, the centre of mass of the seat shell 5 and the occupant having neutral will most likely be behind the contact point C, which assists in urging the transom 11 towards the neutral position. FIGS. 11(*i*) to (*iii*) additionally show the position of an occupant's centre of gravity in each of the shown rocked positions of the chair.

To move from the forward rocked position (a relatively high energy state) towards the neutral position (a lower energy position), the seat shell tilts about the contact point C.

FIG. 11(*ii*) shows the chair 1 in a neutral rock position corresponding to FIG. 8. In this position, the spur gear 23 and curved rack 25 circle centres C1, C2 (FIGS. 9(*i*) to 10(*ii*)) are substantially vertically aligned along the neutral point frontal plane P. The lowest point of the spur gear 23 contacts the lowest point of the curved rack 25 at a contact point C, and the centre of mass of an occupant in a neutral posture is positioned approximately directly above the contact point C, creating a stable low-energy state. The moment arm d between the neutral contact point C and the front spring 27 is the same as the moment arm e between the neutral contact point C and the rear spring 29. The front and rear springs 27, 29 are in a neutral, unstressed state.

FIG. 11(*iii*) shows the chair 1 in a rear rocked RR position. In this position, the spur gear 23 and curved rack 25 are engaged at a contact point C towards a rear of the curved rack 25. Because the contact point C is closer to the rear spring 29, the moment arm e to the rear spring 29 from the contact point C is shorter than a moment arm d to the front spring 27. Therefore, the front spring 27 has more influence in a more rearward rocked position compared to a forward rocked position, and the rear spring 29 has more influence in a more forward rocked position compared to a rearward rocked position.

In the rear rocked position shown in FIG. 11(*iii*), the rear spring 29 acts as a compression spring and the front spring 27 acts as a tension spring. In a neutral posture, an occupant's centre of mass is likely to be in front of the contact point C, which assists urging the transom 11 towards the neutral position.

To move from the rearward rocked position (a relatively high energy state) towards the neutral position (a lower energy position), the seat shell 5 tilts about the contact point C.

The spring rate of the front springs 27 may be the same as the spring rate of the rear springs 29. Alternatively, the front and rear springs 27, 29 may have different spring rates to provide different forward and rearward rock resistances.

Figure 12:
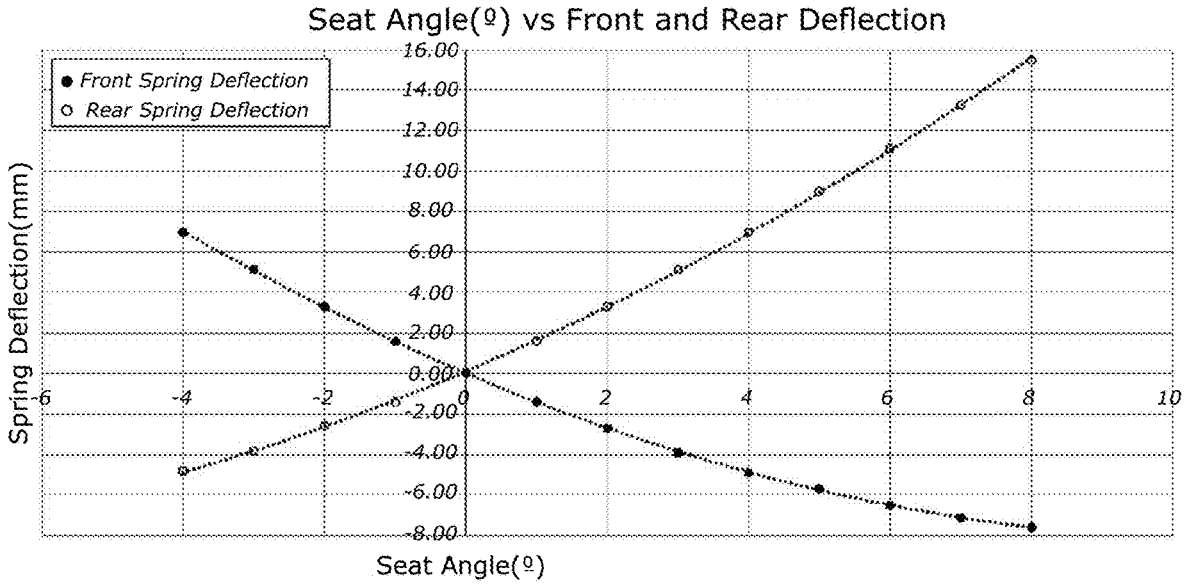
FIG. 12 is a plot showing exemplary deflection of the front and rear springs for various forward and rearward seat angles.
Figure 13:
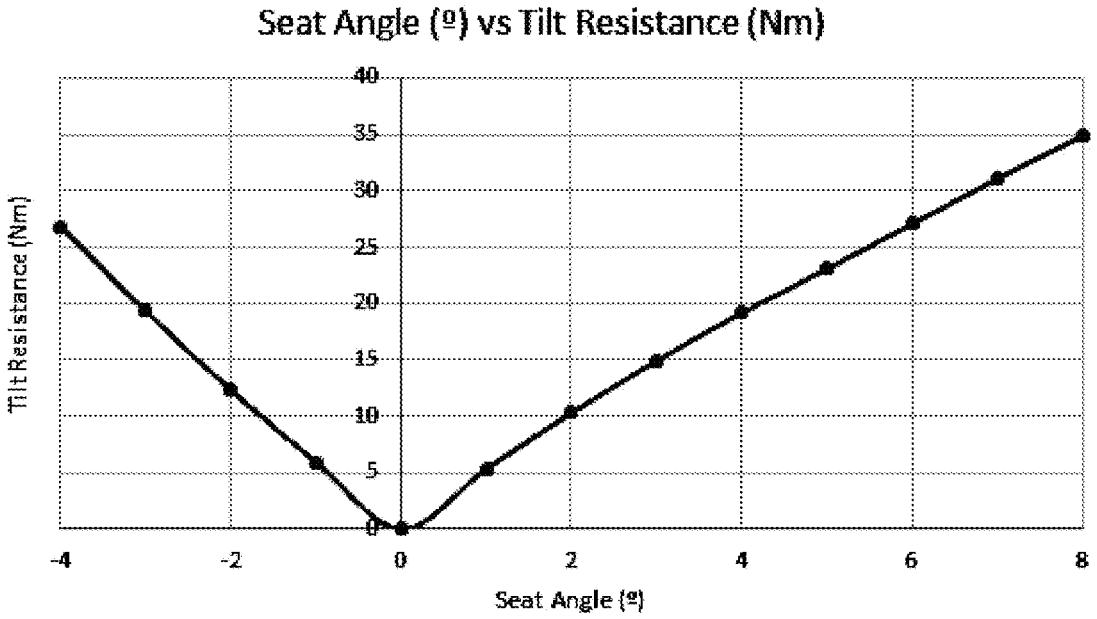
FIG. 13 is a plot showing the tilt or rock resistance for various forward and rearward seat angles.

In the exemplary embodiment shown, the spring rate of each front spring 27 is about twice the spring rate of each rear spring: 29.3 N/mm for the front springs 27, and 14.5 N/mm for the rear springs 29. FIGS. 12 and 13 show the spring deflection and tilt or rock resistance for forward and rearward tilt angles, where a negative tilt angle corresponds to a rearward tilt or rock. The spring deflection and tilt or rock resistance will vary depending on the spring(s) used. In this embodiment, the transom 11 has a maximum forward tilt or rock from neutral of 8° and a maximum rearward tilt or rock from neutral of 4°. The rearward tilt or rock resistance increases more with tilt or rock angle than the forward tilt resistance. Having a lower resistance to forward tilt or rock enables an occupant to easily rock forward in the chair to lean forward while concentrating or working on a task for example. Having a higher resistance to rearward tilt or rock provides more control as a user rocks rearwardly, minimising the likelihood of the user tilting the entire chair (including the base) too far rearwards.

Figure 14:
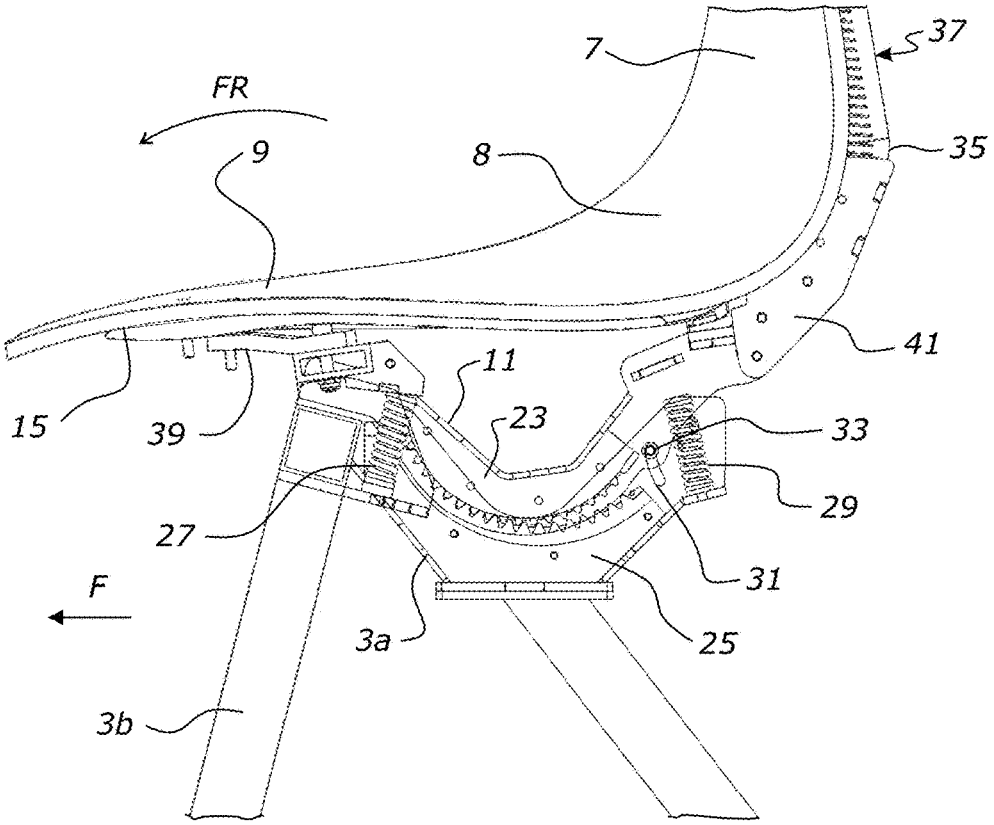
FIG. 14 is a sectioned side view with the transom and seat base components transparent, showing the seat in a forward rocked position limited by the forward stop.
Figure 15:
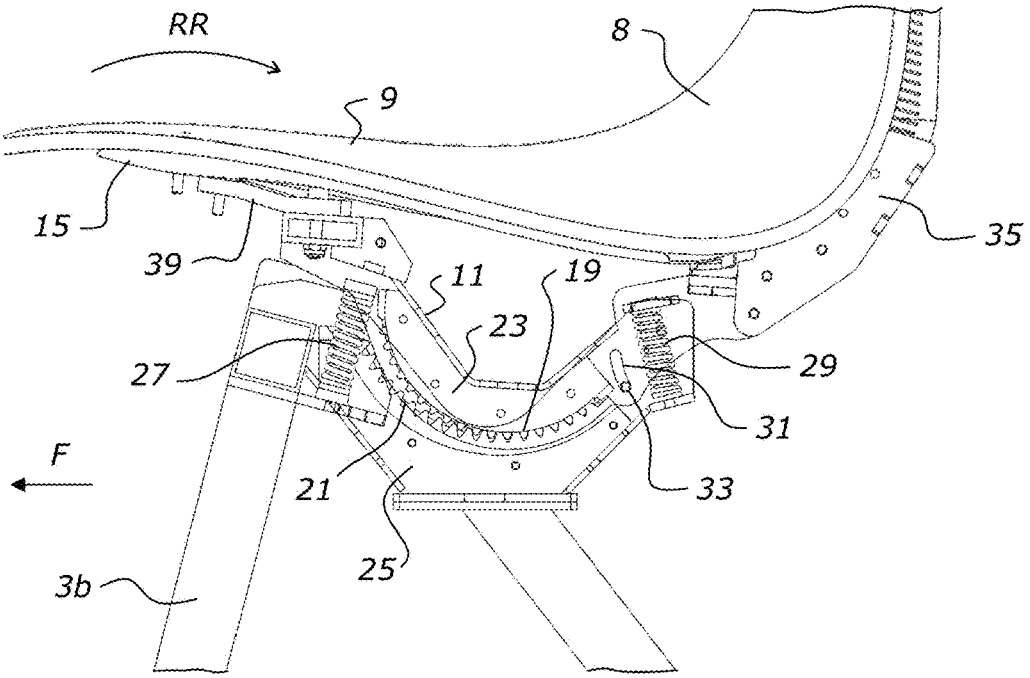
FIG. 15 is a sectioned side view with the transom and seat base components transparent, showing the seat in a rearward rocked position limited by the rear stop.

Forward and rear stops constrain the maximum forward and rearward rock of the transom 11 relative to the base 3. As shown in FIGS. 14 and 15, the forward and rear stops are provided by a curved slot 31 provided on the upper part of the base 3*a*. A pin 33 on the transom 11 slides in the slot 31 as the transom 11 rocks relative to the base 3. Forward rock is limited when the pin 33 reaches the top of the slot 31 as shown in FIG. 14. Rear rock is limited when the pin 33 reaches the base of the slot 31, as shown in FIG. 15.

As shown in FIG. 6, each side of the base comprises two spaced apart side walls 22 adjacent the curved rack 25 and the concave rock surface 21. The convex rock surface 18 and gear 23 fit between the spaced apart side walls 22 to inhibit or prevent lateral movement of the upper rock portion relative to the lower rock portion. Alternatively, the upper rock portion could be provided with the side walls to receive the lower rock portion, or a different lateral positioning feature could be provided. Low friction bearing surfaces may be provided on the interiors of the spaced apart side walls 22.

Preferred embodiments of the rocking mechanism have been described by way of example only and modifications may be made thereto without departing from the scope of the invention. For example, the slot 31 could be provided on the transom 11 and the pin 33 may be provided on the base 3. Alternatively, rather than a slot and pin arrangement, rocking could be limited by separate forward and rear stops provided between the transom 11 and base 3, for example, ledges or projections that engage in the maximum rock positions, or resilient stop blocks that compress to provide a soft stop.

In the embodiment shown, the convex surfaces 18, concave rock surfaces 21, spur gears 23, and curved racks 25 are located in parallel vertical forward/rearward extending planes. Alternatively, they could be orientated in inwardly or outwardly angled non-parallel planes. The planes may be symmetric.

In an alternative embodiment, the chair 1 may comprise only a single convex rock surface 18 and a corresponding single concave rock surface 21. The single set of rock surfaces may be centrally or otherwise positioned. As a further alternative, the chair 1 may comprise more than two sets of rock surfaces.

The spur gear radius of curvature and the rack curvature may vary along the surface of the rack 25 and gear 23. For example, the spur gear 23 may be a partial elliptic gear or other irregularly shaped gear, and the curved rack 25 may have a partial elliptical shape, or other irregularly curved shape. In one embodiment, the pitch diameter of the spur gears 23 and curved racks 25 (and the radius of curvature of the convex and concave rock surfaces 18, 21) may be smaller towards a rear and/or towards the front of the surfaces and larger in a middle portion such that the curved rack 25 is steeper towards the front and rear of the rack. That would create a larger difference between the energy state in the forward and rearward positions to increase the resistance to rock at greater forwards and rearwards rock. Increasing the resistance towards the front and rear rock limits minimises the feeling of hitting a hard/sudden stop at the end of the range of motion.

In embodiments where one or more of the of the spur gears 23, curved racks 25, concave surfaces 21, and convex surfaces 18 have a varying radius of curvature, the pitch diameter PD2 of the curved rack 25, is larger than the pitch diameter PD1 of the spur gear 23 at least at the point of the rack 25 in contact with the spur gear 23 in the neutral position. The pitch diameter PD2 of the curved rack 25 is larger than the pitch diameter PD1 of the spur gear 23 at each point of contact through the rock motion.

The rocking mechanism described employs coil springs 27, 29 as the biasing members. However, alternatively the biasing members may comprise leaf springs, or springs in the form of elastic bands, resilient blocks, or other suitable biasing means. FIGS. 32 to 35 show an example of alternative biasing members or springs 127, 129 that may be used in any of the chairs 1, 101 described herein, and like reference numerals indicate like parts with the addition of 100 to those of chair 1. As shown in FIG. 35, the front 127 and rear 129 springs comprise resilient spring inserts 127*a*, 129*a* that may be made from a suitable material such as rubber, urethane, or the like. In the form shown, the inserts are substantially cylindrical. The inserts 127*a*, 129*a* may have circular peripheries, or could be any other suitable shape, such as elliptical or a polygonal shape for example.

The inserts 127*a*, 129*a* are positioned in complementary apertures in the transom 11. The inserts may comprise regions that are free of material to enhance spring function, with examples described below with reference to FIGS. 40 and 41.

The seat frame and transom 11 can then be fitted to the base 3, with the insert 127*a*, 129*a* received between spaced apart side walls 22 of the base. A locking pin 30 is inserted through apertures in the side walls 22 and in the resilient insert 127*a*, 129*a*, to hold the assembly together. The locking pin may be a snap fit with one of the side walls 22, or may be located in position by another feature such as a nut for example. However, the assembly of the spring arrangement is preferably tool-less or requires minimal tool use for assembly.

The chair may be provided with any suitable number of springs. In the form shown, the chair is provided with two front springs 127 and two rear springs 129, positioned at or toward respective sides of the base 3. Alternatively, the chair may comprise a single front spring and/or a single rear spring, more than two springs at one or each location, or any other suitable configuration.

Figure 32:
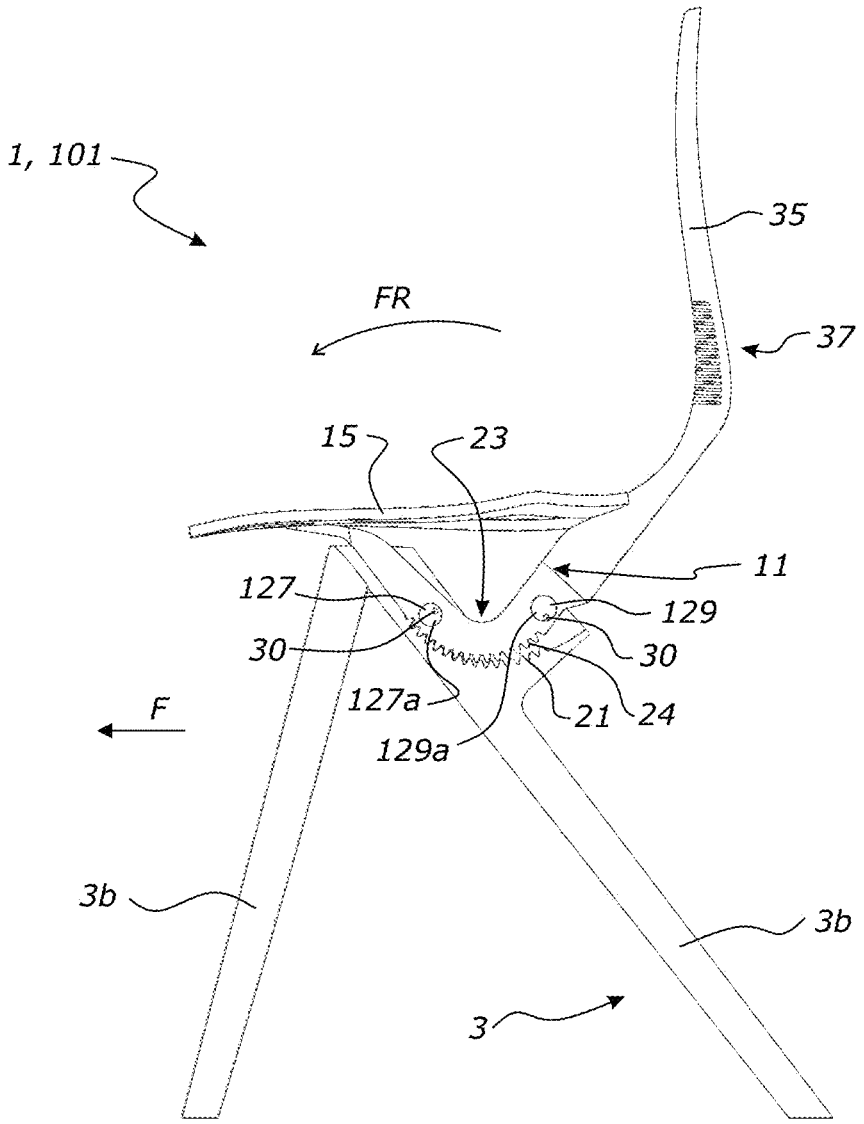
FIG. 32 is a side view of one of the chairs of FIGS. 1 to 31 in a forward rocked position, but with alternative biasing members to bias the seat to a neutral position.

FIG. 32 shows the seat of the chair in a forward rocked position. The spring inserts 127*a*, 129*a* are compressed between the locking pins 30 and the transom 11, inducing a reaction to oppose the forward rocking.

Figure 33:
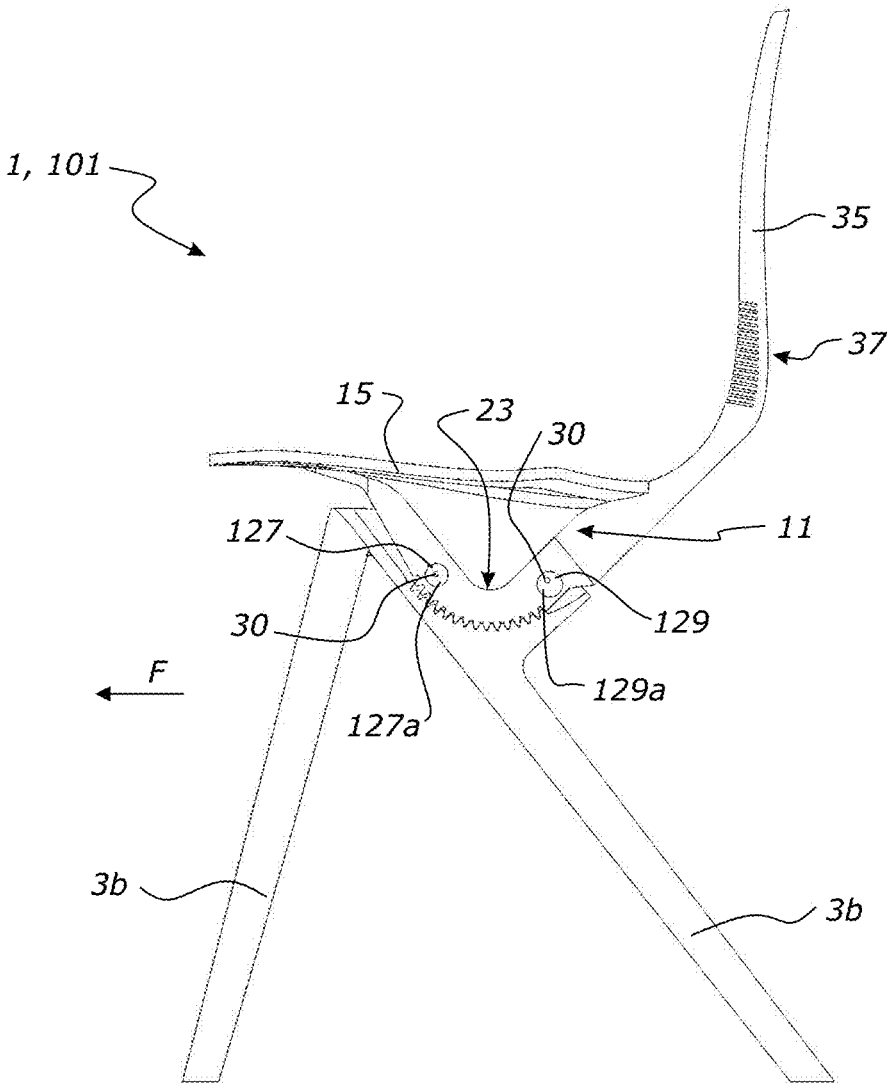
FIG. 33 is a view corresponding to FIG. 32, but with the chair in a neutral position.

FIG. 33 shows the seat of the chair in a neutral position. The spring inserts 127*a*, 129*a* are in an unstressed state, holding the assembly in the neutral, upright position.

Figure 34:
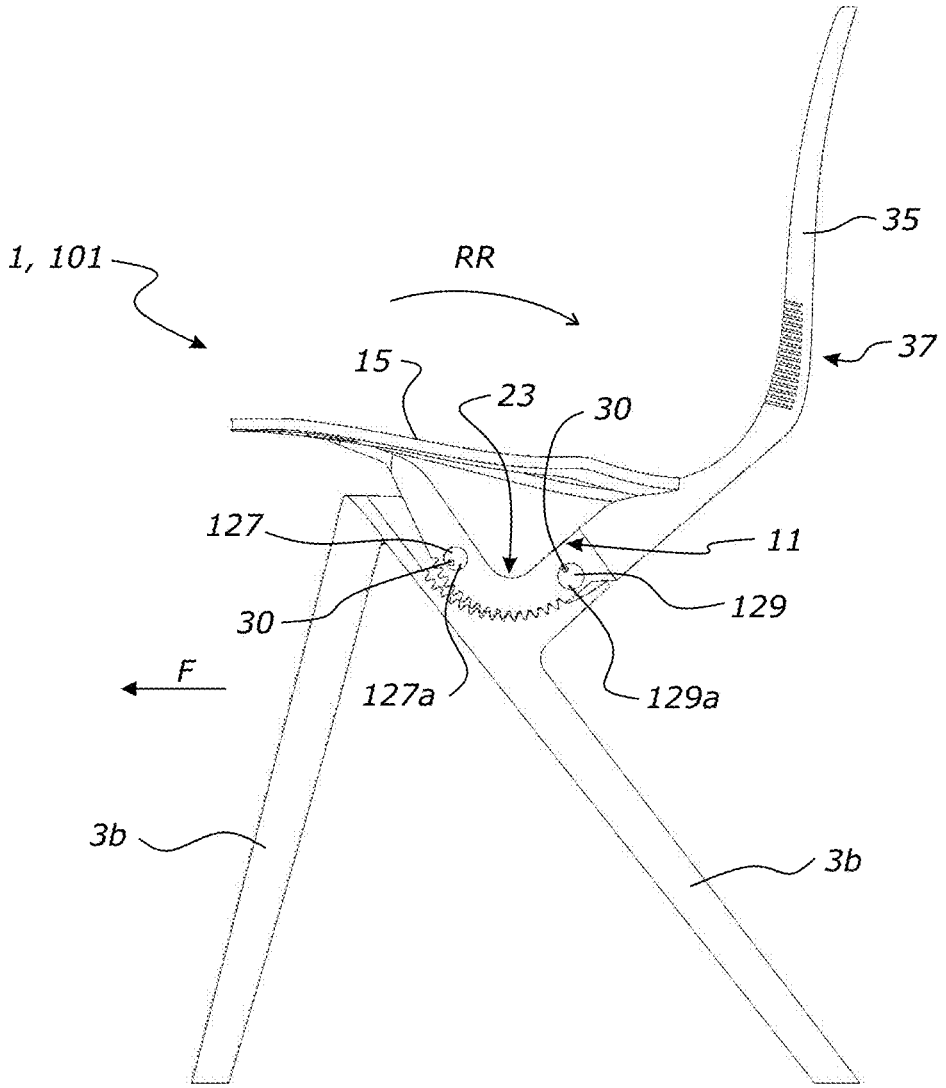
FIG. 34 is a view corresponding to FIG. 33, but with the chair in a rearward rocked position.
Figure 35:
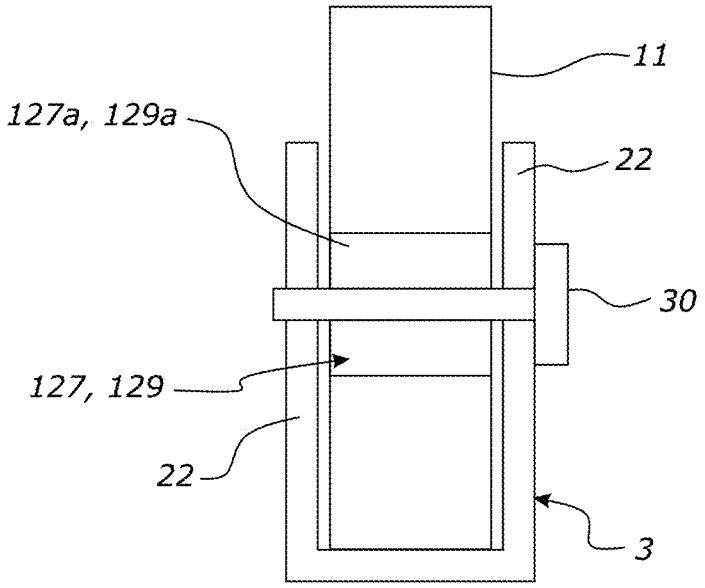
FIG. 35 is a front sectional view through one of the biasing members of the chair of FIGS. 32 to 34.

FIG. 34 shows the seat of the chair in a rearward rocked position. The spring inserts 127*a*, 129*a* are compressed between the locking pins 30 and the transom 11, inducing a reaction to oppose the rearward rocking.

The springs also act as 'soft' rock stops, with the pins 30 and inserts 127*a*, 129*a* limiting the forward or rearward rocking of the chair. That is, the forward and/or rear rock stop is incorporated into the forward and/or rear spring 127, 129.

The rocking resistance of the springs 127, 129 may be customisable. For example, the spring inserts could be swapped out for heavy or light, and/or large or small users. The spring inserts can also be configured so that the front springs 127 have a different spring rate from the rear springs 129. For example, the spring inserts 127*a*, 129*a* may be configured to provide a greater resistance to rearward rocking than to forward rocking, as described above for the coil springs.

Rather than having identical profiles, the profiles of the spur gear teeth 24 and/or the rack teeth 26 may vary. For example, if the profiles of the rolling surfaces are other than constant radii, the tooth profile would vary.

Figure 16:
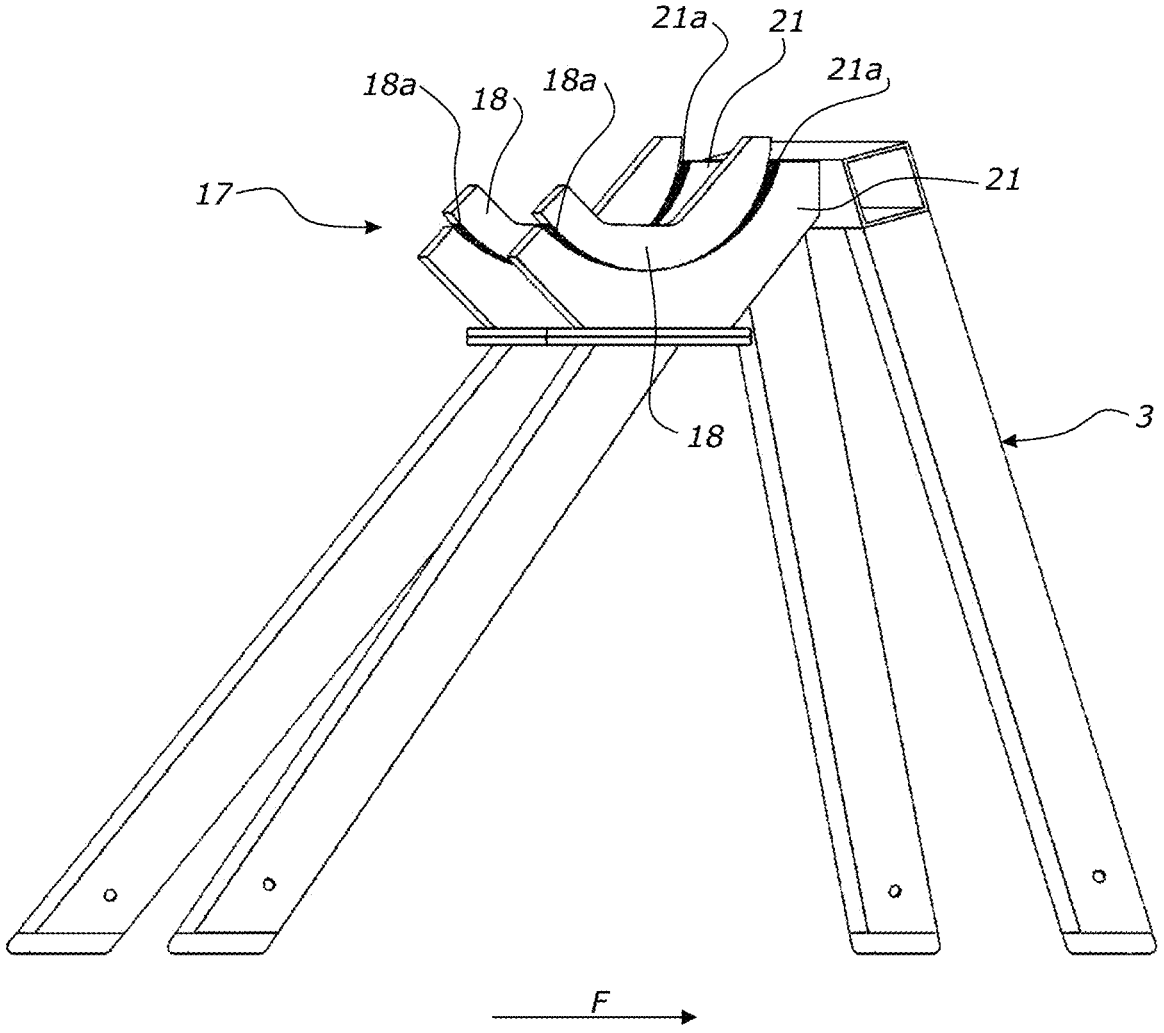
FIG. 16 is a rear perspective view of part of an alternative rocking mechanism for use in the chair of FIGS. 1 to 15, showing an alternative configuration of engagement features.
Figure 17:
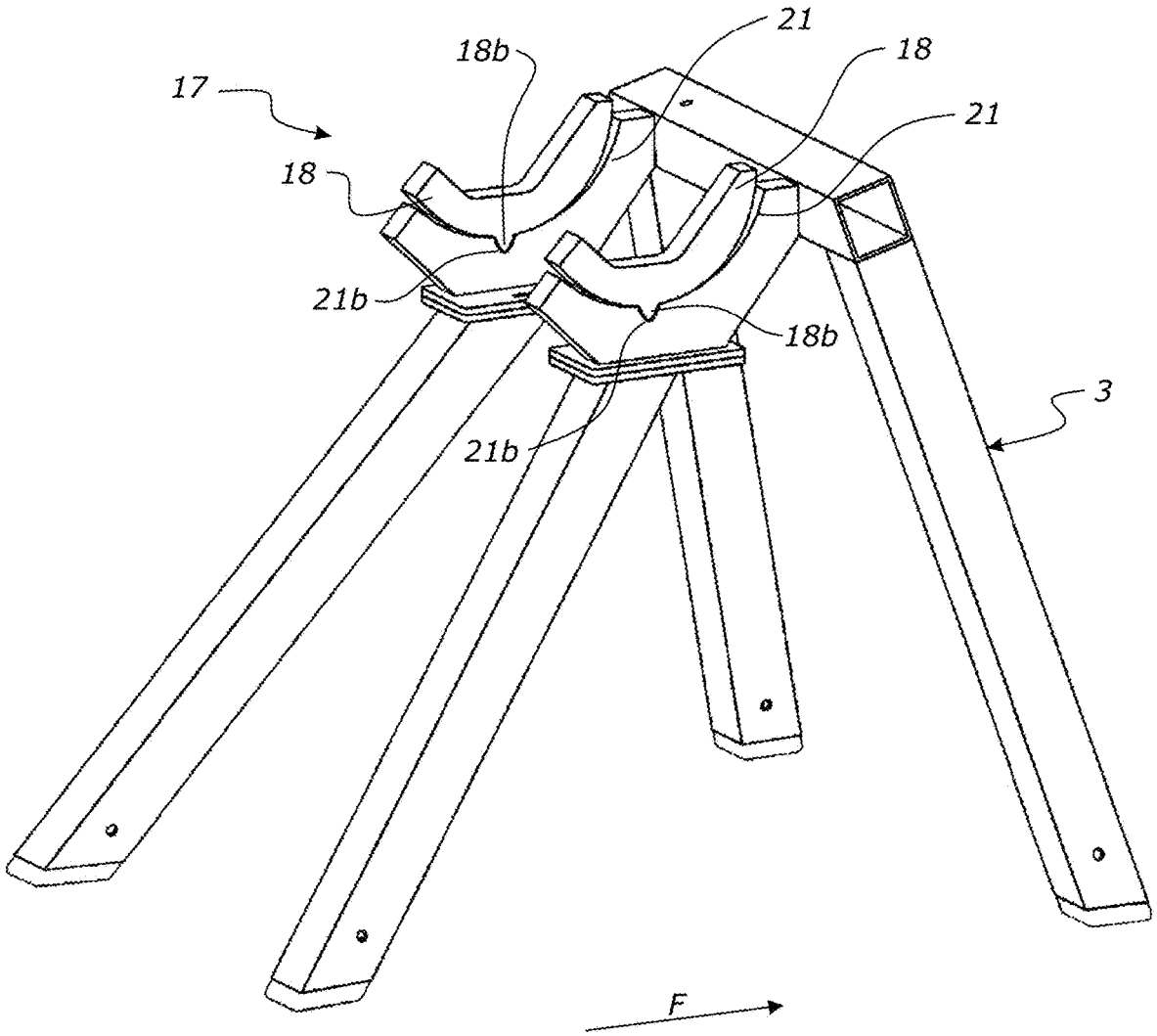
FIG. 17 is a rear perspective view of part of an alternative rocking mechanism for use in the chair of FIGS. 1 to 15, showing another alternative configuration of engagement features.

As a further alternative embodiment, rather than a spur gear 23 and curved rack 25, different complementary engagement features could be used. The engagement features could be provided on the rock surfaces or on adjacent surfaces. For example, as shown in FIG. 16, one or both of the concave rock surface 21 and convex rock surface 18 may comprise complementary high friction surfaces 21*a*, 18*a* such that the convex surface 18 can rock relative to the concave surface 21 with minimal slip between the respective rock surfaces 18, 21. As shown in FIG. 17, the convex rock surface 18 may comprise a single tooth 18*b* that engages a complementary recess 21*b* in the concave rock surface 21. The tooth 18*b* being configured to be fully seated in the recess 21*b* when the transom was in a neutral rock position relative to the base 3, and moving out of engagement, away from its seated position as the transom 11 is rocked forwards or rearwards. The configuration of FIG. 17 may additionally have the high friction surface(s). Other tooth and surface embodiments are envisaged. For example, the convex rock surface 18 may comprise one or more front teeth and one or more rear teeth that engage complementary recesses in the concave rock surface 21. The front tooth or teeth being configured to be fully seated in the respective recess(es) when the transom is rocked to a forward position relative to the base 3, and the rear tooth or teeth being configured to be fully seated in the recess(es) when the transom is rocked to a rearward position relative to the base 3.

As a further alternative, the tooth or teeth could be provided on the base 3 and the complementary recess provided on the transom 11.

The springs of the chair may be configured to act only in tension, only in compression, or both in tension and in compression. For example, the springs may be configured to act only in tension. In that configuration, the front spring(s) will resist rearward rock and the rear spring(s) will resist forward rock. In an alternative configuration, the springs may be configured to act only in compression. In that configuration, the front spring(s) will resist forward rock and the rear spring(s) will resist rearward rock. The springs may act in one direction and lose contact or decouple in the opposite direction.

Figure 36:
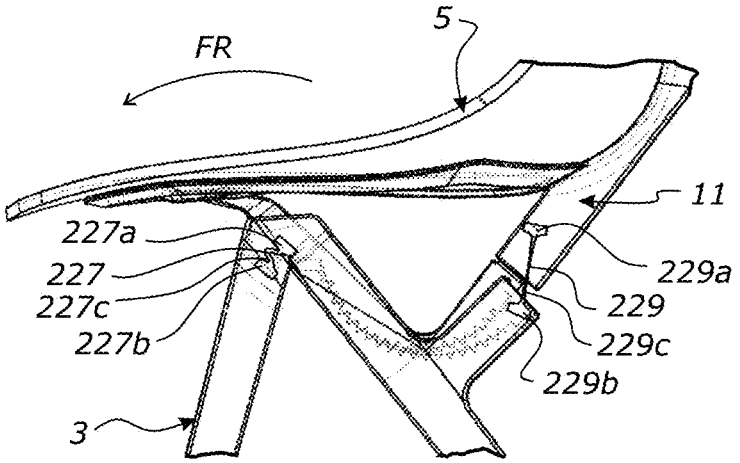
FIGS. 36(*i*) to 36(*iii*) are side views showing the rocking motion of the chair with alternative biasing members, where FIG. 36(*i*) shows the chair in a forward rocked configuration, FIG. 36(*ii*) shows the chair in a neutral position, and FIG. 36(*iii*) shows the chair rocked rearwardly.
Figure 36:
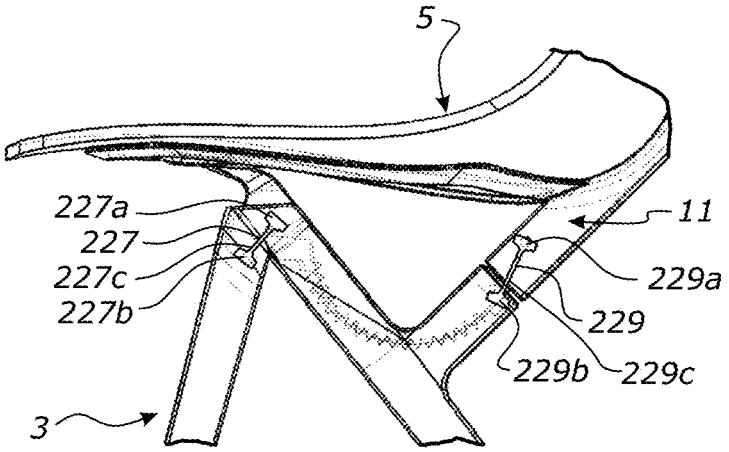
Figure 36:
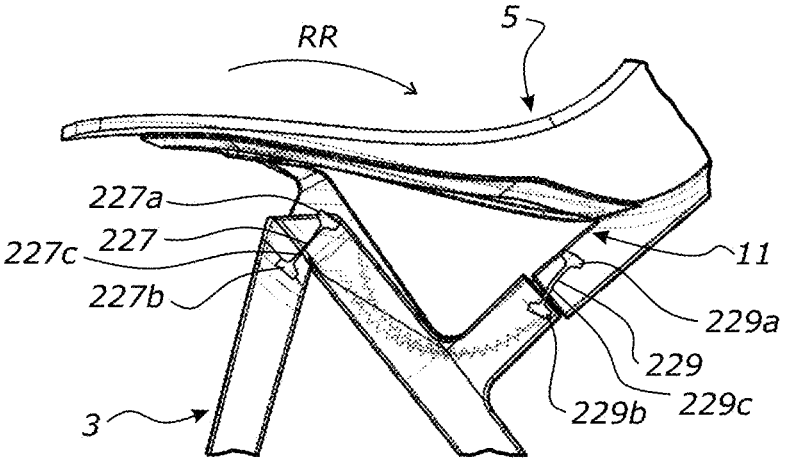
Figure 37:
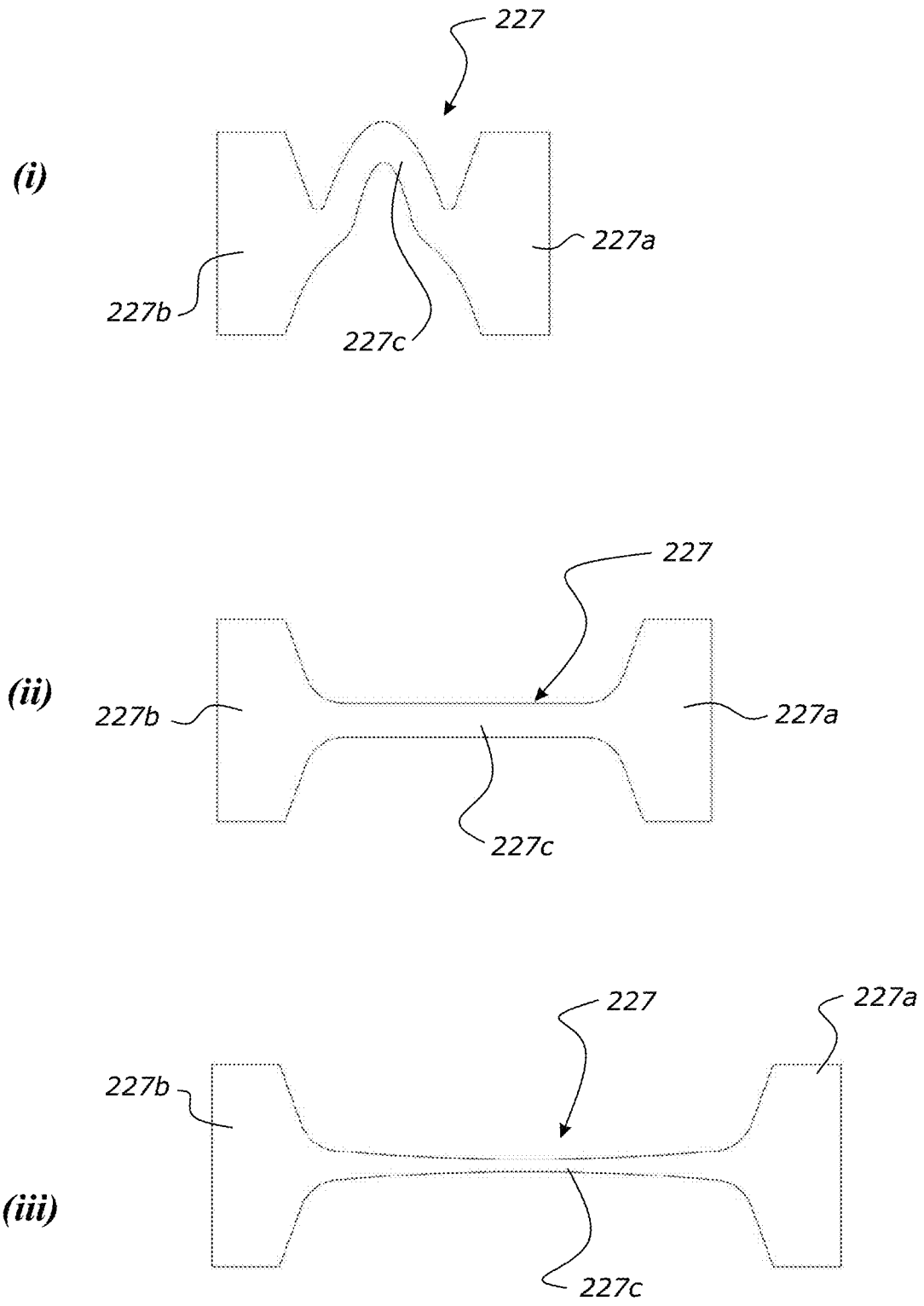
FIGS. 37(*i*) to 37(*iii*) are side views of the front biasing member of the chair of FIGS. 36(*i*) to 36(*iii*), where FIG. 37(*i*) shows the front biasing member when the chair is in a forward rocked configuration, FIG. 37(*ii*) shows the front biasing member when the chair is in a neutral position, and FIG. 37(*iii*) shows the front biasing member when the chair rocked rearwardly.

FIGS. 36 and 37 show alternative springs 227, 229 that act predominantly in tension and that provide little or no resistance to compression. The springs 227, 229 in their relaxed, neutral positions (e.g., FIG. 36(*ii*)) are generally H-shaped members, with first ends 227*a*, 229*a* operatively connected to the transom 11 to rock with the seat shell 5 and second ends 227*b*, 229*b* operatively connected to the chair base. Elongate intermediate regions 227*c*, 229*c* extend between and connected to the first ends 227*a*, 229*a* and second ends 227*b*, 229*b*. The springs may be integrally formed from any suitable material such as rubber, urethane, or the like.

FIG. 36(*i*) shows the chair in a forward rocked FR position. The front spring 227 has the configuration shown in FIG. 37(*i*), in which it is slack and the intermediate region 227*c* has deformed to enable the ends 227*a*, 227*b* of the spring to collapse toward each other. The intermediate region 229*c* of the rear spring has elongated to enable the ends 229*a*, 229*b* of the spring to move apart from one another. The rear spring 229 resists the forward rock of the chair.

FIG. 36(*ii*) shows the chair in a neutral rock position. In this position the front and rear springs 227, 229 have a neutral, relaxed state similar to that shown in FIG. 37(*ii*).

FIG. 36(*iii*) shows the chair in a rearward rocked RR position. The front spring 227 has the configuration shown in FIG. 37(*iii*), in which the intermediate region 227*c* has elongated to enable the ends 227*a*, 227*b* of the spring to move apart from one another. The front spring 227 resists the rearward rock of the chair. The intermediate region 229*c* of the rear spring has deformed.

FIGS. 38 and 39 show alternative springs 327, 329 that act only in tension and that provide no resistance to compression. Each spring 327, 329 has a first, free end 327*a*, 329*a*, a second end 327*b*, 329*b* that is operatively connected to the chair base 3, and an intermediate region comprising an elongate recess 327*c*, 329*c*. The transom 11 has projections 11*a*, 11*b* such as pins that are received in the recesses 327*c*, 329*c*, and that can slide in the recesses 327*c*, 329*c*. The springs may be integrally formed from any suitable material such as rubber, urethane, or the like.

FIG. 38(*i*) shows the chair in a forward rocked FR position. The front spring 327 has the configuration shown in FIG. 39(*i*), in which the spring has not been deformed and the projection 11*a* is positioned at the end of the recess 327*c* closest to the second end 327*b* of the spring. The rear spring 329 is in its fully deformed/stretched configuration, which has been caused by the projection 11*b* pulling against the end of the recess 329*c* adjacent the free end 329*a* of the spring, and stretching the intermediate region of the spring to elongate the spring. The rear spring 329 resists the forward rock of the chair.

FIG. 38(*ii*) shows the chair in a neutral rock position. In this position the front and rear springs 327, 329 have a neutral, relaxed state similar to that shown in FIG. 39(*ii*).

FIG. 38(*iii*) shows the chair in a rearward rocked RR position. The front spring 327 has the configuration shown in FIG. 39(*iii*), in which it is in its fully deformed/stretched configuration, which has been caused by the projection 11*a* pulling against the end of the recess 327*c* adjacent the free end 327*a* of the spring, and stretching the intermediate region of the spring to elongate the spring. The front spring 327 resists the rearward rock of the chair. The rear spring 329 is in a neutral, relaxed state similar to the position shown for the front spring in FIG. 39(*i*).

In an alternative configuration, the ends of the springs could be operatively connected to the transom 11 and the projections could instead by provided on the chair base 3.

FIG. 40 shows another alternative spring 427, 429 that functions in a similar way to that of FIGS. 38 and 39 and that may be used in place of the inserts of FIGS. 32 to 35. The springs 427, 429 comprise a body with a first end 427*a*, 429*a*, a second end 427*b*, 429*b*, and an intermediate recess 427*c*, 429*c*. A u-shaped band 427*d*, 429*d* extends from an end of the recess 427*c*, 429*c* adjacent the second end 427*b*, 429*b*, into the recess and around a projection 11*a*, 11*b* from the transom 11, and back to an end of the recess adjacent the second end 427*b*, 429*b*. FIG. 40 shows the spring in the relaxed state. When the projection 11*a*, 11*b* moves in direction D1, the band 427*d*, 429*d* will stretch and tension, resisting that movement. When the projection 11*a*, 11*b* moves in direction D2, the projection will separate from the band 427*d*, 429*d* so that the band does not influence that movement at least for the latter part of the movement.

FIG. 41 shows another alternative spring 527, 529 that is similar to that of FIG. 40. In this configuration, the projection 11*a*, 11*b* is received in an aperture 527*e*, 529*e* of the band 527*d*, 529*d*. Because the projection 11*a*, 11*b* is received in the aperture 527*e*, 529*e*, the spring will predominantly act in tension (direction D1) but will also act, to a lesser extent, in compression (direction D2).

Any of the springs described herein may be configured so that when the chair is in a neutral position, the springs have a small amount of preload.

Figure 18:
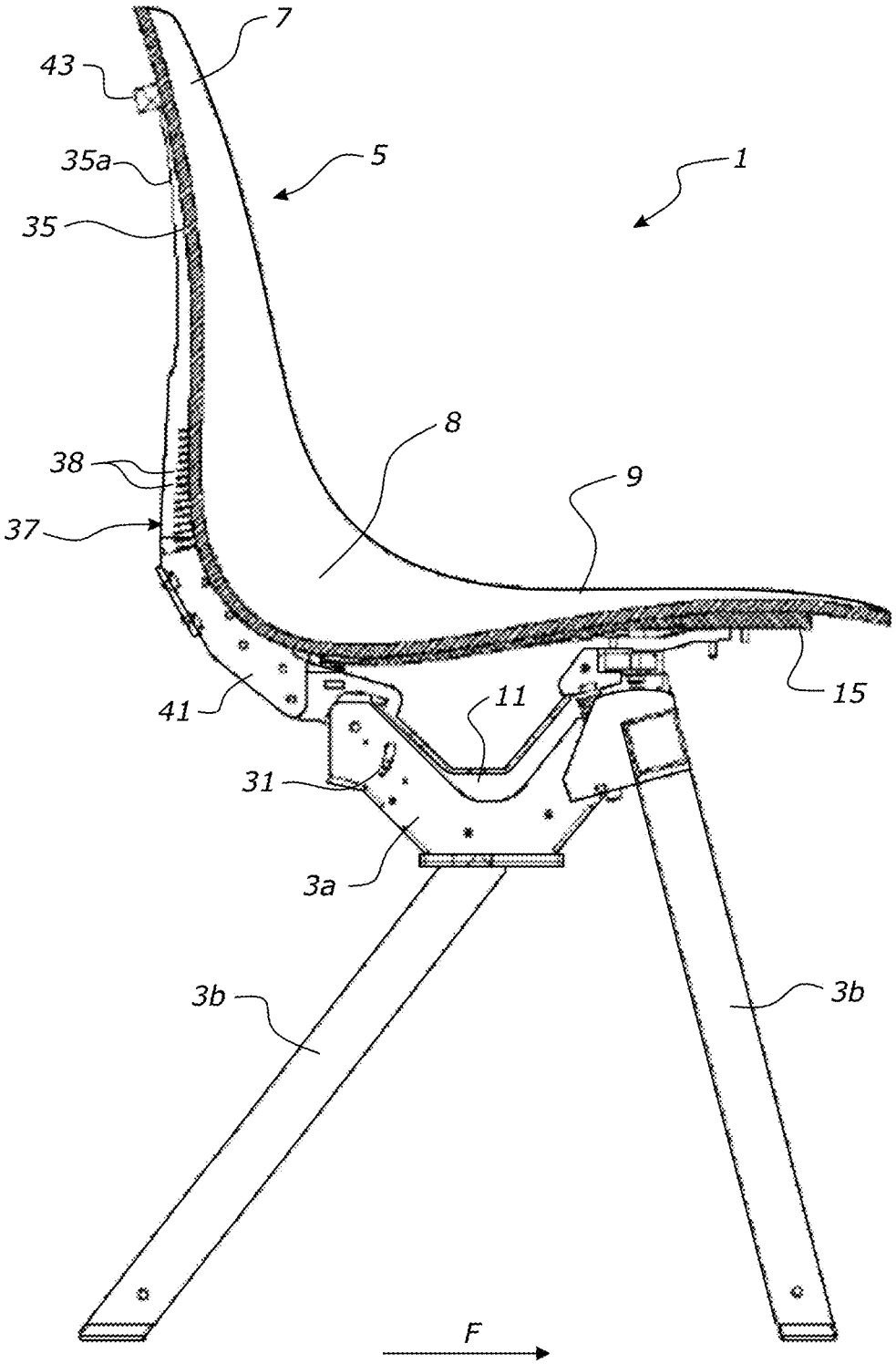
FIG. 18 is a sectioned side elevation of the chair of FIGS. 1 to 17, in an upright position, showing the recline mechanism.
Figure 19:
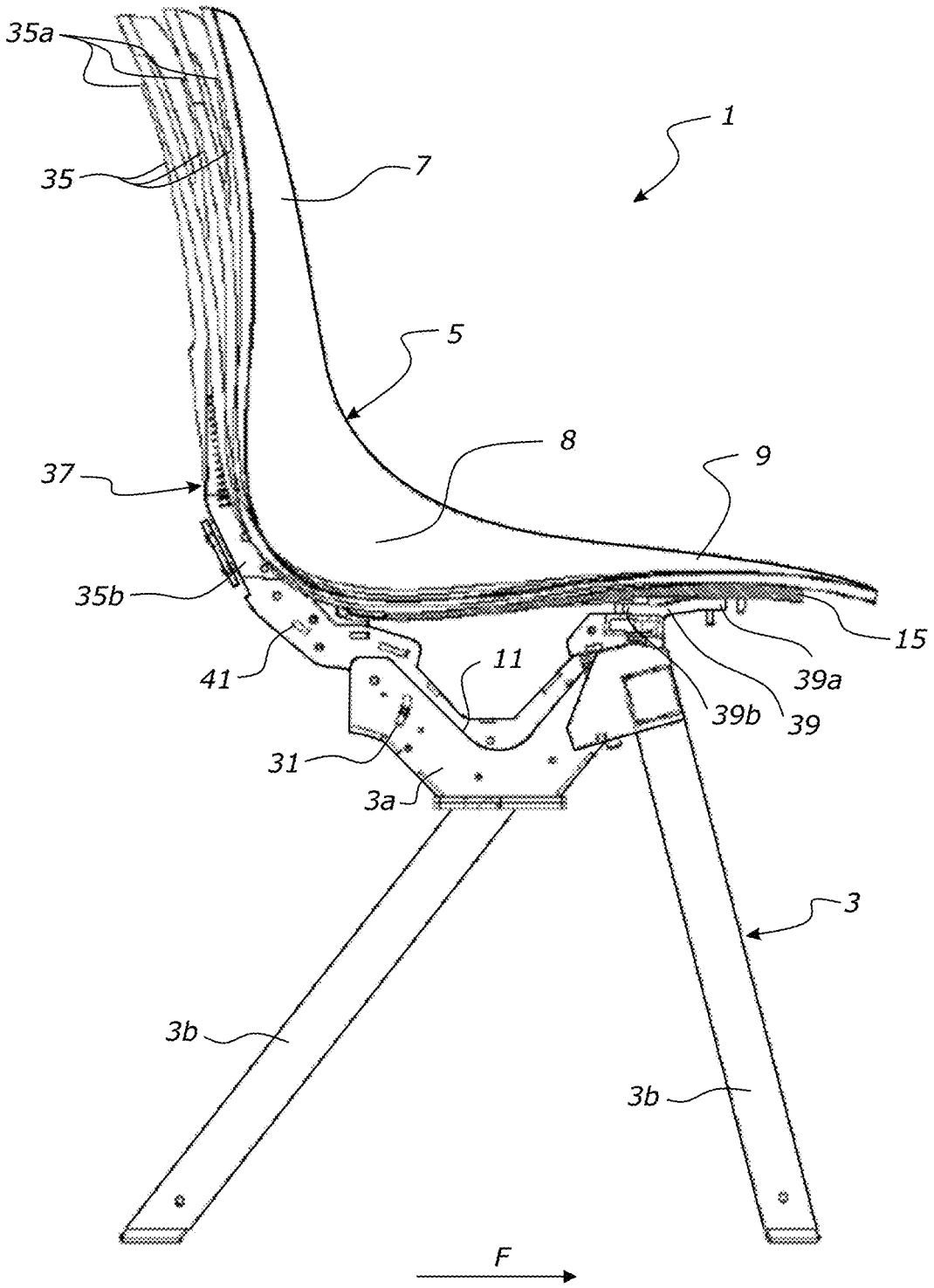
FIG. 19 is a sectioned side elevation of the chair of FIGS. 1 to 18, showing the back portion of the chair upright, partially reclined, and more reclined.
Figure 20:
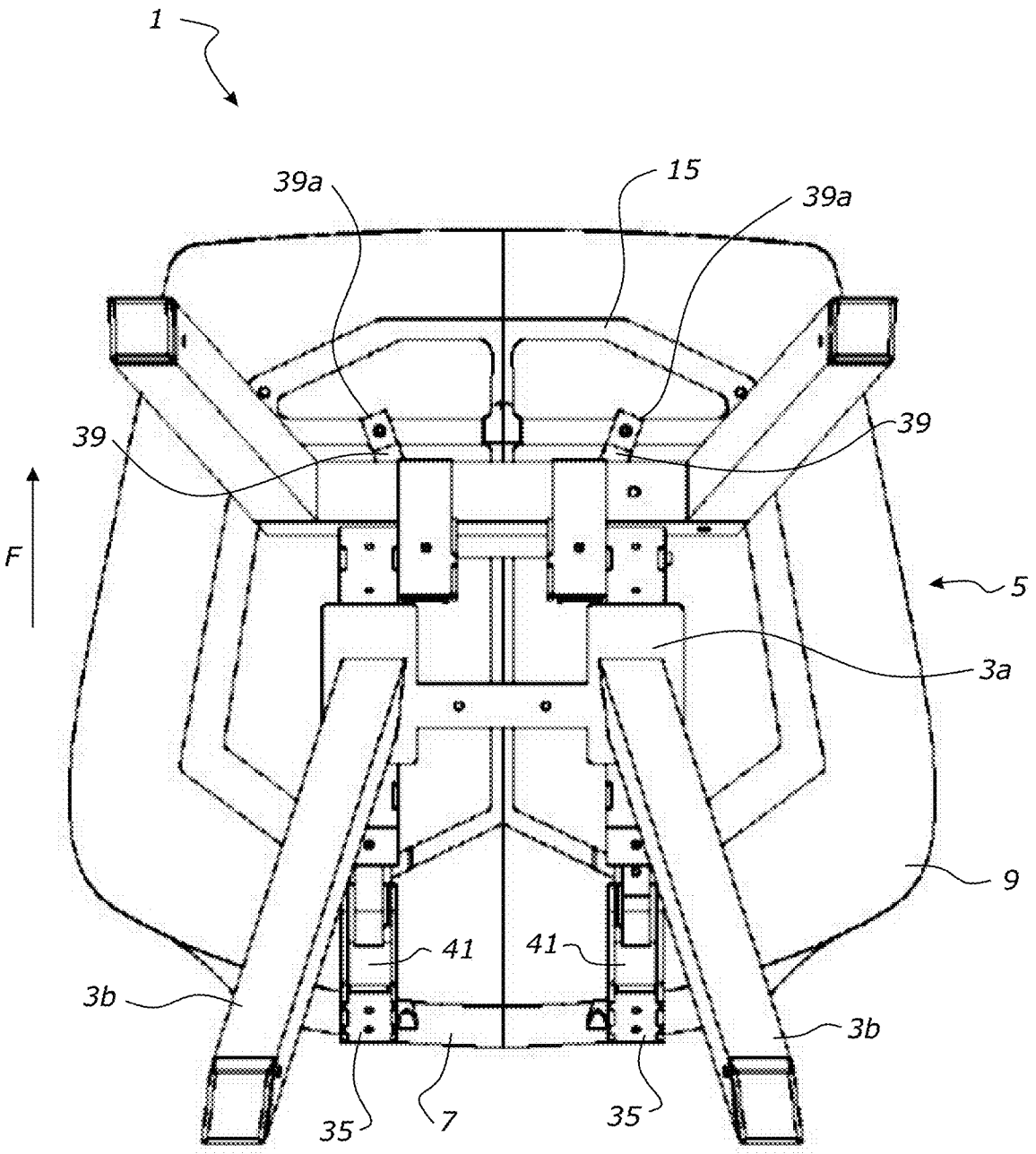
FIG. 20 is an underside view of the chair of FIGS. 1 to 19.
Figure 21:
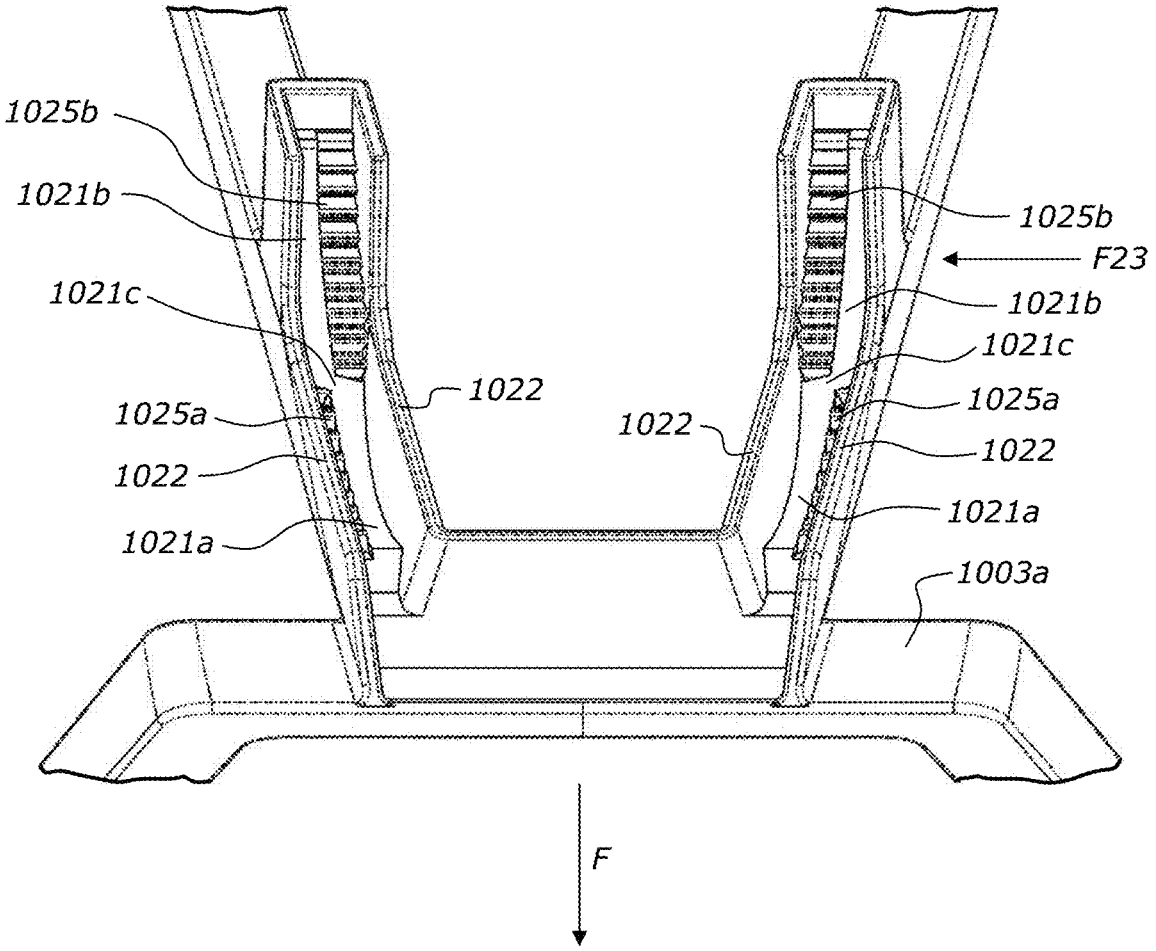
FIG. 21 is an overhead plan view of an alternative lower rock surface and rack arrangement in the chair base, where the racks and lower rock surfaces are offset.
Figure 22:
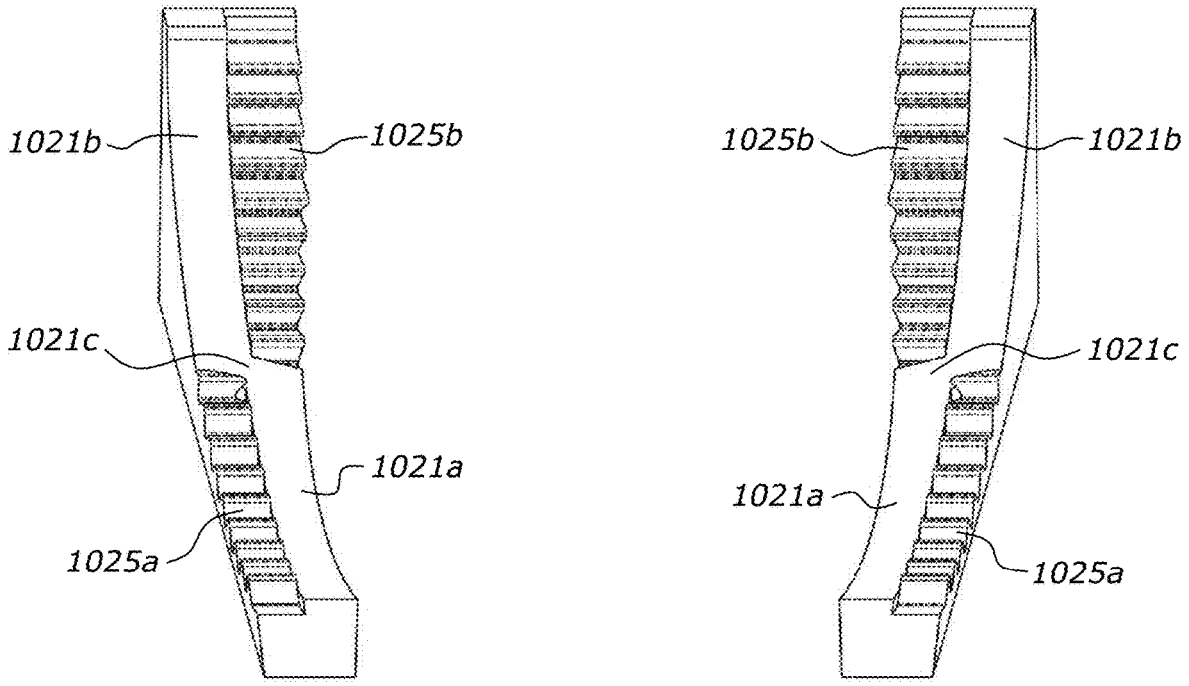
FIG. 22 is an overhead plan view similar to FIG. 21, but only showing the racks and lower rock surfaces of the chair base.
Figure 23:
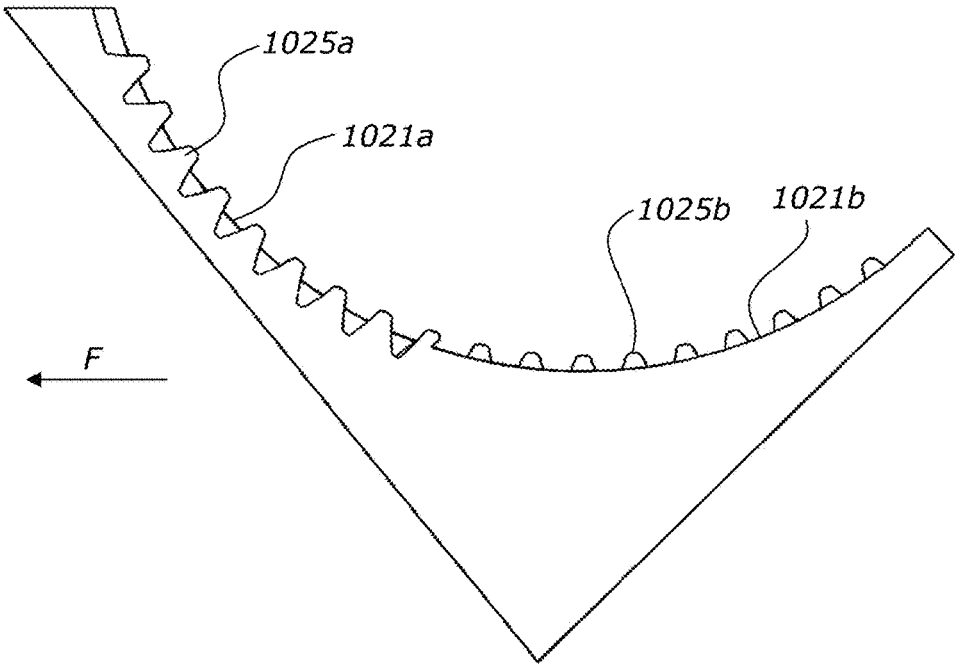
FIG. 23 is a side elevation view of one rack and lower rock surface in direction F23 of FIG. 21.

Referring to FIGS. 18 to 20 the seat shell 5 is movably supported on the transom 11 by way of a recline mechanism, such that the seat shell 5 can recline relative to the transom 11. The recline mechanism comprises two laterally spaced resilient front support members 39. Each front support member 39 has a front end 39*a* attached to the seat portion 9 of the seat shell via the support frame 15, and a rear end 39*b* attached to the transom 11.

The thickness, shape, dimensions, and/or material of the front support members 39 may be selected to provide the desired amount of resilience. For example, the members 39 may be thin so that they are more flexible and provide little resistance to movement of the front portion of the shell 5, or may be thicker so that they are less flexible and provide more resistance to movement of the front portion of the shell 5. That may provide stiffer recline of the shell and/or a smaller extent of recline.

The front ends 39*a* of the front support members are positioned more laterally outward relative to the transom 11 than the rear ends 39*b*, which are positioned more medially. This may assist with providing a wider support beneath the seat, reducing finger traps, and improved aesthetics. Alternatively, the front support members could be parallel or inward-facing.

The rear part of the seat portion 9 is not connected to the transom 11.

The back portion 7 of the seat shell 5 is attached to the transom 11 by way of two upright back support arms 35. Each back support arm 35 has a lower end 35*b* rigidly attached to the transom 11 via a back extension 41, and an upper end 35*a* rigidly attached to an upper part of the back portion 7. Part of each back support arm 35 at or below a lower part of the back portion 7, below the flex region 37 is spaced from the back portion 7. A top transverse cross bar 43 joins the tops 35*a* of the back support arms 35 to minimise movement of the back support arms 35 towards and away from each other.

The back support arms 35 may be directly bolted or otherwise attached to the transom 11, or may be attached via a back arm or transom extension.

Each back support arm 35 has a flex region 37 positioned near a lower part of the back portion 7. The flex regions 37 each comprise a series of slots 38 or notches extending from a front surface of the back support arm 35, part way through the thickness of the back support arm. For example, the notches may extend from a front surface of the back support arm to about half way through the thickness of the support arm. The slots 38 or notches increase the local flexibility of the back support arm near the slots 38 to increase the rearward flexibility of the flex regions 37 compared to the rest of the back support arms 35. The flex regions 37 may also be more flexible than the rest of the back support arms 35 in a forwards direction. Alternatively, the slots or notches may be positioned in a rear surface of the back support arm, with there being sufficient space between upper and lower portions of the notches that they can close to enable rearward flexing.

At least a portion of the seat shell 5 is resilient such that the back portion 7 can resiliently recline relative to the seat portion 9; for example via a joining or intermediate region 8 between the back portion 7 and seat portion 9. As the back portion 7 is reclined relative to the seat portion 9, the back support arms 35 flex at their flex regions 37 to allow the recline. FIG. 19 shows the recline motion of the back portion 7 and the back support arms 35.

As the back portion 7 is reclined, the rear part of the seat portion 9 lifts, deforming the resilient front support members 39. The lower portion of the back support arms 35 are spaced from the back portion 7 helps facilitate the seat lift. In addition, the back support arms 35 comprise a substantially non-compressible or stretchable material, which prevents extension of the back portion 7 during recline, encouraging seat lift.

The maximum lift of the rear of the seat portion 9 and the force required to lift the rear of the seat 9 is partially controlled by the length and stiffness of the front support members 39. The maximum lift of the rear of the seat portion 9 and the force required to lift the rear of the seat 9 is predominantly controlled by the compliance or flexibility of the seat portion. In addition, the weight force of an occupant seated in the chair 1 opposes the seat lift thereby providing some weight compensation of the recline force. That is, a greater rearward force is required to recline the back portion 7 relative to the transom 11 for a heavier occupant compared to the recline force required to recline the back portion 7 for a lighter occupant.

In combination, the rock and recline mechanisms provide a smooth transition between rocking and reclining motions. When the occupant leans back in the chair 1, the back portion 7 initially remains substantially upright relative to the seat portion 9 and the chair will rock rearward. As the seat portion 5 rocks rearward and the rock resistance increases, the back portion 7 will recline relative to the seat portion 9 as the rock resistance becomes greater than the recline resistance. The rock and recline mechanisms may be configured with a desired point in the rocking motion at which back portion starts reclining, for example, at a forward, intermediate, or rearward position in the rocking motion.

The support frame 15 forms a supportive understructure for the seat shell 5, providing load support to the occupant on seat portion when back portion is not reclined. The support frame 15 may be substantially rigid or may be resiliently flexible. In one form, the flexibility of the support frame 15 is less than the flexibility of the seat portion 9. The support frame 15 is coupled to the seat portion 9 at a front part of the support frame 15, but not at a rear portion of the frame 15 to enable the rear portion of the seat portion 9 to raise away from the support frame 15 as the seat portion 9 lifts during recline of the back portion 7. The chair 1 may comprise a cowling or other cover (not shown) to prevent fingers becoming caught between the support frame 15 and the seat portion 9.

The exemplary embodiment of FIGS. 1 to 20 is shown in the figures with a solid seat shell 5 for clarity. However, the seat shell 5 may comprise a compliant structure for comfort and/or to enhance the recline motion of the back portion 7 relative to the seat portion 9. An exemplary embodiment of such a support shell is shown in FIGS. 25 to 31.

Figure 25:
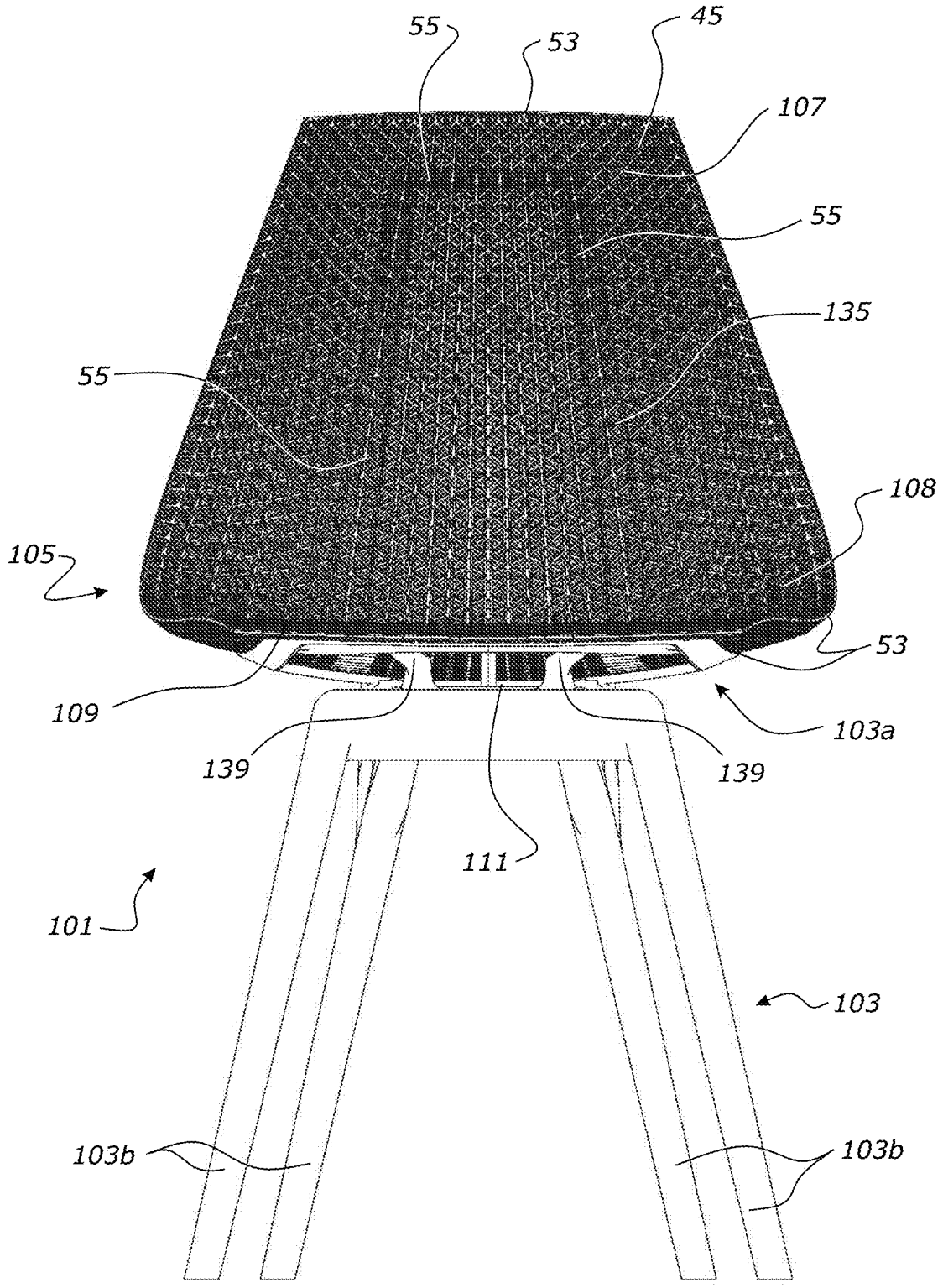
FIG. 25 is a front view of a second exemplary form of the present invention, having a compliant seat shell.

FIG. 25 shows a chair 101 with an exemplary embodiment compliant support shell 105. Unless otherwise indicated, the components of the chair 101 are labelled with like reference numbers compared to the embodiment of FIGS. 1 to 20, but with the addition of 100.

A major part of the seat shell 105 comprises a compliant structure 45. In one form, at least a major part of the back portion 107, seat portion 109, and intermediate joining region 108 of the seat shell 105 comprises the compliant structure 45. In one form, substantially the entire seat shell 105 comprises the compliant structure. The compliant structure 45 consists of a plurality of members or cells 47 interconnected by a plurality of resilient connectors 49. In the exemplary embodiment, the cells 47 are substantially triangular. In some embodiments, at least some of the cells may have three substantially equal length sides and substantially equal included angles between adjacent sides. In other embodiments, at least some of the cells may have sides and/or included angles that differ. Three connectors 49 extend from each cell 47, one connector 49 from each apex of each triangular cell 47, and each attach to a further cell 47 such that each cell 47 in the compliant structure 45 is connected to three other cells 47.

The resilient connectors 49 for a given cell 47 may be orientated at approximately 120° to each other. The angles may vary depending on the curvature/shape of the shell. For example, as shown in FIG. 26*b*, the angles in different regions R1-R8 may vary between about 100° and about 140° depending on the location in the shell, but may average approximately 120° over a substantial portion of the shell. The greatest variations from 120° may occur at more extreme regions of the shell; for example at edges or corners of the shell (R2, R3, R7). Each resilient connector 49 extends orthogonal to a side of each of the two cells 47 it extends between such that the two cells 47 each connector 49 joins have sides that are substantially parallel when the structure 45 is in a neutral unstressed configuration, such as that shown in FIG. 27.

The resilient connectors 49 are substantially straight but alternatively could be curved. The ends of the resilient connectors 49 may be filleted or have a radius where they join the cells 47 for manufacturing purposes, or to reduce stress concentrations.

Figure 27:
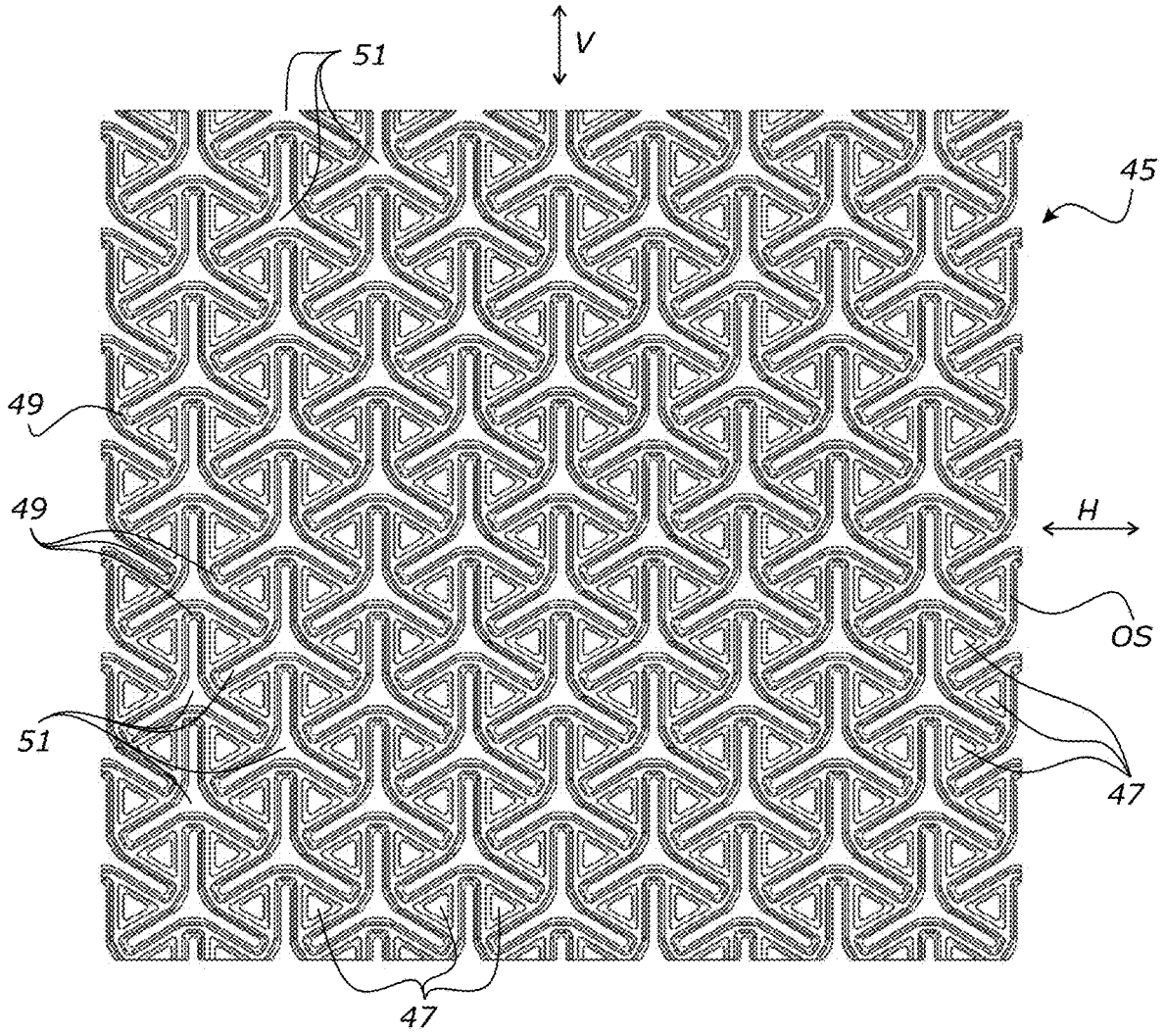
FIG. 27 is a plan view of a portion of the compliant structure in an unstressed state.

The cells 47 and the resilient members 49 together define a plurality of voids 51 which, in the form shown, are Y-shaped. As shown in FIG. 27, the Y-shaped voids 51 are provided in a series of overlapping, offset rows and columns. The voids 51 extend as openings through the depth of the compliant structure.

Figure 31:
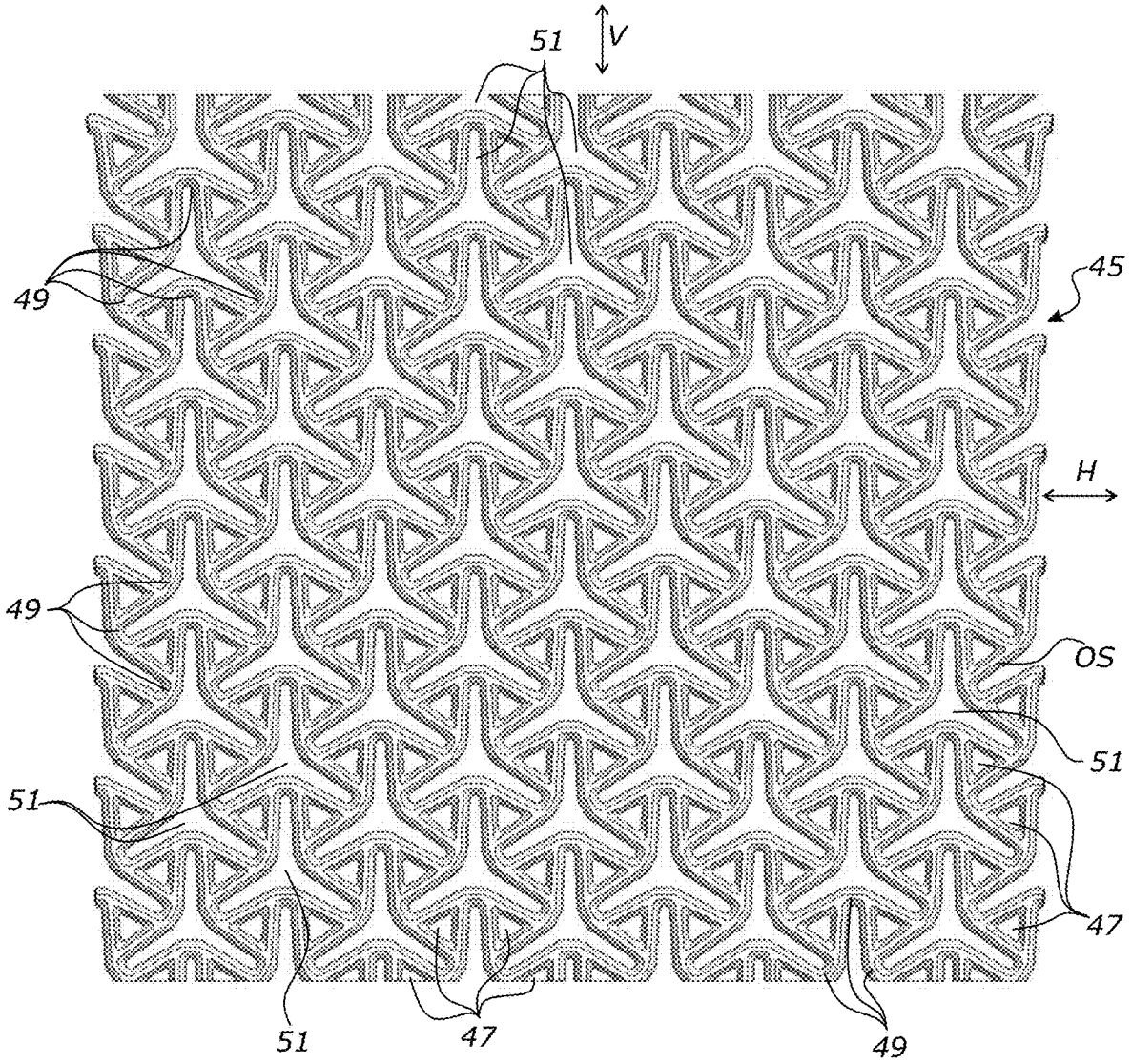
FIG. 31 is a plan view similar to FIG. 27, but is a representative view showing the compliant structure in a stressed (expanded) state.

The cells 47 and resilient members 49 together define a structure that displays auxetic characteristics. That is, the structure 45 has a negative Poisson's ratio in the plane of the structure, with compression in a first direction V causing the structure to also contract in a second orthogonal direction H and extension in a first direction V causing the structure to also expand in a second orthogonal direction H (FIG. 27). Additionally, compression in the second direction H would cause the structure to also contract in the first direction V, and extension in the second direction H would cause the structure to also expand in the first direction V. The structure is substantially non-compressible in a direction extending through the plane of the structure (e.g., in a direction extending into the page for FIG. 27). The auxetic behaviour may contribute to reducing strain in the shell 105. FIG. 31 is an image shown a portion of the compliant structure in an expanded configuration. It can be seen that at least portions, and typically substantially the entirety, of the voids 51 have expanded in size. The opposed side walls of the voids 51 have become non-parallel, and diverge from their connections to the resilient members. Additionally, the cells 47 have moved from their positions shown in FIG. 27. The extent of expansion of the voids 51 and movement of the cells 47 may be more or less than that shown, depending on the configuration and position in the compliant structure.

The compliant structure 45 provides compliance in the seat and back portions 109, 107, for comfort. The compliant structure in an intermediate joining region 108 between the seat and back portions 109, 107 may also enable recline of the back portion 107 relative to the seat portion 109.

As the back portion 107 is reclined relative to the seat portion 109, the joining region 108 deforms. For example, the joining region may contract and/or expand in the first direction V and/or in the second orthogonal direction H. The joining region may contract and/or expand in both the first direction V and in the second orthogonal direction H. The joining region 108 of the shell may exhibit the auxetic characteristics described above.

The seat shell 105 has a solid perimeter 53 that extends along the top and down the sides of the back portion 107, and along the front edge and along the sides of the seat portion 109. The perimeter comprises a section of the compliant surface where the Y-shaped voids are 'filled in'. Alternatively, the perimeter may be a solid, unpatterned strip.

The perimeter 53 is substantially non-compressible and substantially non-extendible in the plane of the structure, such that the length of the perimeter along the sides of the back portion 107 is unchanged as the back portion 107 reclines or flexes relative to the seat portion 109, and such that the length of the perimeter along the sides of the seat portion 109 is substantially unchanged as the seat portion 109 flexes. That assists with lifting of the seat portion 109 as the back portion 107 of the shell is reclined.

In the embodiment shown, the solid perimeter 53 extends around the entire edge of the seat shell 105. However, alternatively the solid perimeter 53 may extend along only a portion of the shell edge, or the seat shell 105 may not have a solid perimeter.

In addition, the seat shell 105 comprises a number of solid, substantially non-compressible attachment regions 55 for attachment to a chair support structure; e.g., to a transom or seat support for example. The solid attachment regions 55 may be regions where the Y-shaped voids are 'filled in' or, alternatively, each attachment region may comprise a solid, unpatterned region. The attachment regions 55 provide additional strength and a suitable surface for attaching a support, for example, for bolting to a back support 35, 135, a seat support 15,115, or transom 11, 111. Additionally, the attachment regions 55 provide suitable load transfer paths and can act as flow leaders during injection moulding of the seat shell 5, 105.

The solid perimeter 53 and attachment regions 55 limit the compression or extension of the compliant structure 45. That can help control the amount of inward lateral movement of the sides of the intermediate region 108 of the shell 105 which is forced to stretch and compress vertically and horizontally in a forward/rearward direction of the chair as the back portion 107 is reclined. Excessive inward lateral movement could be considered by some occupants to be undesirable.

The centres of the Y-shaped voids 51 may be braced or fused where less compliance is desirable.

Additionally or alternatively, the shell 105 may comprise structural regions for other purpose(s). For example, the structural regions may comprise solid regions or relatively stiff regions, to provide reduced compliance in the structural regions. The structural regions may be solid and/or may be relatively thick.

FIGS. 42 and 43 show a variant of the shell 105. An array of solid structural regions 55' are provided in the back portion 107 and seat portion 109. The structural regions 55' will be integrally moulded with the shell 105 and provide lesser compliance of the shell compared to other regions that do not have the structural regions 55'. At least some of the structural regions (for example the structural regions extending up/down in the back portion 107, through the joining region 108, and forward/rearward in the seat portion 109) act as lifting regions or straps to assist with lifting the seat portion 109 as the back portion 107 is reclined. At least some of the structural regions (for example, the structural regions extending toward the edges and corners of the shell) act to provide occupant support.

Different regions of the compliant structure 45 may comprise resilient connectors 49 of differing thicknesses, the thicknesses being selected to provide regions of greater and lesser compliance within the compliant structure. For example thicker resilient members 49 may be provided where less compliance is desirable, and thinner resilient members 49 may be provided where more compliance is desirable.

In addition or alternatively, different regions of the compliant structure 45 may comprise resilient connectors 49 of differing lengths, the lengths being selected to provide regions of greater and lesser compliance in the compliant structure. For example shorter resilient members 49 may be provided where less compliance is desirable, and longer resilient members 49 may be provided where more compliance is desirable.

Figure 26A:
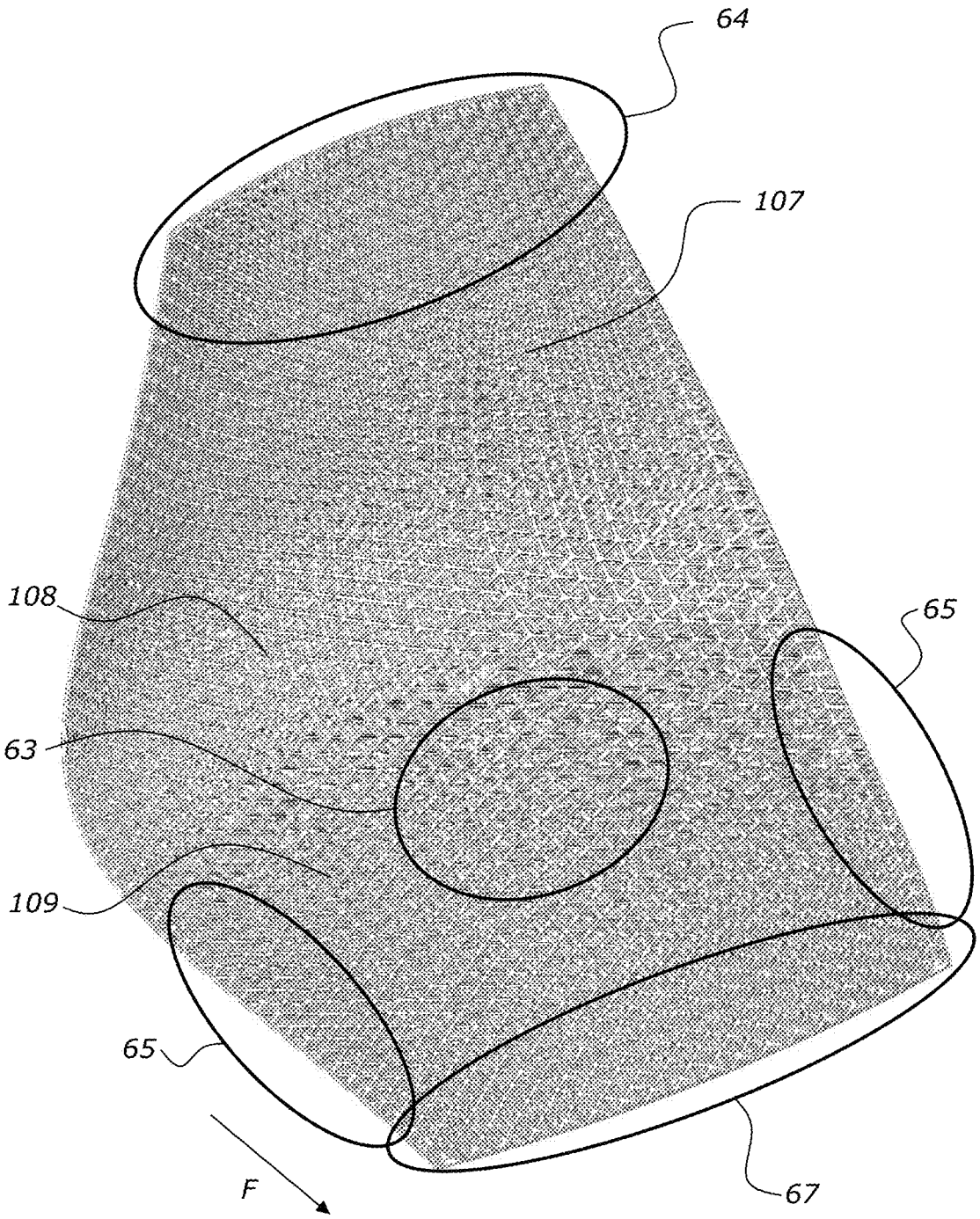
FIG. 26*a* is an overhead perspective view of the seat shell of FIG. 25, showing different regions of the shell.
Figure 26B:
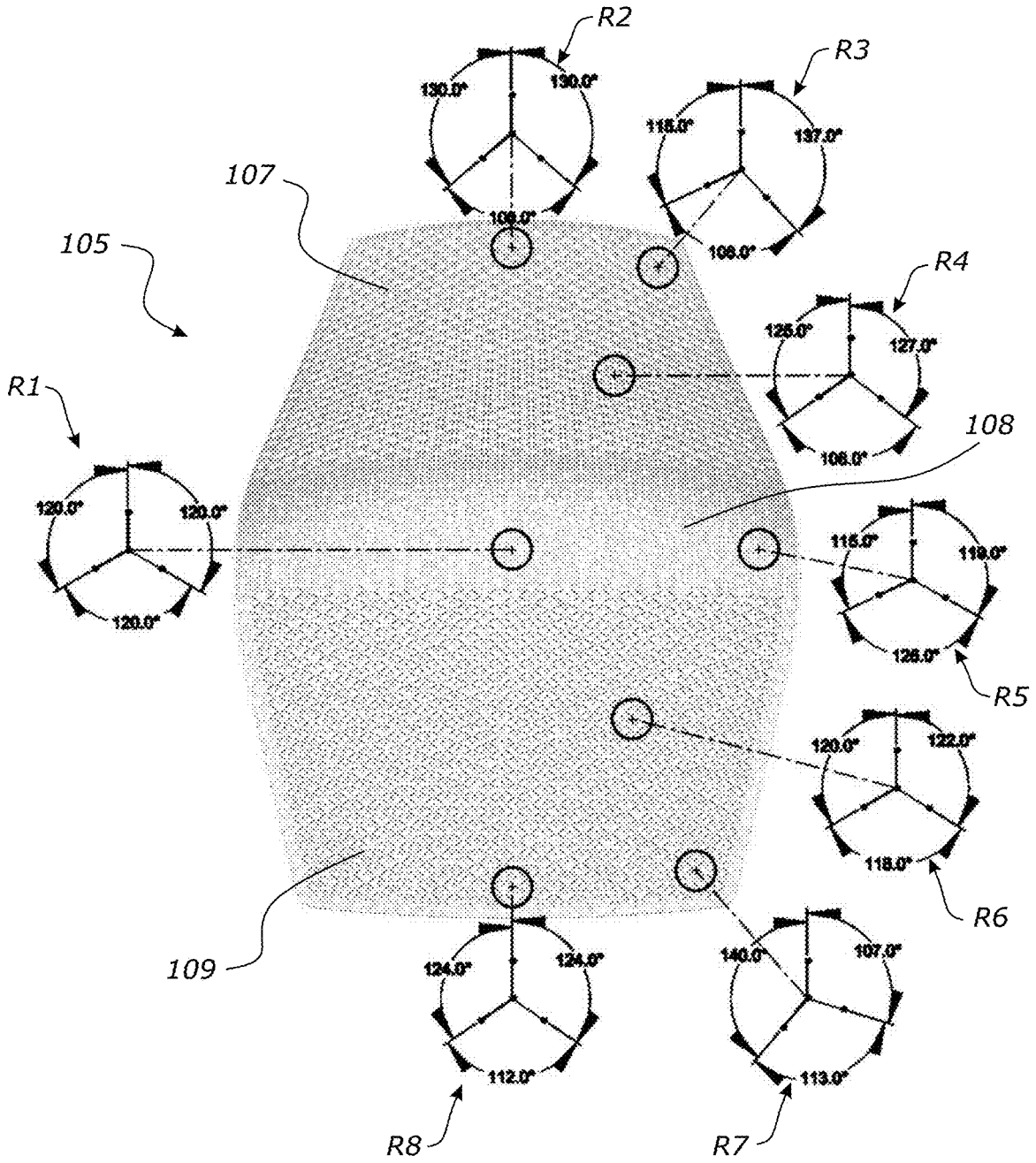
FIG. 26*b* is an overhead perspective view similar to FIG. 26*a*, but showing exemplary angles of resilient members in different regions of the shell.

FIG. 26*a* shows regions of the seat where higher compliance may be desirable, for example, in one or more of an ischial region 63, an upper part 64 of the back portion 107, front and side seat edges 67, 65 of the seat portion 109 to reduce under-thigh pressure both in a standard sitting posture and when side sitting.

Figure 28:
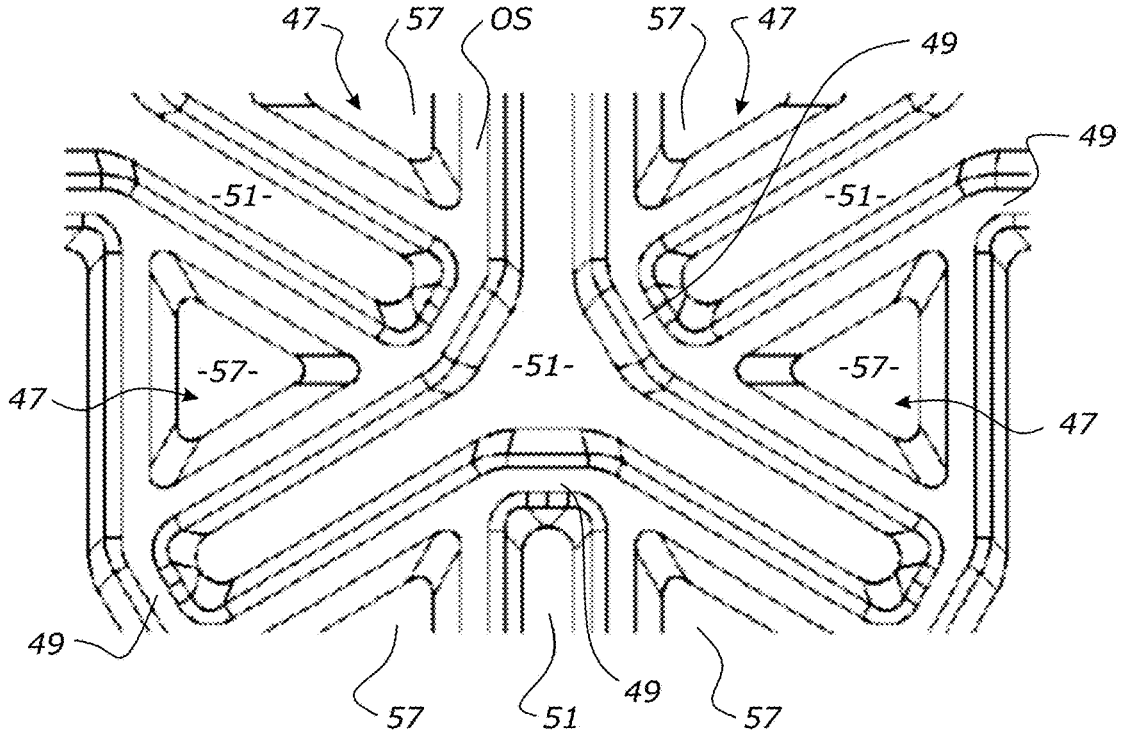
FIG. 28 is an enlarged plan view of a portion of the compliant structure in an unstressed state showing the occupant-facing surface.
Figure 29:
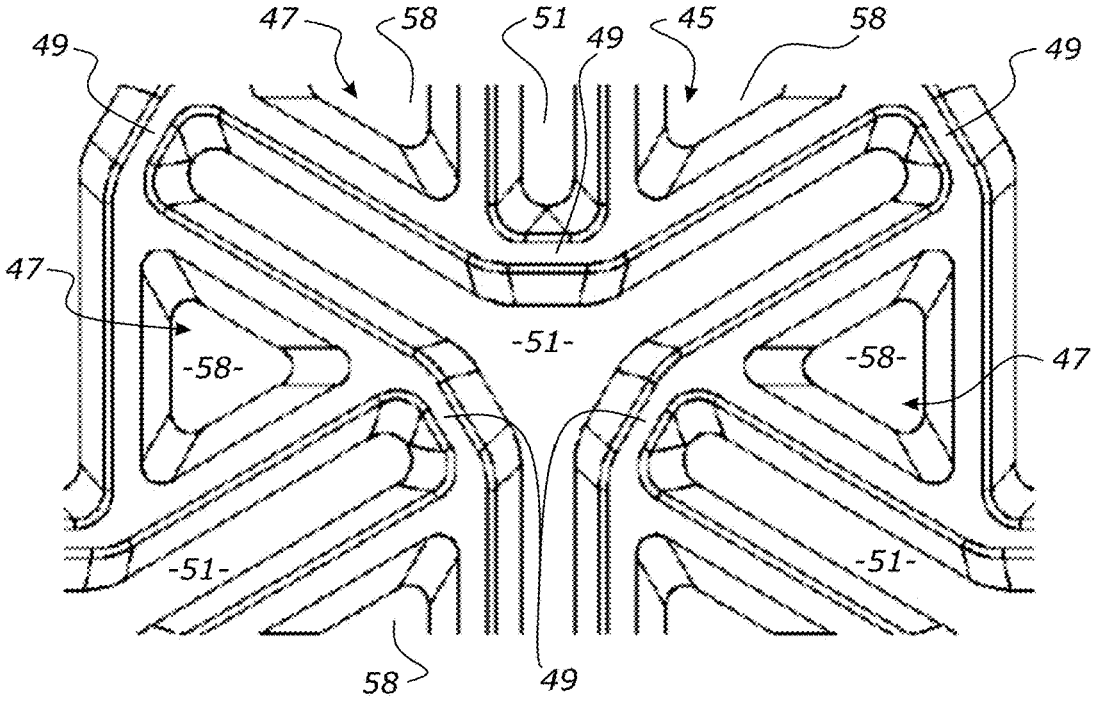
FIG. 29 is an enlarged plan view of a portion of the compliant structure in an unstressed state showing the non-occupant-facing surface.
Figure 30:
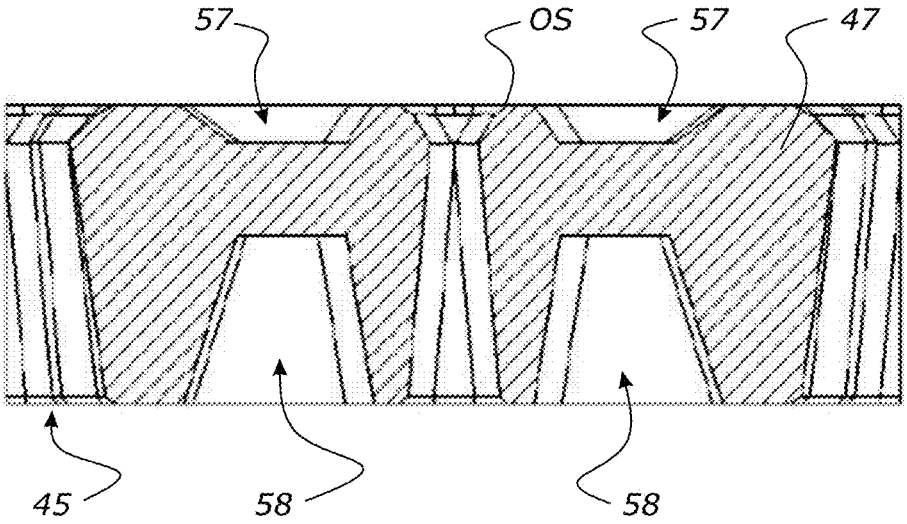
FIG. 30 is a partial section view taken through a portion of the compliant structure, of FIGS. 28 and 29 showing the recesses in the structure surfaces.

Referring to FIGS. 28 and 30, an occupant-facing surface OS of each cell 47 has a recess 57. The occupant-facing recesses 57 reduce the contact surface area between the shell 105 and the occupant, and trap air between the occupant and the surface to reduce thermal conductivity and improve thermal properties of the seat. The cells 47 may also comprise a recess 58 on the shell surface facing away from the occupant. As well as for aesthetic reasons, the recesses 58 on the surfaces facing away from the occupant reduce the amount of material in the shell 105, thereby reducing the weight and cost of the shell 105, they also decrease the thermal mass of the seat shell 105.

The support shell 105 is an integral single layer one piece injection moulded plastic component, but alternatively could be otherwise constructed, or may comprise an alternative material with some resilience, such as a metal or wood based material. The seat and back portions 7, 107, 9, 109 are preferably integrally formed.

The occupant-facing surface of the support shell 105, or both the occupant-facing and opposite surface of the support shell 105 may be upholstered and may comprise cushioning between the shell and the upholstery. In one form, the upholstery may extend across a front of the back portion and top of the seat portion, and have short sections that are received behind the shell, while leaving a large part of the shell open to the rear. In another form, the upholstery may fully surround the shell to cover the front and the back of the shell. Alternatively, the upholstery may be in the form of a pad, and may be provided only for the seat portion or only for the back portion for example.

Preferred embodiments of the invention have been described by way of example only and modifications may be made thereto without departing from the scope of the invention.

For example, the chair may comprise only one back support arm 35, 135, or two or more than two back support arms. In the embodiment of FIGS. 1 to 20, the back support arm upper end(s) 35*a* are rigidly attached to the upper part of the back portion 7, but alternatively, they could instead attach to a mid-part or lumbar region of the back portion 7. The back support members 35 may be upright members, or may be otherwise shaped, for example they may be bent members.

Rather than slots or notches, the increased flexibility in the flex regions of the back support members 35 may be otherwise provided. For example, the back support member 35 may have a corrugated region, a necked region, a varied cross-section, or may comprise a more flexible material.

The back support arm 35 and resilient front support members 39 are shown as being bolted to the back and seat portions 7, 9 of the shell 5. However, alternatively the back supports 35 and/or the resilient members 39 may be integral with the seat shell 5, 105, for example by being integrally moulded with the seat shell 5, 105. Additionally or alternatively the lower rock surfaces 21 and/or the curved racks 25 may be integral with the base 3. Similarly the upper rock surfaces 18 and/or the spur gears 23 may be integral with the transom 11 or with the seat shell 5. The described pattern of the compliant structure in the seat shell 105 is just one possible configuration. The members or cells 47 could have any suitable shapes and/or sizes, with the voids 51 having related shapes and/or sizes. For example, rather than being triangular in plan view, the cells 47 could be circular, square, pentagonal, hexagonal, or any suitable shape. The shapes of the voids will be complementary to the shapes of the cells. The seat shell 105 could have cells of differing shapes in different regions of the seat shell 105. The cells 47 could have a different number of associated resilient connectors 49. For example, the cells could have two, three, four, five, six, or more associated resilient connectors 49. Different cells in different regions of the seat shell could have differing numbers of associated resilient connectors, particularly if the cells have differing shapes in those regions.

The rocking mechanism, recline mechanism, and seat shell are shown on a base having four legs. That configuration is particularly suited to an application where a traditional rigid chair would normally be used, for example, a dining chair. However, alternatively the rocking mechanism, recline mechanism, and/or seat shell may be provided on a pedestal type height adjustable base, for example in a task chair, and/or on a swivel base that enables rotation of the rocking mechanism and support shell about a vertical axis. The features described herein could be used in any suitable seating application, including but not limited to dining chairs, multipurpose chairs, cafeteria chairs, restaurant chairs, breakout space chairs, and meeting environment chairs.

While the preferred form chair will advantageously have all of the features described herein, the various features described herein may be provided alone or in combination. For example, the rocking mechanism could be used in a chair that does not have a recline mechanism (e.g., a tub chair that has a back portion and seat portion in a fixed relationship), or in a chair that has a different type of recline mechanism. As another example, the recline mechanism could be used in a chair that does not have a rocking mechanism or that has a different type of rocking mechanism from that described. As yet another example, the recline mechanism may be used in combination with a chair shell that has some flexibility, but that has a different compliant structure. The recline mechanism could be used in a chair that doesn't have a rocking mechanism.

Other example modifications are outlined in the Summary of the Invention section.

What is claimed is:

1. A chair comprising a support shell having a seat portion and a back portion, a transom, and a recline mechanism, the recline mechanism comprising:

a resilient front support member having a first end operatively attached to the transom and a second end operatively attached to a front part of the seat portion; and a back support arm having a lower end operatively rigidly attached to the transom, an upper end operatively rigidly attached to the back portion, and a flex region having a rearward flexibility that is greater than the rearward flexibility of the rest of the back support arm;

wherein the back portion is reclinable relative to the seat portion and a rear part of the seat portion is configured to lift as the shell back portion reclines.

2. The chair according to claim 1, wherein the back support arm is attached to a lumbar portion or an upper portion of the back portion, or to both a lumbar portion and an upper portion of the back portion.

3. The chair according to claim 1, comprising two back support arms.

4. The chair according to claim 1, comprising two resilient front support members.

5. The chair according to claim 4, wherein the front support members second ends are positioned more laterally outward than the first ends.

6. The chair according to claim 1, wherein the back support arm flex region comprises a series of transverse notches or slots, said notches or slots providing the greater rearward flexibility.

7. The chair according to claim 6, wherein the notches or slots are provided on a front side of the back support arm.

8. The chair according to claim 1, wherein the back support arm upper end is operatively rigidly attached to a lumbar portion of the back portion, or wherein the back support arm upper end is rigidly attached to an upper portion of the back portion.

9. The chair according to claim 1, wherein the lifting of the rear part of the seat portion is partially controlled by a length and stiffness of the front support member.

10. The chair according to claim 1, wherein at least a major portion of the support shell comprises a compliant structure, the compliant structure having a plurality of cells interconnected by a plurality of resilient members.

11. The chair according to claim 10, wherein the compliant structure, in combination with the support arm, enables recline of the back portion relative to the seat portion.

12. The chair according to claim 1, wherein the support shell comprises an integral back portion, seat portion, and joining portion between the back portion and the seat portion, wherein at least a major portion of the chair support shell comprises a compliant structure, the compliant structure having a plurality of cells interconnected by a plurality of resilient members, wherein each of the plurality of cells has a side and each of the plurality of cells is interconnected to at least one other of the plurality of cells by at least one of the plurality of resilient members extending therebetween, wherein a plurality of voids are defined in spaces between the plurality of cells interconnected by the plurality of resilient members, wherein the compliant structure provides compliance in the seat portion, compliance in the back portion, and compliance in the joining portion, wherein the compliant structure enables recline of the back portion relative to the seat portion, and wherein the plurality of cells and the plurality of resilient members together define an auxetic structure.

13. The chair according to claim 12, wherein the plurality of voids are each Y-shaped and are provided in a series of offset rows or columns or offset rows and columns.

14. The chair according to claim 12, wherein the cells are substantially triangular.

15. The chair according to claim 12, wherein the cells comprise an occupant-facing surface having a recess.

16. The chair according to claim 12, wherein a plurality of the resilient members extend from each cell.

17. The chair according to claim 12, wherein the resilient members are substantially straight.

18. The chair according to claim 12, wherein the support shell is configured to cause deformation of the joining portion, as the back portion is reclined.

19. The chair according to claim 12, wherein the support shell comprises a single piece of injection moulded plastic.

20. The chair according to claim 12, wherein the support shell has a solid perimeter portion that is substantially non-compressible and substantially non-extendible, such that a length of the perimeter is substantially unchanged as the back portion reclines or flexes, or as the seat portion flexes.

* * * * *